US012520990B2

(12) United States Patent
Kim et al.

(10) Patent No.: US 12,520,990 B2
(45) Date of Patent: Jan. 13, 2026

(54) DISHWASHER

(71) Applicant: LG ELECTRONICS INC., Seoul (KR)

(72) Inventors: Jongyoung Kim, Seoul (KR); Dongho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 366 days.

(21) Appl. No.: 18/080,285

(22) Filed: Dec. 13, 2022

(65) Prior Publication Data

US 2023/0210340 A1 Jul. 6, 2023

(30) Foreign Application Priority Data

Dec. 31, 2021 (KR) ..... 10-2021-0194339
Dec. 31, 2021 (KR) ..... 10-2021-0194340
Dec. 31, 2021 (KR) ..... 10-2021-0194341
Dec. 31, 2021 (KR) ..... 10-2021-0194343

(51) Int. Cl.
*A47L 15/48* (2006.01)
*A47L 15/42* (2006.01)
*F24H 3/02* (2022.01)

(52) U.S. Cl.
CPC ..... *A47L 15/486* (2013.01); *A47L 15/4223* (2013.01); *F24H 3/022* (2013.01)

(58) Field of Classification Search
None
See application file for complete search history.

(56) References Cited

FOREIGN PATENT DOCUMENTS

| | | | | |
|---|---|---|---|---|
| DE | 1020122033 20 | | 6/2016 | |
| EP | 3000377 | A1 * | 3/2016 | ..... A47L 15/481 |
| EP | 3000377 | | 8/2017 | |
| WO | WO2009/008828 | | 1/2009 | |
| WO | WO2009/028803 | | 3/2009 | |
| WO | WO2019/015284 | | 1/2019 | |

OTHER PUBLICATIONS

Extended European Search Report in European Appln. No. 22212213.7, mailed on May 16, 2023, 8 pages.

* cited by examiner

*Primary Examiner* — Cristi J Tate-Sims
(74) *Attorney, Agent, or Firm* — Fish & Richardson P.C.

(57) ABSTRACT

The present disclosure relates to a dishwasher in which a single heater bracket is used to support and fix a heater in a heater housing, thereby reducing flow resistance against dry airflow flowing in the heater housing and minimizing the generation of noise, and in which the heater bracket, and a supporting leg supporting the heater housing with respect to a base are fastened to the heater housing at the same time by a single fastener, thereby simplifying the inner structure of the heater housing and minimizing costs incurred for assembling and manufacturing a dry air supply part.

19 Claims, 34 Drawing Sheets

DISHWASHER

CROSS-REFERENCE TO RELATED APPLICATION

This application claims priority to and the benefit of Korean Patent Application No. 10-2021-0194339, filed on 2021 Dec. 31, and 10-2021-0194340, filed on 2021 Dec. 31, and 10-2021-0194341, filed on 2021 Dec. 31, and 10-2021-0194343, filed on 2021 Dec. 31, the disclosures of which are incorporated herein by reference in its entirety.

TECHNICAL FIELD

Disclosed herein is a dishwasher, and in particular, a dishwasher in which a single heater bracket is used to support and fix a heater in a heater housing, thereby reducing flow resistance against dry airflow flowing in the heater housing and minimizing the generation of noise, and in which the heater bracket, and a supporting leg supporting the heater housing with respect to a base are fastened to the heater housing at the same time by a single fastener, thereby simplifying the inner structure of the heater housing and minimizing costs incurred for assembling and manufacturing a dry air supply part.

BACKGROUND

Dishwashers spray wash water such as water to a wash target such as cooking vessels, cooking tools and the like accommodated in them to wash the wash target. At this time, wash water used for washing a wash target may include detergent.

Ordinarily, dishwashers are comprised of a wash tub forming a wash space, a storage part accommodating wash targets in the wash tub, a spray arm spraying wash water to the storage part, and a sump storing water and supplying wash water to the spray arm.

Dishwashers help to reduce time and efforts taken to clean wash targets such as cooking vessels and the like after meals, thereby ensuring improvement in user convenience.

Ordinarily, dishwashers perform a washing process of washing wash targets, a rinsing process of rinsing the wash targets, and a drying process of drying the wash targets after the washing and rinsing processes.

In recent years, the drying stage of dishwashers involves supplying high-temperature dry air into the wash tub to reduce a drying period and promote the effect of sterilizing wash targets.

As a related art, a dishwasher provided with a hot air supply device that generates and supplies high-temperature dry air after the washing and rinsing stages is disclosed in DE Patent Publication No. 102012203320 (prior art document 001).

In the dishwasher of document 001, a dry air spray part sprays dry air, generated through the hot air supply device that is disposed under a tub, into the tub.

Regarding the hot air supply device of prior art document 001, four rows of heaters that extends along the flow direction of dry air are provided to heat dry air, in a heater housing, and a plurality of heater brackets for fixing each of the heaters in four rows to the inside of the heater housing is provided in the heater housing.

However, regarding the dry air spray part of prior art document 001, the plurality of brackets for supporting and fixing each of the heaters in four rows is disposed at an air passage, an available cross sectional area of the air passage in which dry air flows decreases, and flow resistance increases, thereby causing flow noise.

Additionally, since the plurality of brackets needs to be assembled to the inside of the heater housing, the inner structure of the heater housing becomes complex, and assembly and manufacturing costs increase.

Further, a dishwasher provided with a hot air supply device generating is disclosed in EU Patent No. 3000377 (prior art document 002), and the hot air supply device generates and supplies high-temperature dry air after the washing and rinsing stages.

In the dishwasher of prior art document 002, dry air, generated through the hot air supply device that is disposed under a tub, sprays into the tub.

Regarding the hot air supply device of prior art document 002, a water discharge opening for discharging wash water reversely drawn into the tub outward is formed under a duct part that connects a heater housing to the tub.

To prevent the reversely drawn wash water from flowing to a heater, the heater housing and the duct part form a flow path having an approximate V shape with respect to the horizontal direction, and the water discharge opening is disposed at the lowermost end side of the V shape.

To embody the V-shaped flow path structure, an upper end opening of the water discharge opening of prior art document 002 is formed in a position where the direction of dry airflow changes. In the V-shaped flow path structure, there is a big change in the direction of dry airflow, and the shape of the flow path causes flow loss. Additionally, dry airflow having passed through the heater leaks at least partially towards a base through the upper end opening of the water discharge opening. The flow loss and the leakage of dry air cause deterioration of the efficiency in the production of dry air.

Further, according to prior art document 002, a plurality of fasteners such as a screw bolt and the like for connecting a fan housing to the heater housing is included, deteriorating assemblability in the process of fastening the fan housing to the heater housing and structural reliability.

Further, in the dishwasher of prior art document 002, dry air generated through the hot air supply device disposed under the tub sprays into the tub.

Regarding the hot air supply device of prior art document 002, a plurality of fastening parts connects between the heater housing accommodating the heater, and the duct part connecting the heater housing to the tub. Additionally, the duct part has a plurality of bends.

In the hot air supply device of prior art document 002, when wash water is reversely drawn from the tub, the reversely drawn wash water is highly likely to leak through the plurality of fastening parts, and the leaking wash water is highly likely to imposes damage to electronic components.

In the hot air supply device of prior art document 002, the reversely drawn wash water is collected in the duct part having the plurality of bends, causing a reduction in the available cross-sectional area of the passage through which dry air passes. Accordingly, the flow rate of dry air decreases, and the collected wash water causes the electric leakage of the heater.

Regarding the hot air supply device of prior art document 002, the heater housing that accommodates the heater, and the fan housing that accommodates a fan-motor assembly generating dry airflow connect through a plurality of fastening parts. Further, because of limitations caused by the structures and shapes of the heater housing and the fan housing, an additional assembly jig for maintaining a temporary assembly between the heater housing and the fan housing is required at a time when the heater housing and the fan housing are assembled with a fastener such as a screw bolt and the like.

The hot air supply device of prior art document 002 does not ensure its structural reliability since the fan housing is fastened and fixed to the heater housing through the plurality of fastening parts, resulting in an increase in the man hours input for manufacturing and deterioration in the structural reliability.

Furthermore, the hot air supply device of prior art document 002 needs to be additionally provided with an exclusive assembly jig for assembling the fan housing and the heater housing, causing a significant increase in manufacturing costs.

PRIOR ART DOCUMENT

Patent Document (Document 001) DE Patent Publication No. 102012203320

(Document 002) EP Patent No. 3000377

SUMMARY

The first objective of the present disclosure is to provide a dishwasher in which a heater is supported and fixed in a heater housing with a single heater bracket, thereby reducing flow resistance against dry airflow flowing in the heater housing and minimizing the generation of noise.

The second objective of the present disclosure is to provide a dishwasher in which a heater bracket, and a supporting leg supporting the heater housing with respect to a base are fastened to a heater housing at the same time with a single fastener, thereby simplifying the inner structure of the heater housing and minimizing the costs of assembling and manufacturing a dry air supply part.

The third objective of the present disclosure is to provide a dishwasher in which the number of fasteners is minimized and a fastening structure is simplified such that a fan housing connects to a heater housing through a housing connector, and a fastening hole of the heater housing serves as a wash water discharge hole, thereby ensuring improvement in assemblability and structural reliability.

The fourth objective of the present disclosure is to provide a dishwasher in which an air passage is formed in a heater housing so that the flow direction of dry airflow may be parallel with the horizontal direction, and a fastening hole serving as a drain hole extends in a direction parallel with the flow direction of dry airflow, thereby minimizing the flow loss of dry airflow.

The fifth objective of the present disclosure is to provide a dishwasher in which a heater housing and a connection duct part connect to each other based on surface-to-surface contact, and the their coupling surface extends in a direction parallel with the horizontal direction, thereby preventing wash water drawn reversely from the upper end portion of the connection duct part from leaking through the coupling surface effectively, and minimizing the leakage of dry air through the coupling surface.

The sixth objective of the present disclosure is to provide a dishwasher in which an outlet of a heater housing and a lower end suction opening of a connection duct part have a non-circular shape, and the heater housing and the connection duct part connect in a sliding manner, thereby preventing the misassembly between the heater housing and the connection duct part effectively while improving the assemblability between the heater housing and the connection duct part.

The seventh objective of the present disclosure is to provide a dishwasher in which a fan housing and a housing connector in an upside-down state are assembled in the state of being supported with respect to the ground surface without an exclusive assembly jig, while the fan housing is fastened to the housing connector through a plurality of fastening members, thereby ensuring a significant reduction in the number of fasteners and the man hours input for manufacturing and significant improvement in structural reliability.

The eighth objective of the present disclosure is to provide a dishwasher in which a filter housing, a fan housing and a housing connector are fastened by a pair of fastening members at the same time, thereby ensuring significant improvement in assemblability and a reduction in manufacturing costs.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

A dishwasher according to the present disclosure comprises: a tub accommodating a wash target and having a wash space a front surface of which is open; a dry air supply part being disposed at a lower portion side of the tub, generating dry airflow for drying the wash target and supplying the dry airflow into the tub; and a base being disposed at a lower portion side of the dry air supply part and supporting the dry air supply part, the dry air supply part, comprising: a heater housing having an air passage through which the dry airflow flows, therein; and a hearer being disposed at the air passage at least partially and heating the dry airflow, wherein a penetration hole serving as any one of a fastening hole, a coupling hole or a drain hole is formed on a bottom surface of the heater housing.

The dry air supply part may comprise: a heater bracket being disposed at the air passage and supporting the heater in the state of separating the heater from the bottom surface of the heater housing; and a support leg being disposed between the heater housing and the base and elastically supporting the heater housing with respect to the base, wherein the heater bracket and the support leg may be fixed to the bottom surface of the heater housing at the same time through a single fastener, and the penetration hole may comprise a fastening hole through the single fastener passes and extends.

Regarding the fastener, a head part being provided in one end portion may join the heater bracket, and a screw thread being provided in the other portion may be a screw bolt that is screw-coupled to the support leg.

Additionally, a screw hole may be provided on the bottom surface of the heater housing, and the other end portion of the screw bolt may penetrate and extend through the screw hole.

The support leg may comprise a leg body having an upper side surface that surface-contacts a lower portion of the bottom surface of the heater housing and a lower end portion that is supported by the base, and having a hollow hole shape; and a screw boss extending downward from the upper side surface and being screw-coupled with the crews thread of the screw bolt.

The support leg may further comprise a pair of first coupling projections through which the other end portion of the screw bolt passes, which is spaced apart from each other with a through hole, being formed at an upper end of the screw boss, therebetween, and which protrudes toward the bottom surface of the heater housing from the upper side surface of the leg body.

The support leg may further comprise a second coupling projection being disposed between the pair of first coupling projections and an outer side edge of the upper side surface of the leg body, and protruding from the upper side surface of the leg body toward the bottom surface of the heater housing.

The pair of first coupling projections and the second coupling projection may be integrally provided on the upper side surface of the leg body.

The penetration hole may be provided with a pair of first coupling holes into which the pair of first coupling projections is inserted respectively, and a second coupling hole into which the second coupling hole is inserted.

As the pair of first coupling projections is inserted into the pair of first coupling holes respectively, each of the pair of first coupling projections may be elastically deformed at least partially.

As the second coupling projection is inserted into the second coupling hole, the second coupling projection may be elastically deformed at least partially.

The penetration hole may further comprise a drain hole being integrally formed at the second coupling hole in succession, and draining wash water, being reversely drawn from the tub, toward the base.

Further, a cross section of the drain hole may be greater than a cross section of the second coupling hole.

Further, a lower portion of the drain hole may be partially open in a way that the lower portion of the drain hole is partially blocked by the upper side surface of the leg body.

The drain hole may be formed in a position lower than a position of the heater with respect to the up-down direction.

The heater bracket may comprise: a perpendicular extension part extending in a direction farther from the bottom surface of the heater housing; a heater holder being integrally formed at the perpendicular extension part, and being forcibly coupled to an outer surface of the heater; and a horizontal extension part integrally connecting to a lower end of the perpendicular extension part and extending in a direction parallel with the bottom surface of the heater housing, wherein the horizontal extension part may be provided with a bolt groove through which the screw bolt passes.

The horizontal extension part may join the head part of the screw bolt.

The horizontal extension part may be fixed between the pair of first coupling projections.

The dry air supply part may further comprise: a fan housing being disposed at an upstream side of the heater housing with respect to a flow direction of the dry airflow, and accommodating an air blowing fan that generates the dry airflow; and a housing connector having one side to which the fan housing is detachably coupled, and the other side to which an open front end of the heater housing is detachably coupled, wherein the housing connector may be provided with a holding projection that protrudes toward the heater housing, and the penetration hole may further comprise a fastening hole to which the holding projection is coupled.

The fastening hole may be open at least partially in the state of being coupled with the holding projection.

The fastening hole may be open at least partially toward the base.

The fastening hole may extend in a direction parallel with a flow direction of the dry airflow.

The housing connector may comprise a connector main body having an inlet into which dry airflow discharged from the fan housing is drawn, at a front end portion thereof, and having a box shape; a connection tab protruding toward the fan housing from the front end portion, and being coupled with the fan housing, wherein the open front end of the heater housing may be detachably coupled to a rear end portion of the connector main body, which is formed at a downstream side of the front end portion and at least partially open, and the holding projection may protrude toward the fastening hole from the rear end portion of the connector main body.

The holding projection may be integrally formed in the rear end portion of the connector main body.

The fastening hole may be formed in a position lower than a position of an inner lower surface of the connector main body with respect to the up-down direction.

The bottom surface of the heater housing may comprise an inclined surface that has an upward inclination angle at which an up-down height gradually increases along the flow direction from the open front end, and the fastening hole may be formed on the inclined surface.

Further, a drain hole may be formed on the inclined surface, and be at least partially open toward the base in a lower stream of the fastening hole with respect to the flow direction.

The drain hole may be formed in a position lower than a position of a lower end portion of the heater with respect to the up-down direction.

The dry air supply part may further comprise a support leg being disposed between the heater housing and the base and elastically supporting the heater housing with respect to the base, and the drain hole may be formed at an upper side of the support leg.

The drain hole may be at least partially blocked by the support leg.

The heater housing may comprise a lower housing having an entirely open upper surface, having the heater fixed therein and having a box shape; and an upper housing being coupled to an upper side of the lower housing and partially covering the open upper surface of the lower housing, wherein as the rear end portion of the connector main body is coupled to the front end of the heater housing, the rear end portion of the connector main body may be partially inserted into the lower housing.

The rear end portion of the connector main body, inserted into the lower housing, may surface-contact an inner surface of the lower housing.

As the rear end portion of the connector main body is coupled to the front end of the heater housing, an upper side surface of the upper housing may cover a partially open upper surface of the connector main body past the rear end portion of the connector main body.

The upper side surface of the upper housing may be inserted into the connector main body partially.

The upper side surface of the upper housing, inserted into the connector main body, may surface-contact the inner surface of the connector main body.

The dry air supply part may further comprise: a connection duct part guiding the dry airflow, having passed through the heater housing, to the tub, wherein the heater housing may be provided with an outlet which has an upper surface being open at least partially and through which the dry airflow is discharged, and an expansion surface that extends around the outlet along the horizontal direction, and a lower end of the connection duct part may fluid-connect with the outlet while contacting the expansion surface.

Further, a flange surface may be provided at the lower end of the connection duct part, and expand horizontally in parallel with the expansion surface while surface-contacting the expansion surface.

The heater housing may comprise a lower housing having an entirely open upper surface, having the heater fixed therein and having a box shape; and an upper housing being coupled to an upper side of the lower housing, partially covering the open upper surface of the lower housing and forming the outlet, wherein the expansion surface may be integrally formed around the open upper surface of the lower housing.

A horizonwise width of the flange surface may be greater than a horizonwise width of the expansion surface.

Further, a horizonwise outer end portion of the flange surface may extend in the horizontal direction past the expansion surface.

The connection duct part may comprise a bridge part that protrudes from the flange surface in the perpendicular direction and has a lower side surface having a shape corresponding to a shape of the upper side surface of the upper housing.

As the flange part of the connection duct part is coupled to the expansion surface, the lower side surface of the bridge part and the upper side surface of the upper housing may be surface-contacted at least partially.

The expansion surface and the flange surface may be coupled in a sliding manner while any one of the connection duct part or the heater housing moves relatively in the horizontal direction toward the rest.

Further, a guide wall and at least one of guide projections may be provided in a horizonwise outer end portion of the flange surface, and the guide wall may extend along an outer end portion of the flange surface to have a shape corresponding to a shape of a horizonwise outer end portion of the expansion surface, and at least one of the guide projections may protrude toward a lower portion of the expansion surface from the guide wall.

As the slide coupling is completed, a perpendicular relative movement of the expansion surface may be blocked by the guide projection and the flange surface.

As the slide coupling is completed, the horizonwise outer end portion of the expansion surface may contact the guide wall at least partially.

The lower housing, the upper housing and the connection duct part may be fastened together through at least one of hasteners.

At least one of the fasteners may be a screw bolt, and a screw thread formed in one end portion of the screw bolt may pass through the lower housing and the upper housing and be screw-coupled to the bridge part.

Further, a screw boss may be integrally provided in one end portion and the other end portion of the bridge part, and one end portion of the screw bolt may be screw-coupled to the screw boss.

The outlet may have a cross section of a non-circular shape, and an inlet may be formed at the lower end of the connection duct part and have a cross section of a non-circular shape corresponding to the shape of the outlet.

The dry air supply part may further comprise a fan housing being disposed at an upstream side of the heater housing with respect to a flow direction of the dry airflow, and accommodating an air blowing fan that generates the dry airflow; and a housing connector having one side to which the fan housing is detachably coupled, and the other side to which the heater housing is detachably coupled, the housing connector, comprising: a pair of fastening bosses protruding in the perpendicular direction, in a state of being disposed at the base, and being detachably coupled with the fan housing; and a main body holding rib protruding in the perpendicular direction, in a state of being disposed at the base, and extending in a direction across a flow direction of the dry airflow, wherein an upper end of the pair of fastening bosses and an upper end of the main body holding rib may be disposed on the same flat surface.

The housing connector may comprise: a connector main body having an inlet into which dry airflow discharged from the fan housing is drawn, at a front end portion thereof and having a box shape; and a connection tab protruding from the front end portion toward the fan housing, covering an upper surface of the fan housing and having a plate shape, wherein the pair of fastening bosses may protrude from an upper surface of the connection tab in the perpendicular direction, and the main body holding rib may protrude from the upper surface of the connector main body in the perpendicular direction.

The fan housing and the housing connector may be fastened and assembled to each other through the fastener, in an upside-down state of a state in which the fan housing and the housing connector are disposed at the base.

The fastener may be a screw bolt, and a screw thread formed in one end portion of the screw bolt may pass through the fan housing and the connection tab and be coupled to the pair of fastening bosses.

In the upside-down state, an up-down position of an upper end of the pair of fastening bosses may be the same.

In the upside-down state, the fan housing and the housing connector may be supported by the upper end of the pair of fastening bosses and an upper end of the main body holding rib in the gravitational direction.

In the upside-down state, an up-down position of the upper end of the main body holding rib may be the same as the up-down position of the upper end of the pair of fastening bosses.

In the upside-down state, the up-down position of the upper end of the main body holding rib may remain constant along a direction across a flow direction of the dry airflow.

The pair of fastening bosses may be spaced from each other in the radial direction, with a rotation axis of the air blowing fan therebetween.

The upper end of the main body holding rib may extend in a direction parallel with a flow direction of the dry airflow and extend linearly along a direction across an extension line passing through the center of the inlet, and the pair of fastening bosses may be spaced formed each other with the extension line therebetween.

Further, a straight line passing through the center of the pair of fastening bosses and the rotation center of the rotation axis may form an acute angle with respect to the direction where the upper end of the main body holding rib extends.

The fan housing may comprise: an exhaust duct from which air accelerated through the air blowing fan is discharged and which is inserted and coupled to the inlet of the connector main body; and a pair of bolt fastening parts which is disposed under the pair of fastening bosses and through which one end portion of the screw bolt passes and extends.

Further, a stopper projection may be provided in the connector main body and join the exhaust duct and stop the insertion of the exhaust duct, and as the exhaust duct joins the stopper projection, the pair of bolt fastening parts may be aligned with the fastening bosses respectively corresponding to the bolt fastening parts to allow one end portion of the screw bolt to penetrate.

The dry air supply part may further comprise a filtering part that filters air suctioned into the fan housing, and the fan housing may be disposed in the filtering part.

The filtering part may comprise a filter housing accommodating the fan housing and being provided in a way that is segmented vertically, and may be fixed to the lower housing forming a segmented lower portion of the filter housing.

In the upside-down state of the state in which the fan housing and the housing connector are disposed at the base, the lower housing may be fastened to the fan housing and the housing connector through the screw bolt.

The head part provided in the other end portion of the screw bolt may join the lower housing, and the screw thread formed in one end portion of the screw bolt may pass through the lower housing and the fan housing and be screw-coupled to the fastening boss.

A dishwasher according to the present disclosure has the advantages of reducing flow resistance against dry airflow flowing in a heater housing and minimizing the generation of noise.

The dishwasher has the advantages of ensuring the implication of the inner structure of the heater housing and minimizing the costs of assembling and manufacturing a dry air supply part.

The dishwasher has the advantage of minimizing the transfer of high-temperature heat generated in the heater housing to a base since a supporting leg is made of an elastic material exhibiting heat resistance.

The dishwasher has the advantages of minimizing the number of fasteners and ensuring the simplification of a fastening structure, to ensure significant improvement in assemblability and structural reliability.

The dishwasher has the advantage of minimizing the leakage of dry airflow to prevent a decrease in dry efficiency.

The dishwasher has the advantages of ensuring the minimization of an angle of a change in a flow direction and minimizing the flow loss of dry airflow, to prevent deterioration in drying efficiency.

The dishwasher has the advantage of preventing wash water reversely drawn from the upper end portion of a connection duct part from leaking through a coupling surface of the heater housing and the connection duct part effectively.

The dishwasher has the advantage of minimizing the leakage of dry air through the coupling surface of the heater housing and the connection duct part, to prevent deterioration in drying efficiency.

The dishwasher has the advantages of ensuring improvement in the assemblability between the heater housing and the connection duct part and preventing the misassembly therebetween effectively.

The dishwasher has the advantage of ensuring a significant reduction in manufacturing costs and improvement in assemblability, since an exclusive assembly jig is omitted.

The dishwasher has the advantage of ensuring structural reliability and a significant reduction in man hours input for assembly, since a pair of fastening members such as a screw bolt and the like is used to fasten a filter housing, a fan housing and a housing connector at the same time.

Specific effects are described along with the above-described effects in the section of detailed description.

BRIEF DESCRIPTION OF DRAWINGS

The accompanying drawings constitute a part of the specification, illustrate one or more embodiments in the disclosure, and together with the specification, explain the disclosure, wherein.

DETAILED DESCRIPTION

Figure 1:
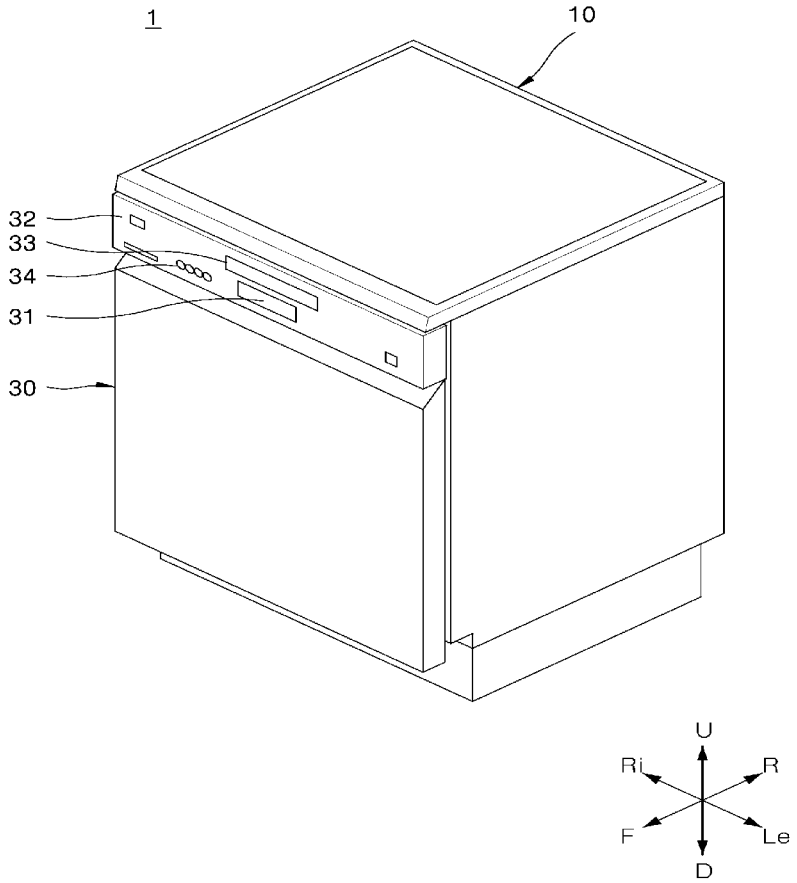
FIG. 1 is front perspective view showing a dishwasher of one embodiment.

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Below, preferred embodiments according to the disclosure are specifically described with reference to accompanying drawings. In the drawings, identical reference numerals can denote identical or similar component.

The terms "first", "second" and the like are used herein only to distinguish one component from another component. Thus, the components should not be limited by the terms. Certainly, a first component can be a second component, unless stated to the contrary.

Throughout the disclosure, each component can be provided as a single one or a plurality of ones, unless explicitly stated to the contrary.

When one component is described as being "in the upper portion (or lower potion)" or "on (or under)" another component, one component can be directly on (or under) another component, and an additional component can be interposed between the two components.

When any one component is described as being "connected", "coupled", or "connected" to another component, any one component can be directly connected or coupled to another component, but an additional component can be "interposed" between the two components or the two components can be "connected", "coupled", or "connected" by an additional component.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Hereafter, the subject matter of the present disclosure is described with reference to the drawings showing the configuration of the dishwasher 1 of the embodiment.

[Entire Structure of Dishwasher]

Hereafter, the entire structure of the dishwasher of one embodiment is describer with reference to the accompanying drawings.

Figure 2:
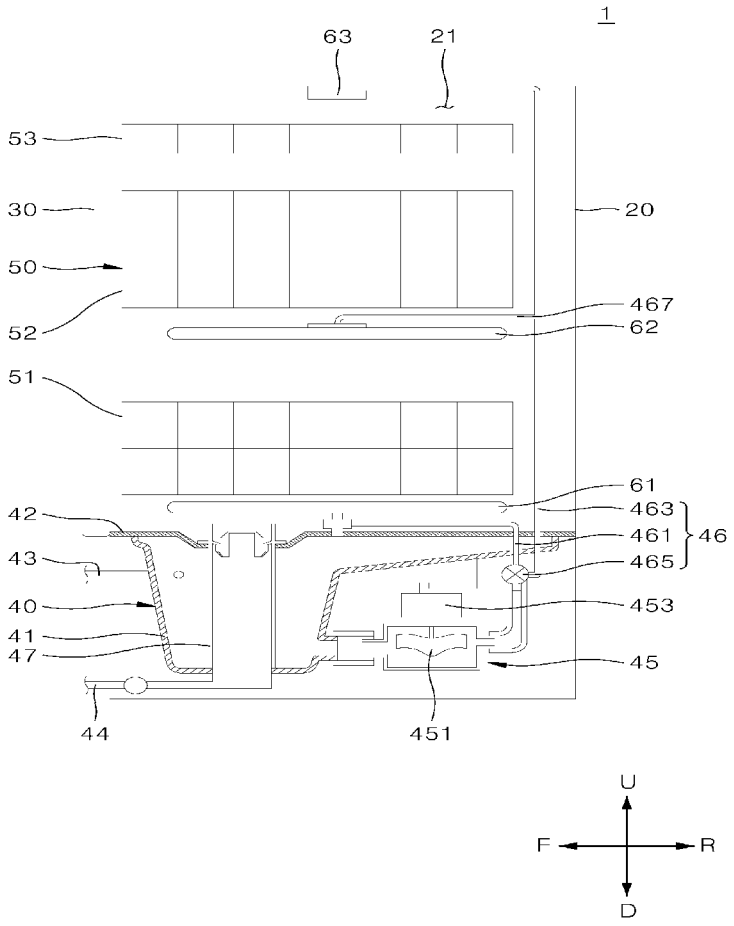
FIG. 2 is a schematic cross-sectional view showing the dishwasher in FIG. 1.

FIG. 1 is a front perspective view showing a dishwasher according to the present disclosure, and FIG. 2 is a schematic cross-sectional view schematically showing the inner structure of the dishwasher according to the present disclosure.

As illustrated in FIGS. 1 to 2, the dishwasher 1 according to the present disclosure comprises a case 10 forming the exterior of the dishwasher 1, a tub 20 being installed in the case 10, forming a wash space 21 in which a wash target is washed and having a front surface that is open, a door 30 opening and closing the open front surface of the tub 20, a driving part 40 being disposed under the tub 20 and supplying, collecting, circulating and draining wash water for washing a wash target, a storage part 50 being provided detachably in the wash space 21 in the tub 20 and allowing a wash target to be mounted on, and a spray part 60 being installed near the storage part 50 and spraying wash water for washing a wash target.

At this time, wash targets mounted in the storage part 50 may be cooking vessels such as bowls, dishes, spoons, chopsticks, and the like, and other cooking tools, for example. Hereafter, the wash targets are referred to as cooking vessels, unless mentioned otherwise.

The tub 20 may be formed into a box the front surface of which is open entirely, and may be a so-called wash tub.

The tub 20 may have a wash space 21 therein, and its open front surface may be opened and closed by the door 30.

The tub 20 may be formed in a way that a metallic sheet having strong resistance against high-temperature and moisture, e.g., a stainless steel-based sheet, is pressed.

Additionally, a plurality of brackets may be disposed on the inner surfaces of the tub 20 and allow functional components such as a storage part 50, a spray part 60 and the like, which are described below, to be supported and installed in the tub 20.

The driving part 40 may comprise a sump 41 storing wash water, a sump cover 42 distinguishing the sump 41 from the tub 20, a water supply part 43 supplying wash water to the sump 41 from the outside, a drain part 44 discharging wash water of the sump 41 to the outside, and a water supply pump 45 and a supply channel 46 for supplying wash water of the sump 41 to the spray part 60.

The sump cover 42 may be disposed at the upper side of the sump 41, and distinguish the sump 41 from the tub 20. Additionally, the sump cover 42 may be provided with a plurality of return holes for returning wash water, having sprayed to the wash space 21 through the spray part 60, to the sump 41.

That is, wash water having sprayed toward cooking vessels from the spray part 60 may fall to the lower portion of the wash space 21 and return to the sump 41 through the sump cover 42.

The water supply pump 45 is provided in a lateral portion or the lower portion of the sump 41, and pressurizes wash water and supplies the same to the spray part 60.

the supply channel 46. The water supply pump 45 may be provided with an impeller 451, a motor 453 and the like. As power is supplied to the motor 453, the impeller 451 may rotate, and wash water of the sump 41 may be pressurized and then supplied to the spray part 60 through the supply channel 46.

The supply channel 46 may selectively supply the wash water supplied by the water supply pump 45 to the spray part 60.

For example, the supply channel 46 may comprise a first supply channel 461 connecting to a lower spray arm 61, and a second supply channel 463 connecting to an upper spray arm 62 and a top nozzle 63. The supply channel 46 may be provided with a supply channel diverting valve 465 selectively opening and closing the supply channels 461, 463.

At this time, the supply channel diverting valve 465 may be controlled to allow each of the supply channels 461, 463 to be opened consecutively or opened simultaneously.

The spray part 60 is provided to spray wash water to cooking vessels and the like stored in the storage part 50.

Specifically, the spray part 60 may comprise a lower spray arm 61 being disposed under the tub 20 and spraying wash water to a lower rack 51, an upper spray arm 62 being disposed between the lower rack 51 and an upper rack 52 and spraying wash water to the lower rack 51 and the upper rack 52, and a top nozzle 63 being disposed in the upper portion of the tub 20 and spraying wash water to a top rack 53 or the upper rack 52.

In particular, the lower spray arm 61 and the upper spray arm 62 may be rotatably provided in the wash space 21 of the tub 20, and spray wash water toward cooking vessels in the storage part 50 while rotating.

The lower spray arm 61 may be rotatably supported at the upper side of the sump cover 42 such that the lower spray arm 61 may spray wash water to the lower rack 51 while rotating under the lower rack 51.

Additionally, the upper spray arm 62 may be rotatably supported by a spray arm holder 467 such that the upper spray arm 62 may spray wash water while rotating between the lower rack 51 and the upper rack 52.

The tub 20 may be further provided with a means on a lower surface 25 thereof, to enhance washing efficiency, and the means diverts the direction of wash water having sprayed from the lower spray arm 61 in the upward direction (U-direction).

Since a well-known configuration can be applied to the configuration of the spray part 60, detailed description of the configuration of the spray part 60 is omitted hereafter.

The storage part 50 for storing cooking vessels may be provided in the wash space 21.

The storage part 50 may be withdrawn through the open front surface of the tub 20 from the inside of the tub 20.

For example, FIG. 2 shows an embodiment provided with a storage part comprising a lower rack 51 that is disposed in the lower portion of the tub 20 and stores relatively large-sized cooking vessels, an upper rack 52 that is disposed at the upper side of the lower rack 51 and stores medium-sized cooking vessels, and a top rack 53 that is disposed in the upper portion of the tub 20 and stores small-sized cooking vessels and the like. However, the subject matter of the present disclosure is not limited to the embodiment. Hereafter, a dishwasher that is provided with three storage parts 50, as illustrated, is described.

Each of the lower rack 51, the upper rack 52 and the top rack 53 may be withdrawn outward through the open front surface of the tub 20.

To this end, the tub 20 may have a guide rail (not illustrated), on both lateral walls thereof that form the inner circumferential surface of the tub 20, and for example, the guide rail may comprise an upper rail, a lower rail, a top rail and the like.

Each of the lower rack 51, the upper rack 52 and the top rack 53 may be provided thereunder with wheels. A user may withdraw the lower rack 51, the upper rack 52 and the top rack 53 outward through the front surface of the tub 20 to easily store cooking vessels on the racks or take out cooking vessels from the racks after a washing process.

The guide rail 54 may be provided as a fixed guide rail that guides the withdrawal and insertion of the spray part 60 in the form of a simple rail or as a stretchable guide rail which guides the withdrawal and storage of the spray part 60 and the withdrawal distance of which increases as the spray part 60 is withdrawn.

The door 30 is used for opening and closing the open front surface of the tub 20 that is described above.

Ordinarily, a hinge part (not illustrated) for opening and closing the door 30 is provided in the lower portion of the open front surface, and the door 30 is open while rotating around the hinge part as a rotation axis.

The door 30 may be provided with a handle 31 and a control panel 32 on the outer surface thereof. The handle 31 is used for opening the door 30, and the control panel 32 is used for controlling the dishwasher 1.

As illustrated, the control panel 32 may be provided with a display 33 that visually displays information on a current operation state and the like of the dishwasher, and a button part 34 comprising a selection button to which the user's selection manipulation is input, a power button to which the user's manipulation for turning on-off the power source of the dishwasher is input, and the like.

The inner surface of the door 30 may form a mounting surface that supports the lower rack 51 of the storage part 50 as the door 30 is fully opened as well as forming one surface of the tub 20 as the door 30 is closed.

To this end, as the door 30 is fully opened, the inner surface of the door 30 forms a horizontal surface in the same direction where the guide rail 54, by which the lower rack 51 is guided, extends, for example.

Though not illustrated in FIGS. 1 and 2, a dry air supply part may be provided under the tub 20, and generate high-temperature dry air and supply the same into the tub 20 as described hereafter. The tub 20 may be provided with at least one of dry air supply holes, on the lower surface thereof, and high-temperature dry air generated in the dry air supply part may flow into the tub 20 through the dry air supply hole.

[Detailed Configuration of Dry Air Supply Part]

Hereafter, the detained configuration of the above-described dry air supply part 80 is described with reference to FIGS. 3 to 8.

Figure 3:
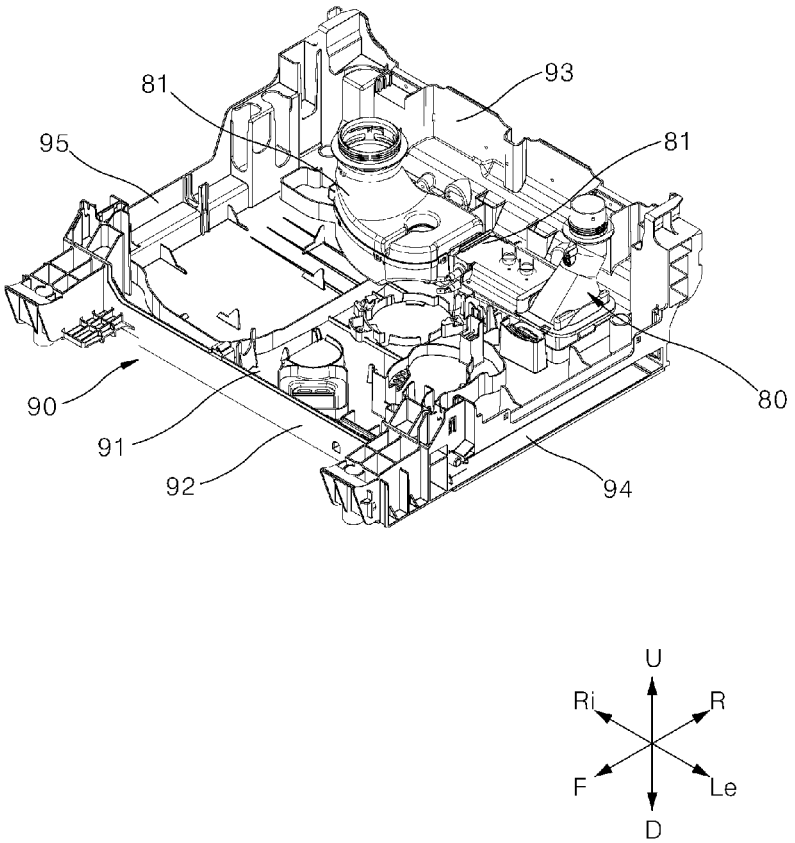
FIG. 3 is a front perspective view showing a dry air supply part of the dishwasher of one embodiment, which is accommodated in a base.

As illustrated in FIG. 3, the dry air supply part 80 may be accommodated in a base 90 and may be disposed to be supported by a lower surface 91 of the base 90.

For example, the dry air supply part 80 may be disposed in a position adjacent to a rear surface 93 of the base 90, and disposed in a position between a leakage detecting part and the rear surface 93 of the base 90, approximately in parallel with the rear surface 93 of the base 90.

The position in which the dry air supply part is disposed may be selected considering the characteristics of the dry air supply part 80 that generates heat of about 100° C. or greater in a high-temperature dry air supply mode. That is, the dry air supply part may be disposed to avoid electronic components that are relatively under great influence of high-temperature heat.

Additionally, the arrangement position of the dry air supply part may be selected based on the position of the dry air supply hole formed on the lower surface of the tub 20. That is, considering the user's safety, the dry air supply hole into which dry air flows may be formed at the corner of the lower surface of the tub 20, which is adjacent to the rear surface and the left side surface of the tub 20.

To effectively generate dry air and supply the same to the dry air supply hole formed in the above-described position, the dry air supply part 80 may be disposed at the lower portion side of the dry air supply hole.

The arrangement position of the dry air supply part 80 is described exemplarily. The dry air supply part 80 may be disposed near a left side surface 94, a right side surface 95 or a front surface 92 of the base 90 rather than the rear surface 93 of the base 90. Hereafter, the dry air supply part 80 disposed near the rear surface 93 of the base 90 approximately in parallel with the rear surface 93 is described, but the position of the dry air supply part 80 is not limited.

Figure 4:
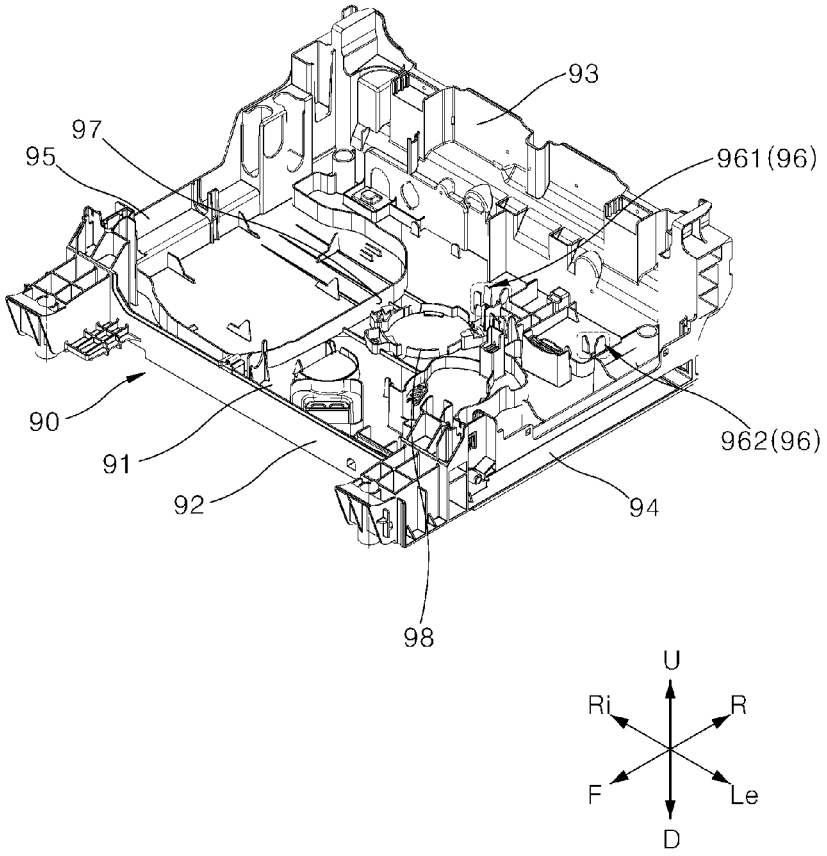
FIG. 4 is a front perspective view showing FIG. 3 without the dry air supply part.
Figure 5:
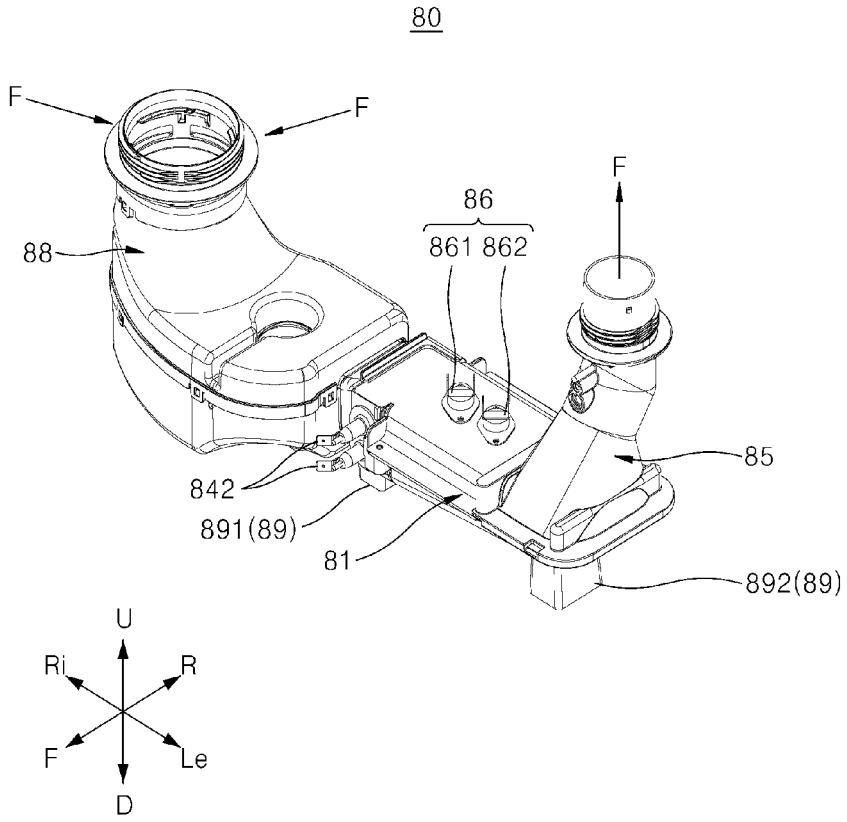
FIG. 5 is a front perspective view showing the dry air supply part in FIG. 3.
Figure 6:
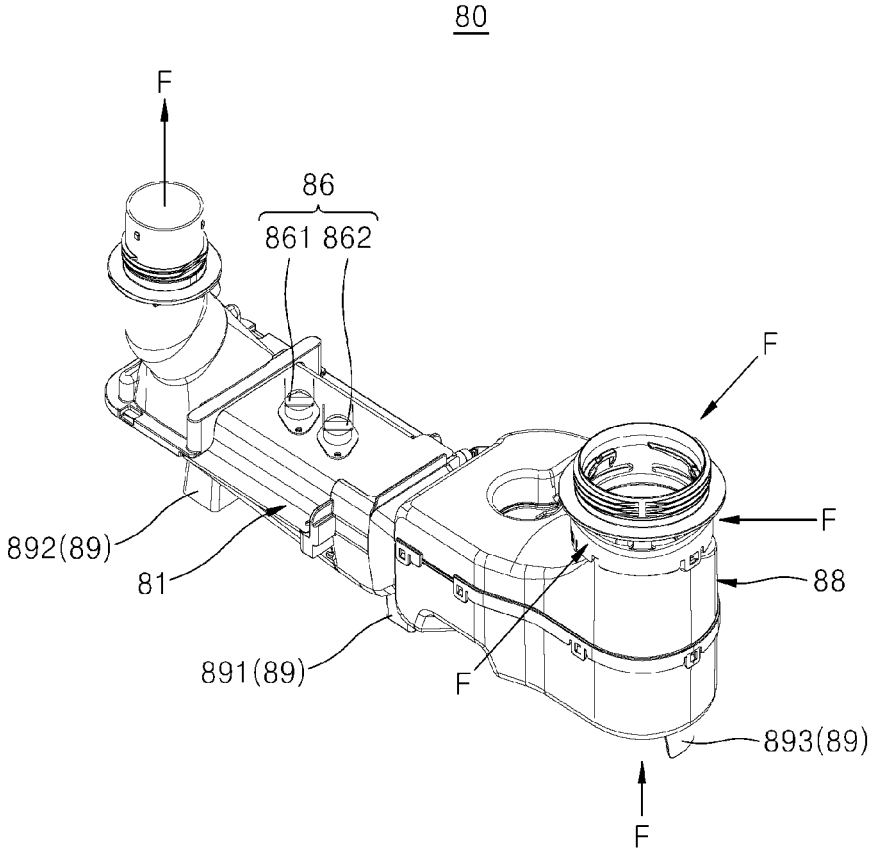
FIG. 6 is a rear perspective view showing the dry air supply part in FIG. 3.

Additionally, as illustrated in FIG. 4, a support rib 96 for supporting the dry air supply part 80 and preventing the escape of the dry air supply part 80, a plurality of guide ribs 98 setting the position of a leakage detecting part (not illustrated) that detects whether wash water leaks from the tub 20 and preventing the escape of the leakage detecting part (not illustrated), and a wash water rib 97 for guiding wash water being discharged from the dry air supply part 80 to the leakage detecting part may be provided on the lower surface 91 of the base 90.

The support rib 96, the guide ribs 98 and the wash water rib 97 may be formed integrally on the lower surface 91 of the base 90.

As illustrated, the support rib 96 may be divided into a first support rib 961 that supports the middle portion of the dry air supply part 80 from below, and a second support rib 962 that supports the left side of the dry air supply part 80 from below.

A below-described first leg 891 of the dry air supply part 80 is coupled to the first support rib 961, and a below-described second leg 892 of the dry air supply part may be coupled to the second support rib 962.

FIGS. 5 to 8 show a detailed configuration of the dry air supply part 80.

As illustrated, the dry air supply part 80 generating dry air and supplying the same into the tub 20 may comprise an air blowing fan 83 that generates dry airflow F to be supplied into the tub 20, a heater 84 that heats dry air, a heater housing 81 that has an air passage C in which the heater 84 is accommodated, and a filtering part 88 that filters air to be suctioned into the air blowing fan 83.

The air blowing fan 83 is disposed at the upstream side in the direction of dry airflow F with respect to the heater 84 and the heater housing 81, and accelerates air to the air passage C formed in the heater housing 81 to generate dry airflow F.

The air blowing fan 83, and an air blowing motor (not illustrated) generating rotational driving force of the air blowing fan may be mutually modularized, and form an assembly in a way that the air blowing fan and the air blowing motor are accommodated in the fan housing 82.

The air blowing fan 83 and the fan housing 82 may be fixed to a housing connector 87 that connects a filer housing 881 of the below-described filtering part 88 and the heater housing 81.

Specifically, the air blowing fan 83 and the fan housing 82 may be accommodated entirely in the filter housing 881 in the state of being fixed to the housing connector 87.

The type of the air blowing fan to be applied to the dry air supply part 80 is not limited, but a sirocco fan, for example, is preferred considering the position and space limitations in the installation of the air blowing fan.

When a sirocco fan is applied as shown in the illustrative embodiment, filtered air may be suctioned from the lower portion of the fan housing 82, in a direction that is parallel a direction from the center of the sirocco fan to the rotational axis of the same, and be accelerated and discharged outward in the radial direction.

The accelerated and discharged air may form dry airflow F and be drawn into the air passage C in the heater housing 81 through the fan housing 82 and an inlet 8712 of the housing connector 97.

At this time, the air blowing fan, e.g., a sirocco fan, and a rotation shaft of the motor may be disposed to have directionality approximately parallel with the up-down direction (U-D direction), and filtered air may be suctioned through the lower surface of the fan housing 82, for example.

Further, a PCB substrate for controlling the moor may be built into an upper surface 821 of the fan housing 82, which is on the opposite side of the lower surface into which filtered air is suctioned.

The fan housing 82, as illustrated, may be fixed to a ring-type connection tab 872 provided at the housing connector 87 through a fastener such as a screw bolt that is not illustrated, and the like, for example.

Figure 7:
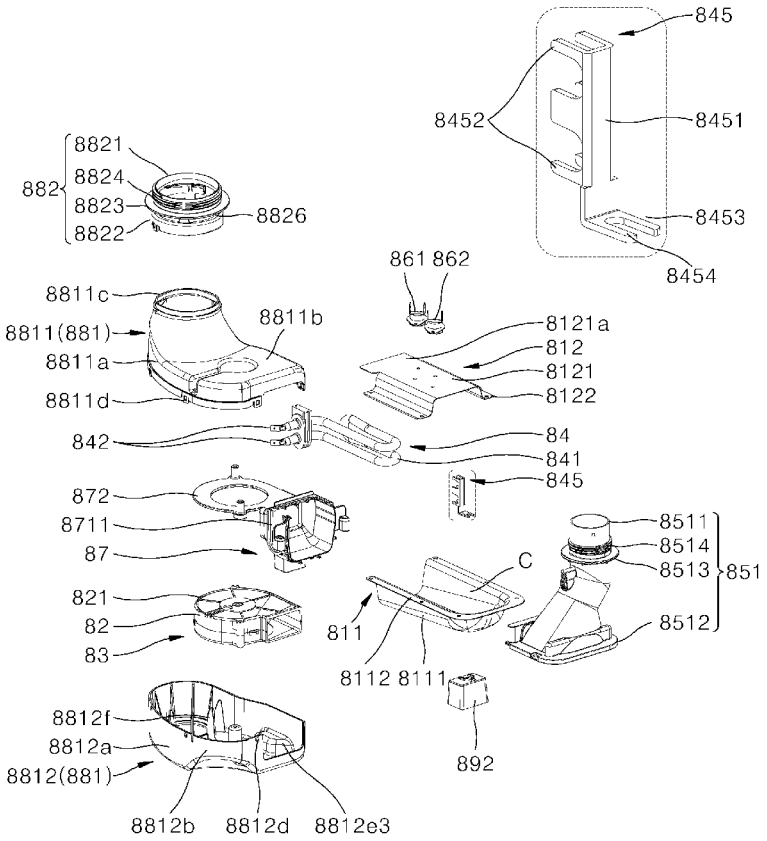
FIGS. 7 and 8 are exploded perspective views showing the dry air supply part in FIG. 3.
Figure 8:
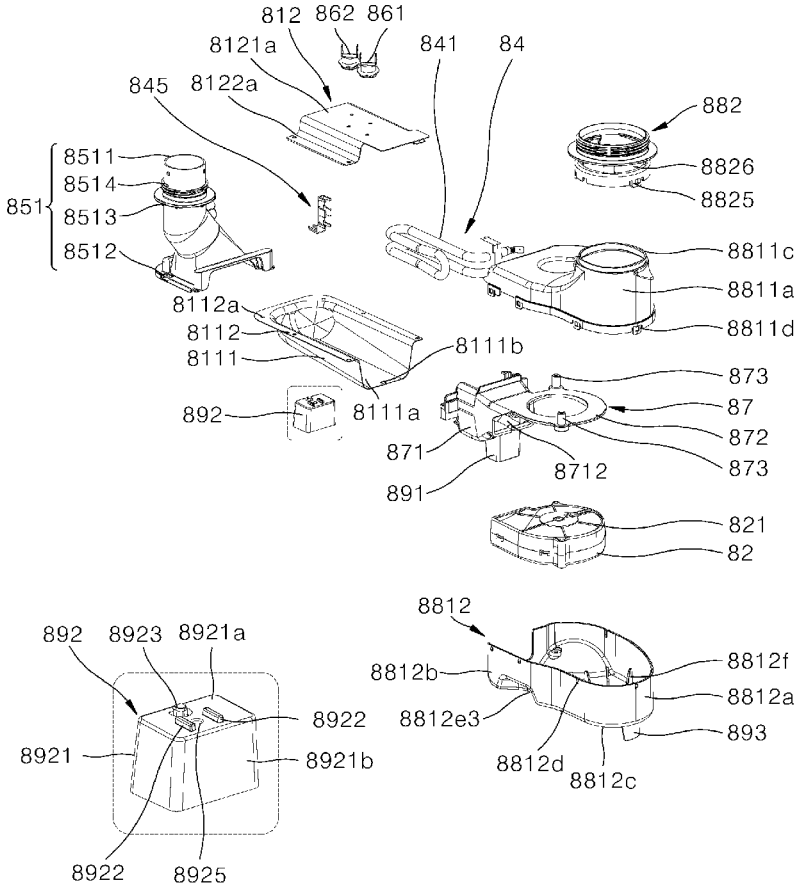

The connection tab 872 may extend in a direction where the connection tab 872 covers from the inlet 8712 of a connector main body 871 to the upper surface 821 of the fan housing 82, and the connection tab 872, as illustrated in FIGS. 7 and 8, may be provided with a pair of fastening bosses 873 that extend from the upper surface of the connection tab 872 in the upward direction (U-direction).

Each of the pair of fastening bosses 873 may have a screw hole to which a screw bolt is screw-coupled.

At a time of screw bolt-based fastening, the connection tab 872 and the fan housing 82 may be assembled in a reversed state of the state in FIGS. 7 and 8, i.e., in the state where the up-down positions of the connection tab 872 and the fan housing 82 are reversed, or in an upside-down state of the connection tab 872 and the fan housing 82. At this time, the pair of fastening bosses 873 may serve as a leg that supports the connection tab 872 and the fan housing 82 against the gravitational direction in a non-fastening state.

The heater 84 is disposed in the air passage C of the heater housing 81, and preferably, is directly exposed to dry airflow F in the air passage C and heats the dry airflow F.

When the dry air supply part 80 supplies high-temperature dry air, power may be supplied to the heater 84, and the heater may heat dry air, and when the dry air supply part 80 supplies low-temperature dry air, the supply of power to the heater 84 may be cut off, and the heater 84 may stop operating.

At this time, when low-temperature dry air is supplied, the air blowing motor may keep operating to generate dry airflow F.

The type of the heater 85 provided in the dry air supply part 80 of one embodiment is not limited, but a tube-type sheath heater may be selected since the sheath heater has a relatively simple structure, ensures excellent heat generation efficiency and helps to prevent electric leakage caused by the reverse inflow of wash water that flows from the tub 20 reversely, for example.

To enhance heat exchange efficiency, the heater main body 841 that is a sheath heater may have a stereoscopic shape having a plurality of bends, to be directly exposed to dry airflow F at the air passage C in the heater housing 81 and ensure a maximum heat transfer surface.

One end portion and the other end portion of the heater main body 841 may pass through the front surface of the connector main body 871 of the above-described housing connector 87 and extend.

Additionally, a pair of terminals 842 for receiving power may be formed in one end portion and the other end portion of the heater main body 841.

As illustrated, the pair of terminals 842 may be installed in and fixed to the connector main body 871 through a terminal fixation part 843.

At this time, a fixation slot 8711 may be provided on the front surface of the connector main body 871 to allow the terminal fixation part 843 to be fit-coupled to the connector main body 871 in a sliding manner.

A slit-type groove that extends in a sliding direction, i.e., in the up-down direction (U-D direction), may be formed on both lateral surfaces of the terminal fixation part 843, and while the terminal fixation part 843 slides from the upper side to the lower side, the edge of the fixation slot 8711 is inserted into the slit-type groove and fit-coupled to the slit-type groove.

As described above, the front end side of the heater main body 841 may be fixed and supported by the terminal fixation part 843.

The rear end side of the heater main body 841, as illustrated in FIGS. 7 and 8, may be fixed and supported by a single heater bracket 845 disposed in the heater housing 81. That is, the rear end side of the heater main body 841 may be supported on the air passage through the heater bracket 845 in the state of being separated from the heater housing 81.

The heater bracket 845 may be made of a metallic material considering the function of the heater main body 841 that generates high-temperature heat, and preferably, manufactured in a way that a metallic sheet highly resistant against high temperature and moisture, e.g., a stainless steel-based sheet, is pressed.

For example, the heater bracket 845 may be manufactured to have an L shape as illustrated in the partially enlarged view of FIG. 7.

As shown in the illustrative embodiment, in the L shape, a perpendicular extension part 8451 that extends in the up-down direction (U-D direction) may be provided with two heater holders 8452 forcibly coupled to the outer surface of the heater main body 841 to correspond to two rows of the heater main body 841 to effectively support the heater main body 841 that extends in two rows.

A pair of heater holders 8452 may be provided, and spaced vertically from the perpendicular extension part 8451 to correspond to the two rows of the heater main body 841 that are spaced along the up-down direction (U-D direction). Each of the heater holders 8452 may have a C-shaped exterior to correspond to the exterior of the tube-type heater main body 841.

Each of the heater holders 8452 may be forcibly coupled to the outer surface of the heater main body 841 in a way that the heater holder 8452 is plastically deformed when the heater holder 8452 is coupled to the heater main body 841, and before being fixed to the bottom surface 8111*a* of the heater housing 81, may be forcibly coupled to the heater main body 841 and modularized.

In the L shape, a horizontal extension part 8453 that extends approximately along the left-right direction (Le-Ri direction) may be integrally formed at the lower end of the perpendicular extension part 8451.

The horizontal extension part 8453 may directly contact a bottom surface 8111*a* of a lower housing 811 and support the heater main body 841 and the heater bracket 845, and be fixed to the bottom surface 8111*a* of the lower housing 811.

The horizontal extension part 8453 may have a notch-type bolt groove 8454 through which a screw bolt passes and extends such that the horizontal extension part 8453 is fixed to the bottom surface 8111*a* of the lower housing 811 through a fastener such as a screw bolt and the like. Accordingly, the horizontal extension part 8453 may have a U shape with the bolt groove 8454.

A screw bolt that fixes the horizontal extension part 8453 may pass through the bolt groove 8454 and the bottom surface 8111*a* of the lower housing 811, extend to the second leg 892 disposed under the horizontal extension part 8453 outside the lower portion of the lower housing 811, and be screw-coupled to the second leg 892.

That is, the heater bracket 845, the lower housing 811 and the second leg 892 may be fastened at the same time by a single screw bolt, thereby simplifying a fastening structure and an assembly process.

Further, as illustrated in FIGS. 5 to 8, a temperature sensor as a temperature sensing part 86 sensing the temperature of high-temperature dry air generated through the heater 84 or detecting the overheating of the heater 84 may be provided on an upper side surface 8121*a* of an upper housing 812 of the heater housing 81.

For example, the temperature sensor may comprise a thermistor 861 that senses the temperature of dry air, and a thermostat 862 that detects the overheating of the heater 84.

An output signal of the temperature sensor may be delivered to a non-illustrated controller, and the controller may receive the output signal of the temperature sensor to determine the temperature of high-temperature dry air and the overheating of the heater 84. As the heater 84 overheats, the controller may cut off the supply of power to the heater 84 and change the operation mode of the dry air supply part 80 from the high-temperature dry air mode to the low-temperature dry air mode.

The heater housing 81 may be formed into a hollow hole that has a vacant inner space such that the air passage C, in which the above-described heater main body 841 and heater bracket 845 are disposed, is formed.

At this time, for dry airflow F to move, the front end portion of the heater housing 81, corresponding to the upstream side with respect to the direction of the movement of the dry airflow F, and the rear end portion of the heater housing 81, corresponding to the downstream side with respect to the direction of the movement of the dry airflow F, may be open at least partially.

To easily form the air passage having the front end portion and the rear end portion that are at least partially open, as described above, the heater housing 81 may comprise a lower housing 811 and an upper housing 812 that are disposed in a way that the lower housing 811 and the upper housing 812 are divided with respect to the up-down direction (U-D direction), for example. Hereafter, the heater housing 81 comprising the lower housing 811 and the upper housing 812, which are disposed in a way that the heater housing 81 is divided in the up-down direction as illustrated, is described as an example, but not limited.

The lower housing 811 constituting the lower portion of the heater housing 81 may comprise a concave part 8111 that is convex downward in the state where the lower housing 811 is disposed, and an expansion surface 8112 that extends horizontally in the form of a flange from the circumferential edge of the concave part 8111.

For example, the concave part 8111 and the expansion surface 8112 may be formed integrally.

The concave part 8111 that is convex downward constitutes the lower portion of the air passage C formed in the heater housing 81.

A maximum length of the air passage C may be ensured with respect to the flow direction of dry airflow F, as illustrated, and to improve the efficiency of heat exchange with the heater 84 disposed in the heater housing 81, the left-right length of the concave part 8111 may be greater than the front-rear width of the concave part 8111.

Additionally, the right end portion of the lower housing 811, corresponding to the upper stream with respect to the direction of the movement of dry airflow, may be open in a way that the right end portion is entirely cut perpendicularly, and the left end portion, corresponding to the lower stream, may be closed rather than being opened.

A bottom surface 8111*a* of the concave part 8111 may be formed into an inclined surface the up-down height of which increases gradually from the right end portion of the lower housing 811 to the left end portion. By doing so, the cross-sectional area of the air passage C formed through the bottom surface 8111*a* may decrease gradually, and flow loss, caused by the generation of eddy current at the left end side where the direction of dry airflow changes, may be minimized.

The bottom surface 8111*a* of the concave part 8111 may have a plurality of penetration holes 8111*b* comprising a fastening hole formed for a coupling to the above-described housing connector 87 and a coupling hole formed for fixing the above-described heater bracket 845 and the second leg 892.

At this time, at least a portion of the plurality of penetration holes 8111*b* may serve as a drain hole for discharging wash water, flowing reversely through a below-described connection duct part 85, toward the base 90.

The expansion surface 8112 extending in the form of a flange may be formed to extend approximately in parallel with the horizontal direction.

The expansion surface 8112 provides a means of increasing a contact surface with an expansion surface 8122 of the upper housing 812 and a duct main body 851 of the connection duct part 85, which are described below, to enhance coupling strength and to minimize the leakage of dry airflow. The minimization of the leakage of dry airflow may lead to the prevention of a reduction in the dry air supply efficiency of the dry air supply part 80.

In the illustrative embodiment, the expansion surface 8112 may be formed along the circumferential edge of the concave part 8111 expect for the right end portion of the lower housing 811 continuously and integrally.

As described above, the expansion surface 8112 of the lower housing 811 may have a plurality of screw holes 8112*a* that are formed in a way that penetrates vertically, such that the expansion surface 8122 of the upper housing 812 and the duct main body 851 of the connection duct part 85 may be effectively coupled to the expansion surface 8112 of the lower housing 811.

The lateral surface of the lower housing 811 connecting the bottom surface 8111*a* and the expansion surface 8112 of the lower housing 811 may be formed into at least any one of an inclined surface or a curved surface or a combination thereof, to prevent a rapid change in the cross-sectional area of the air passage C and minimize the flow resistance of dry airflow.

The lower housing 811 may be formed in a way that a metallic sheet that has strong resistance against high temperature and moisture, considering that the heater main body 841 generating high-temperature heat is disposed in the lower housing and that the lower housing is directly exposed to wash water flowing reversely from the tub 20, e.g., a stainless steel-based sheet having approximately uniform thickness, is pressed.

Additionally, the upper housing 812 constituting the upper portion of the heater housing 81 may comprise a concave part 8121 that is convex upward in the state where the upper housing 812 is disposed, and an expansion surface 8122 that extends horizontally in the form of a flange from the circumferential edge of the concave part 8121.

For example, the concave part 8121 and the expansion surface 8122 may be formed integrally.

The concave part 8121 that is convex upward constitutes the upper portion of the air passage C provided in the heater housing 81.

Like the lower housing 811, a maximum length of the air passage C may be ensured with respect to the flow direction of dry airflow F, as illustrated, and to improve the efficiency of heat exchange with the heater 84 disposed in the heater housing 81, the left-right length of the concave part 8121 may be greater than the front-rear width of the concave part 8121.

However, as described hereafter, the left-right length of the upper housing 812 may be less than the left-right length of the lower housing 811 to form an outlet from which dry air having passed through the heater main body 841 is discharged. That is, because of a difference in the left-right lengths, at least a portion of the left end side of the lower housing 811 may not be covered by the upper housing 812 and be open in the upward direction (U-direction). The left end side of the lower housing 811, which is open at least partially, forms an outlet that is open in the upward direction (U-direction).

The right end portion of the upper housing 812, corresponding to the upper stream, and the left end portion of the upper housing 812, corresponding to the lower stream, with respect to the direction of the movement of dry airflow may be open in a way that the right end portion and the left end portion are entirely cut perpendicularly.

An upper side surface 8121*a* of the concave part 8121 may be formed into a flat surface the up-down height of which is maintained constantly from the right end portion of the upper housing 812 to the left end portion. As described above, a temperature sensing part 86 may be attached to the outside of the upper side surface 8121*a* of the concave part 8121.

As illustrated in FIG. 7, the right end portion of the upper side surface 8121*a* formed into a flat surface may extend further toward the housing connector 87 than the expansion surface 8122. By doing so, the right end portion of the upper side surface 8121*a* may be inserted into the connector main body 871 of the housing connector 87 at least partially and coupled to the connector main body 871. Accordingly, as the upper housing 812 and the connector main body 871 are coupled, a contact surface or a coupling surface between the upper housing 812 and the connector main body 871 may increase, and the outward leakage of dry airflow flowing in the housing connector 87 and the heater housing 81 may be minimized.

The connector main body 871 may be provided with a means for increasing a contact surface or a coupling surface with the right end portion of the upper side surface 8121*a* of the upper housing 812, to correspond to the right end portion of the upper side surface 8121*a*.

The expansion surface 8122 extending in the form of a flange may extend approximately in parallel with the horizontal direction to correspond to the expansion surface 8112 of the lower housing 81.

In the illustrative embodiment, the expansion surface 8122 may be formed at the front side and the rear side of the concave part 8121 except for the right end portion and the left end portion of the upper housing 812 continuously and integrally.

The expansion surface 8122 of the upper housing 812 may have a plurality of screw holes 8122*a* that are formed in a way that penetrates vertically, to correspond to the above-described screw holes 8112*a* of the lower housing 811.

Like the lower housing 811, the lateral surface of the upper housing 812 connecting the upper side surface 8121*a* and the expansion surface 8122 of the upper housing 812 may be formed into at least any one of an inclined surface or a curved surface or a combination thereof, to prevent a rapid change in the cross-sectional area of the air passage C and minimize the flow resistance of dry airflow.

Further, like the lower housing 811, the upper housing 812 may be formed in a way that a metallic sheet that has strong resistance against high temperature and moisture, e.g., a stainless steel-based sheet, is pressed.

The dry air supply part 80 may further comprise a connection duct part 85 that is coupled to an outlet, formed at the left end side of the heater housing 81 and being open in the upward direction (U-direction), and has an air passage therein.

As described above, the heater housing 81 and the air blowing fan 82 are disposed below the lower surface 25 of the tub 20. The connection duct part 85 guides dry air being discharged from the heater housing 81 to a predetermined position, i.e., the dry air supply hole formed at the tub 20.

For example, the predetermined position may be the lower surface 25 of the tub 20, and the dry air supply hole into which dry airflow F guided to the connection duct part 85 is drawn may be formed at a corner of the lower surface 25 of the tub 20, which is adjacent to the rear surface 23 and the left side surface 26.

As shown in the illustrative embodiment, the duct main body 851 of the connection duct part 85 may have a shape that is capable of changing the direction dry airflow and connecting the dry air supply hole of the tub 20 and the outlet of the heater housing 81.

For example, the duct main body 851 of the connection duct part 85 may have a cylinder shape that allows of the fluid communication of a lower end portion 8512 with the outlet of the heater housing 81 and allows an upper end portion 8511 to extend in the upward direction (U-direction) and connect to the dry air supply hole.

The lower end portion 8512 of the duct main body 851 may be coupled to the lower housing 811 of the heater housing 81 in a sliding manner.

Specifically, a guide wall and a guide projection for guiding a slide coupling and maintaining a coupling state of the expansion surface 8112 of the lower housing 811 may be integrally provided in the lower end portion 8512 of the duct main body 851, formed into a flange surface.

Additionally, a bridge part may be provided in the lower end portion 8512 of the duct main body 851 in a way that protrudes upward from the lower end portion 8512 of the duct main body 851, and the inner surface of the bridge part has a shape corresponding to the outer shape of the left end portion of the upper housing 812 such that the left end portion of the upper hosing 812 is inserted in a sliding manner.

Further, considering the shape of the cross section of the rectangle-shaped outlet of the heater housing 81, the lower end portion 8512 of the duct main body 851 may have a rectangle pillar shape, and for the prevention of leakage, the upper end portion 8511 of the duct main body 851 may have a cylinder shape.

That is, the duct main body 851 may have a cylinder shape to improve the efficiency of a coupling between the upper end portion 8511 of the duct main body 851 and the dry air supply hole 254 of the tub 20 and to prevent leakage.

As a means of improving coupling efficiency and preventing leakage, a ring-type flange 8513 and a male screw part 8514 may be provided at the upper end portion 8511 side of the duct main body 851.

The upper end portion 8511 of the duct main body 851 passes through the lower surface of the tub 20 and extends in the upward direction (U-direction), and the upper end portion 8511 of the duct main body 851 and the male screw part 8514 may pass through the lower surface of the tub 20 at least partially, and protrude toward the inside of the tub 20.

A fastening nut (not illustrated) may be coupled to the male screw part 8514 that is disposed by passing through the tub 20.

At a time of fixing and fastening the duct main body 851, the fastening nut is screw-coupled to the male screw part 8514 in the tub 20, and the upper end portion 8511 of the duct main body 851 may be fixed in the state of being exposed to the inside of the tub 20.

That is, the fastening nut 852 closely contacts the upper side of the lower surface of the tub 20, and the ring-type flange 8513 receives the force of being pulled toward the lower surface of the tub 20, with the fastening nut's coupling force, in the state of closely contacting the lower side of the lower surface of the tub 20. By doing so, adhesive force between the flange 8513 and the lower surface of the tub 20 increases. Thus, it is less likely that wash water leaks to the outer circumferential surface of the duct main body 851.

As a means of promoting the effect of preventing the leakage of wash water, an airtight ring (not illustrated) made of an elastic material may be additionally provided between the flange 8513 and the lower surface of the tub 20.

As the upper end portion 8511 of the duct main body 851 is fixed to the tub 20 through the fastening nut 852, the up-down (U-D direction) movement of the left end side of the heater housing 81 is limited by the duct main body 851 and fixed.

By doing so, a support structure for the upper side of the dry air supply part 80 may be obtained without an additional fastener.

A plurality of supporting legs 89 supporting the heater housing 81 and the like against the base 90 may serve as a support structure for the lower side of the dry air supply part 80.

The plurality of supporting legs 89 may comprise a first leg 891 that is provided under the housing connector 87 and supports the housing connector 87 with respect to the gravitational direction, a second leg 892 that is provided under the heater housing 81 and supports the heater housing 81 with respect to the gravitational direction, and a third leg 893 that is provided under the filtering part 88 and supports the filtering part 88 with respect to the gravitational direction.

For example, the first leg 891 may be formed integrally at the connector main body 871 of the housing connector 87 and protrude from the lower portion of the connector main body 871 toward the base 90.

Additionally, the second leg 892 may be coupled to the lower side of the lower housing 811 of the heater housing 81, and provided aside from the lower housing 811. The second leg 892 may be made of a different material, e.g., rubber having predetermined heat resistance and elasticity, from the material of the lower housing 811, to minimize the transfer of high-temperature heat generated from the lower housing 811 to the base 90 and effectively absorb vibrations and impacts.

Specifically, as illustrated in the enlarged view of FIG. 8, the second leg 892 is made of a different material apart from the lower housing 811 and assembled and fixed to the lower portion of the lower housing 811. Accordingly, the second leg 892 may be provided with a means of setting the right position of the second leg 892 with respect to the lower housing 811 and maintaining the temporary assembly of the second leg 892.

As such means, a plurality of coupling projections may be provided on an upper side surface 8921*a* of a leg body 8921 that plays the role of a coupling surface to the lower housing 811.

The plurality of coupling projections may comprise a pair of first coupling projections 8922 that extend in parallel with the lengthwise direction, i.e., the left-right direction, of the lower housing 811, and a second coupling projection 8923 that is provided between the pair of first coupling projections 8922 and an outer perimeter surface 8921*b*.

The right position and temporary assembly of the second leg 892 may be maintained in a way that the pair of first coupling projections 8922 and the second coupling projection 8923 are inserted into the first coupling hole and the second coupling hole provided on the bottom surface 8111*a* of the lower housing 811.

Additionally, a through hole 8925 through which a screw bolt fastening the heater bracket 845, the lower housing 811 and the second leg 892 at the same time passes as described above may be formed between the pair of first coupling projections 8922 on the upper side surface 8921*a* of the leg body 8921. A screw boss 8924 to which the screw bolt is screw-coupled may be formed integrally at the leg body 8921, under the through hole 8925.

Further, the third leg 893 may be integrally formed in the lower portion of the filter housing 881 constituting the filtering part 88 and protrude from the lower portion of the filter housing 881 to the base 90.

Though not illustrated, an airflow guide (not illustrated) that changes the direction of dry airflow being supplied through the duct main body 851 may be coupled to the upper end portion 8511 of the duct main body 851.

Additionally, the filtering part 88 may be disposed in the upper stream of the heater 84 with respect to the flow direction of dry airflow, to filter air to be suctioned into the air blowing fan 83.

Specifically, the filtering part 88 may comprise a filter member that filters air to be suctioned into the air blowing fan 83, and a hollow hole-type filter housing 881 that has an accommodation space in which the filter member and the air blowing fan 83 are accommodated.

As illustrated in FIGS. 5 to 8, the filter housing 881 may comprise a first housing 8811 and a second housing 8812 that are disposed in the form of a segment body segmented with respect to the up-down direction (U-D direction), for example.

Hereafter, the filter housing 881 comprising the first housing 8811 and the second housing 8812 that are divided and arranged vertically as illustrated is described as an example, but not limited.

The filter housing 881, as described above, accommodates and supports the filter member and the fan housing 82.

Accordingly, the first housing 8811 may be divided into a filter accommodation part 8811*a* and a fan housing accommodation part 8811*b* such that the first housing 8811 accommodates and supports the filter member and the fan housing 82 at least partially, preferably, accommodates and supports the upper portion of the filter member and the upper portion of the fan housing 82. As illustrated, the filter accommodation part 8811*a* and the fan housing accommodation part 8811*b* of the first housing 8811 are entirely open downward to allow the second housing 8812*b* to be coupled to the lower portion side thereof.

The filter accommodation part 8811*a* may be formed further upstream than the fan housing accommodation part 8811*b* with respect to the flow direction of dry airflow, and in the illustrative embodiment, formed on the right of the fan housing accommodation part 8811*b*.

The filter accommodation part 8811*a*, for example, may have a cylindrical outer shape such that the filter member having a cylinder shape is detachably accommodated.

The filter accommodation part 8811*a* may have a coupling opening 8811*c* at the upper end thereof, and the coupling opening 8811*c* is open in the form of a circle to correspond to the outer shape of the filter member. The filter member may move downward through the coupling opening 8811*c*, and move to a filter accommodation part 8812*a* of the second housing 8812.

The fan housing accommodation part 8811*b* may be formed further downstream than the filter accommodation part 8811*a* with respect to the flow direction of dry airflow, and in the illustrative embodiment, formed integrally at the filter accommodation part 8811*a*, on the right of the filter accommodation part 8811*a*, near the heater housing 81.

The fan housing accommodation part 8811*b* may have an inner shape corresponding to the outer shape of the upper portion of the fan housing 82, to cover the upper portion of the air blowing fan 83 entirely.

However, an opening may be formed in the central portion of the fan housing accommodation part 8811*b*, to expose the fan housing 82's upper surface 821 area where the PCB substrate is disposed at least partially, thereby cooling the above-described PCB substrate and motor of the air blowing fan 83. Additionally, a slit-type wash water channel may be provided on the upper side surface of the fan housing accommodation part 8811*b*, and have one end portion of which communicates with the opening and the other end portion of which extends forward. By doing so, wash water drawn through the opening may move through the wash water channel and be discharged toward the base.

The second housing 8812 of the filter housing 881 is coupled to the lower portion of the first housing 8811 to form a sealed accommodation space, and accommodates and supports the lower portions of the filter member and the fan housing 82.

Like the first housing 8811, the second housing 8812 may be divided into a filter accommodation part 8812*a* and a fan housing accommodation part 8812*b*, to accommodate and support the lower portion of the filter member and the lower portion of the fan housing 82.

As illustrated, the upper end of the second housing 8812 may be open entirely to be coupled to the lower end of the first housing 8811.

To correspond to the filter accommodation part 8811*a* of the first housing 8811, the filter accommodation part 8812*a*, provided under the filter accommodation part 8811*a* of the first housing 8811, may be provided with a plurality of filter guide ribs 8812*f* that effectively supports the lower end portion of the filter member and prevents the filter member's escape from the right position.

The filter guide rib 8812*f* may protrude from the bottom surface of the filter accommodation part 8812*a* upward, and be integrally formed on the bottom surface 8812*e* of the filter accommodation part 8812*a*.

Additionally, to correspond to the filter member's outer shape formed into a cylinder, the plurality of filter guide ribs 8812*f* may be arranged radially around the filter member.

As the center of the plurality of filter guide ribs 8812*f*, a lower suction opening 8812*c* may be formed on the bottom surface 8812*e* of the filter accommodation part 8812*a* in a penetrating manner, and allow external air to be suctioned.

The lower suction opening 8812*c* may have a circle shape to correspond to the outer shape of the filter member having a cylinder shape, and the outer diameter of the lower suction opening 8812*c* may be less than the outer diameter of the filter member to allow external air to be suctioned into the filter member.

The fan housing accommodation part 8812*b* may be formed further downstream than the filter accommodation part 8812*a* with respect to the flow direction of dry airflow, and in the illustrative embodiment, formed integrally at the filter accommodation part 8812*a*, on the right of the filter accommodation part 8812*a*, near the heater housing 81.

The fan housing accommodation part 8812*b* may have an inner shape corresponding to the outer shape of the lower portion of the fan housing 82, to cover the lower portion of the fan housing 82 entirely.

The bottom surface 8812*e* of the fan housing accommodation part 8812*b* may be spaced a predetermined distance apart from the lower surface 824 of the fan housing 82, to allow filtered air to be suctioned effectively, and for example, be formed into a flat surface parallel with the horizontal direction.

Additionally, a plurality of uplifted surface parts 8812*e*3 and a screw boss 8812*e*2 that protrude from the lower surface 824 may be provided in the fan housing accommodation part 8812*b*.

The plurality of uplifted surface parts 8812*e*3 is provided to avoid another structure disposed under the second housing 8812, and for example, provided to avoid the base's ribs and leakage detecting part disposed under the second housing 8812.

Accordingly, the shape of an individual uplifted surface part 8812*e*3 may vary depending on the shape of another avoided structure.

The fan housing 82, as described above, is supported in the state of being spaced a predetermined distance apart from the bottom surface of the fan housing accommodation part 8811*b*. The plurality of uplifted surface parts 8812*e*3 may be used as a support part that supports the fan housing 82 in the state of being spaced from the bottom surface of the fan housing accommodation part 8811*b*. Thus, the fan housing 82 may be disposed such that the lower surface of the fan housing 82 surface-contacts the upper end surface of an individual uplifted surface part 8812*e*3.

The screw boss 8812*e*2 supports the lower surface of the fan housing 82 together with an individual uplifted surface part 8812*e*3. Additionally, the screw boss 8812*e*2 may be provided with a bolt hole 8812*e*1 into which one of a pair of screw bolts fastening the fan housing 82 and the connection tab 872 of the housing connector 87 at the same time is inserted.

The remaining bolt 8812*e*1 may be formed at any one of the plurality of uplifted surface parts 8812*e*3 in a penetrating manner.

In the first housing 8811 and the second housing 8812 that are disposed in the form of a segment body as described above, the lower end of the first housing 8811 and the upper end of the second housing 8812 may be detachably coupled to each other.

To achieve the above-described detachable coupling relationship, a fastening tab 8811*d* extending toward the second housing 8812 is provided at the lower end of the first housing 8811, and a hook projection 8812*d* may be provided at the upper end of the second housing 8812 and fastened to the fastening tab 8811*d* based on a hook coupling.

A tub connection duct 882 may be detachably coupled and fastened to the coupling opening 8811*c* of the filter accommodation part 8811*a* of the first housing 8811.

The filter member of the filtering part 88 of one embodiment may be replaced through the lower surface of the tub 20.

To this end, the filter accommodation part 8811*a* of the first housing 8811 needs to connect to the lower surface of the tub 20, and the tub connection duct 882 connects the lower surface of the tub 20 and the filter accommodation part 8811*a* of the first housing 8811.

The tub connection duct 882 may be integrally provided at the filter accommodation part 8811*a* of the first housing 8811. However, the tub connection duct 882 provided additionally in the first housing 8811 in the illustrative embodiment is described, hereafter.

Like the duct main body 851 of the above-described connection duct part 85, an upper end portion 8821 of the tub connection duct 882 may pass through the lower surface of the tub 20 and extend upward as illustrated FIGS. 7 and 8.

A filter replacement hole may be provided on the lower surface of the tub 20 to allow the upper end portion 8821 of the tub connection duct 882 to be inserted. To distinguish the filter replacement hole from the dry air supply hole, the filter replacement hole may be formed at a corner of the lower surface of the tub 20, which is adjacent to the rear surface and the right side surface of the tub 20.

To improve coupling efficiency and prevent leakage between the upper end portion 8821 of the tub connection duct 882 and the filter replacement hole 253 of the tub 20, the tub connection duct 882 may be formed into a cylinder.

As a means of improving coupling efficiency and preventing leakage, a ring-type flange 8823 and a male screw part 8824 may be provided at the upper end portion 8821 side of the tub connection duct 882.

The upper end portion 8821 of the tub connection duct 882 may pass through the lower surface of the tub 20 and extend in the upward direction (U-direction), and the upper end portion 8821 of the tub connection duct 882 and the male screw part 8824 may pass through the lower surface of the tub 20 and protrude toward the inside of the tub 20 at least partially.

A fastening nut (not illustrated) may be coupled to the male screw part 8824 that is disposed by passing through the tub 20.

At a time of fixing and fastening the tub connection duct 882, the fastening nut is screw-coupled to the male screw part 8824, in the tub 20. Accordingly, the upper end portion 8821 of the tub connection duct 882 may be fixed in the state of being exposed to the inside of the tub 20.

Additionally, an upper suction opening 8826 into which external air is suctioned may be formed under the flange 8823 in a penetrating manner, between the upper end portion 8821 and a lower end portion 8822 of the tub connection duct 882.

After external air having passed through the upper suction opening 8826 enters into the filter member, the external air may be filtered while passing through the outer circumferential surface of the filter member.

That is, in the filtering part 88 according to the present disclosure, external air may flow into the filter member through two suction paths comprising the lower suction opening 8812*c* provided at the second housing 8812 and the upper suction opening 8826 provided at the tub connection duct 882. By doing so, a sufficient flow rate of dry airflow F required to dry a wash target may be ensured effectively.

Further, a fastening part 8825 for providing a detachably fastening function to the coupling opening 8811*c* of the first housing 8811 may be integrally provided in the lower end portion 8822 of the tub connection duct 882. For example, the fastening part 8825 may be a fastener that is coupled to the coupling opening 8811*c* of the first housing 8811 based on a hook coupling.

[Detailed Structure and Assembly Process of Heater Bracket and Second Leg]

Hereafter, a detailed structure of the heater bracket 845 and the second leg 892 of the dishwasher of one embodiment and the process of assembling the heater bracket 845 and the second leg 892 to the heater housing 81 are described with reference to FIG. 9.

Figure 9:
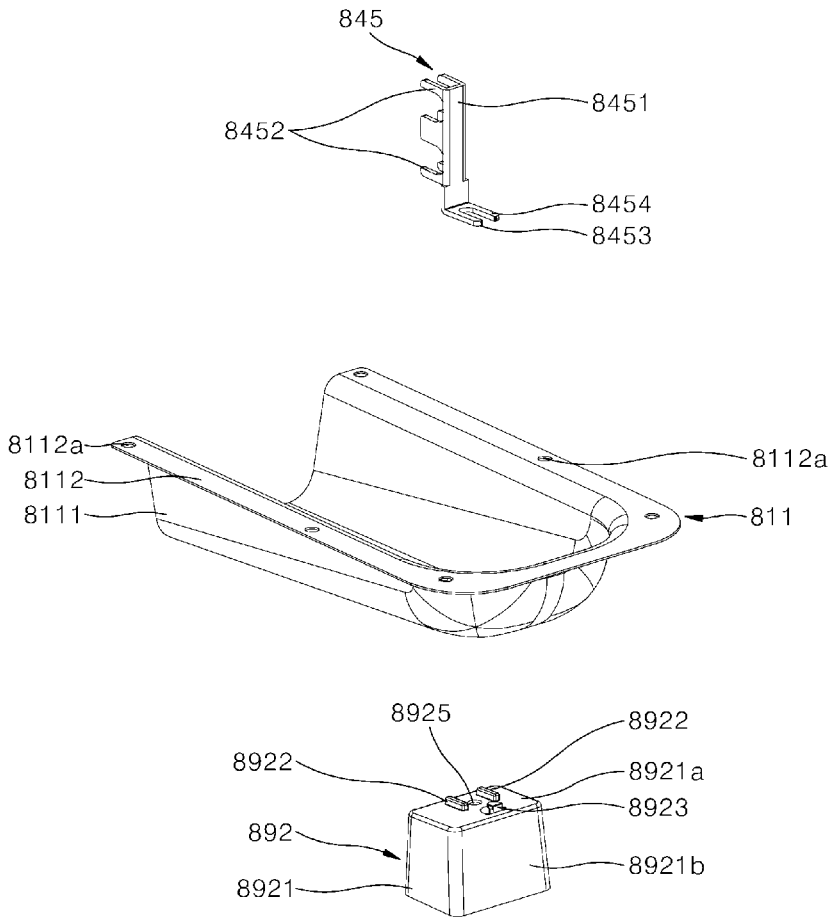
FIGS. 9 and 10 are exploded perspective views for describing a relative relationship among a lower housing of a heater housing, a heater bracket, and a second leg.
Figure 10:
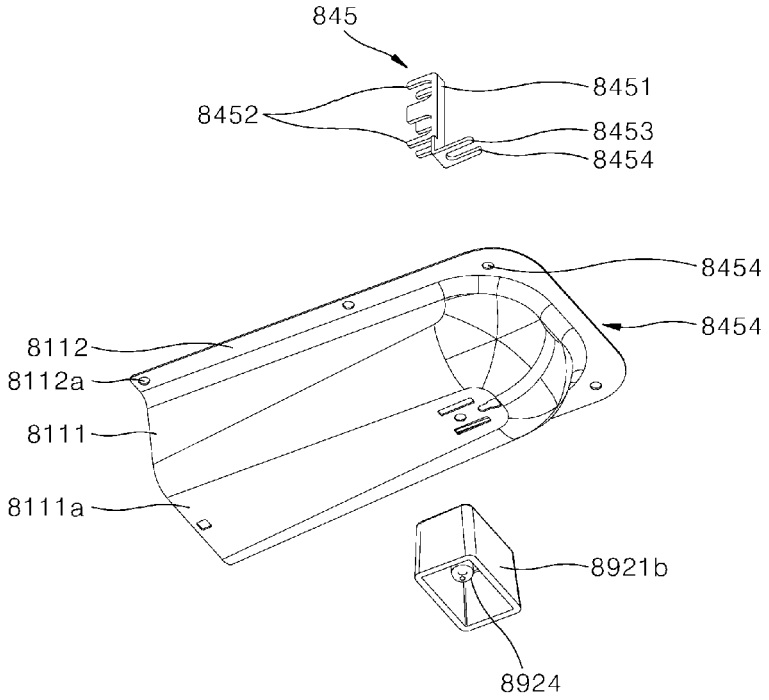

Referring to the exploded perspective views of FIGS. 9 and 10, before the assembly of the heater bracket 845, the second leg 892 may be first attached to the lower portion of the bottom surface 8111*a* of the lower housing 811.

As described above, the heater bracket 845 and the second leg 892 may be fastened to the lower housing 811 at the same timer by a single screw bolt B. To distinguish the genuine assembly using a single screw bolt B, the process of attaching the second leg 892 to the bottom surface 8111*a* of the lower housing 811 is referred to as temporary assembly, hereafter.

As describe above, the plurality of coupling projections may be provided on the upper side surface 8921*a* of the leg body 8921 serving as a coupling surface to the bottom surface 8111*a* of the lower housing 811.

For example, the plurality of coupling projections may comprise a pair of first coupling projections 8922 that extends in parallel with the lengthwise direction of the lower housing 811, preferably, in parallel with the left-right direction, and a second coupling projection 8923 that is provided between the pair of first coupling projections 8922 and the outer side edge of the upper side surface 8921*a* of the leg body 8921.

For example, the pair of first coupling projections 8922 may have a rectangular cross section where a length in a direction parallel with the lengthwise direction of the lower housing 811 (hereafter, a longitudinal direction) is greater than a thickness in a direction across the lengthwise direction of the lower housing 811 (hereafter, a transverse direction).

Additionally, the second coupling projection 8923 may have an approximate circular arc shaped-cross section and be formed into a cylindrical shape that is cut along the perpendicular direction, for example.

The pair of first coupling projections 8922 and the second coupling projection 8923 may be integrally formed on the upper side surface 8921*a* of the leg body 8921.

As illustrated, the pair of first coupling projections 8922 may be spaced from each other with the through hole 8925 formed at the upper end of the screw boss 8924 therebetween. For example, each of the pair of first coupling projections 8922 may be disposed to have the same distance from the through hole 8925 provided at the center of the upper side surface 8921*a* of the leg body 8921.

The second coupling projection 8923 may be disposed closer to the left side edge of the upper side surface 8921*a* of the leg body 8921 than the pair of first coupling projections 8922, for example.

As described hereafter, the second coupling projection 8923 may be disposed asymmetrically around the through hole 8925 with respect to the pair of first coupling projections 8922.

The pair of first coupling projections 8922 and the second coupling projection 8923 may be at least partially exposed to the air passage formed in the heater housing 81 by passing through the bottom surface 8111*a* of the lower housing 811, as described hereafter. The heights at which the pair of first coupling projections 8922 and the second coupling projection 8923 protrude from the upper side surface 8921*a* of the leg body 8921 may remain minimum not to act as flow resistance against dry airflow flowing through the air passage, for example.

However, since a temporary assembly between the second leg 892 and the lower housing 811 needs to be maintained with the pair of first coupling projections 8922 and the second coupling projection 8923, the heights at which the pair of first coupling projections 8922 and the second coupling projection 8923 protrude from the upper side surface 8921*a* of the leg body 8921 may be limited approximately to the thickness of the bottom surface 8111*a* of the lower housing 811, for example.

Further, a pair of first coupling holes 8111*b*1 into which the pair of first coupling projections 8922 is inserted, and a second coupling hole 8111*b*2 into which the second coupling projection 8923 is inserted may be provided on the bottom surface 8111*a* of the lower housing 811.

The pair of first coupling holes 8111*b*1 may have a rectangular shape to correspond to the shape of the pair of first coupling projections 8922.

Figure 11:
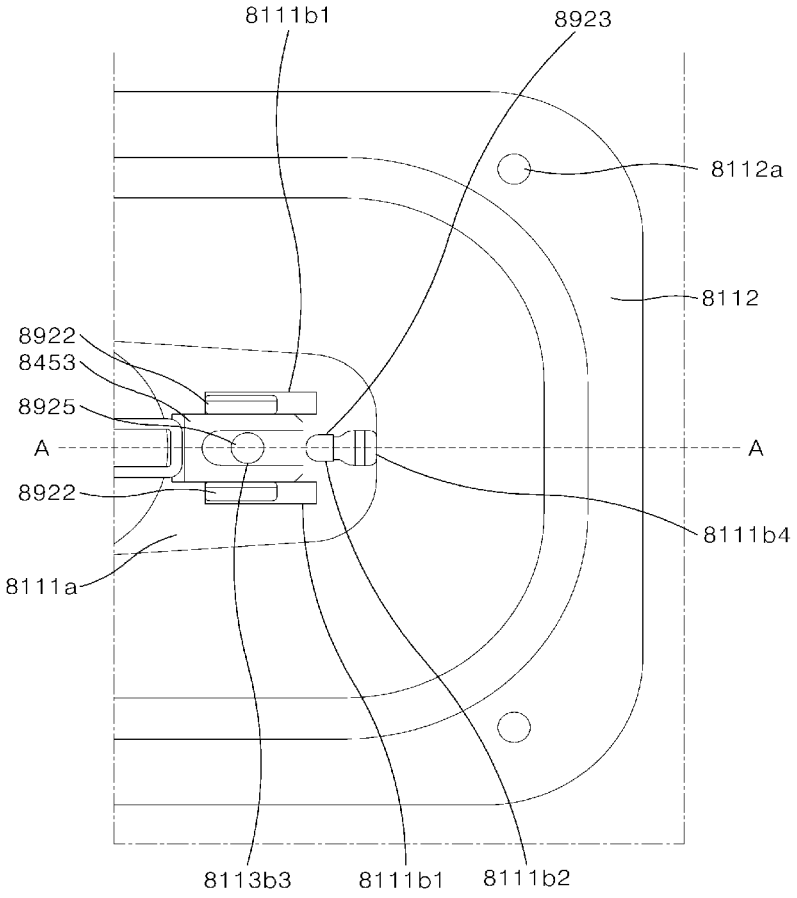
FIG. 11 is a plan view showing a heater bracket and a second leg coupled to a lower housing.
Figure 12:
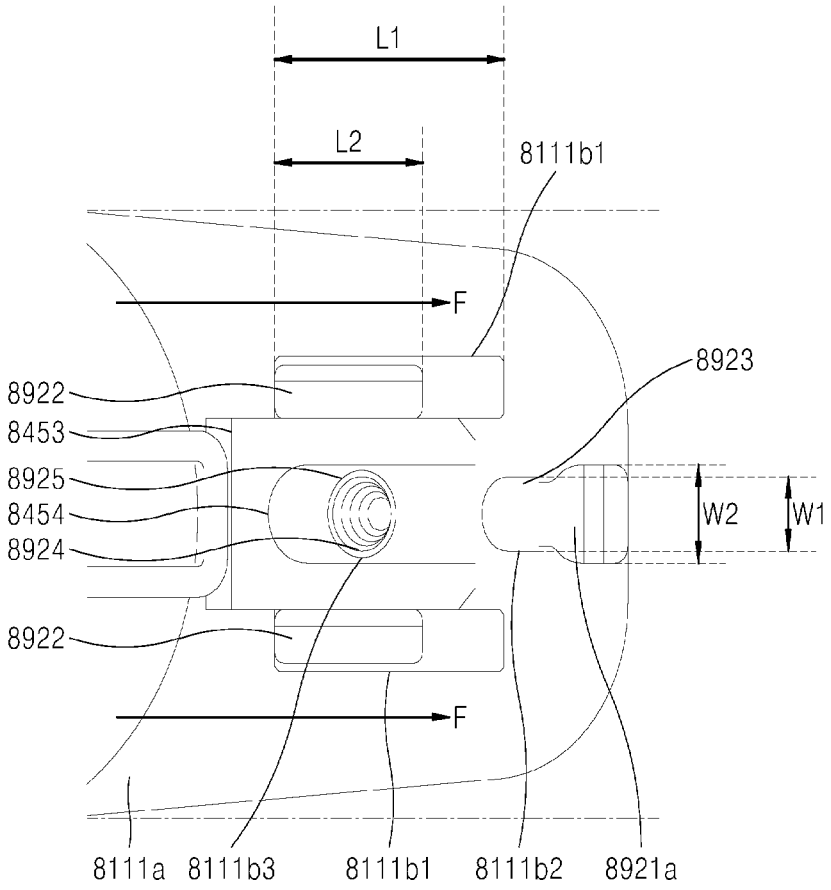
FIG. 12 is a partial enlarged view of FIG. 11.

However, considering the manufacturing tolerance of the first coupling holes 8111*b*1 and the first coupling projections 8922, the longitudinal length L1 of the first coupling holes 8111*b*1 may be greater than the longitudinal length L2 of the first coupling projections 8922, as illustrated in FIGS. 11 and 12.

To maintain the forcible insertion or tight coupling between them, the longitudinal width of the first coupling holes 8111*b*1 may be less than or the same as the longitudinal width of the first coupling projections 8922, for example.

The second coupling hole 8111*b*2 may be formed into a circular hole to correspond to the outer shape of the second coupling projection 8923.

As mentioned about the first coupling holes 8111*b*1, for the second coupling projection 8923 to be forcibly inserted into or tightly coupled to the second coupling hole 8111*b*2, the inner diameter or the transverse width W1 of the second coupling hole 8111*b*2 may be less than or the same as a maximum outer diameter of the second coupling projection 8923.

Thus, during the forcible insertion or tight coupling of the pair of first coupling projections 8922 and the second coupling projection 8923, the portion where each of the first coupling projections 8922 joins each of the first coupling holes 8111*b*1, and the portion where the second coupling projection 8923 joins the second coupling hole 8111*b*2 may be elastically deformed.

As a result, without an additional fixation means or maintenance means, a temporary assembly between the second leg 892 and the lower housing 811 may be maintained, and the separation of the second leg 892 from the lower housing 811 may be prevented, effectively.

As described about the arrangement relationship between the pair of first coupling projections 8922 and the second coupling projection 8923, the second coupling hole 8111*b*2 may be disposed asymmetrically around a screw hole 8111*b*3 with respect to the pair of first coupling holes 8111*b*1.

Accordingly, since the right position into which the pair of first coupling projections 8922 and the second coupling projection 8923 are inserted may be specified through the pair of first coupling holes 8111*b*1 and the second coupling hole 8111*b*2, a temporary assembly between the second leg 892 and the lower housing 811 may not be formed, in a position outside the right position, e.g., in the position where the second leg 892 is rotated around the through hole 8925 outside the right position.

By doing so, the misassembly between the second leg 892 and the lower housing 811 may be prevented effectively.

Additionally, a drain hole 8111*b*4 that drains wash water, drawn reversely from the tub through the connection duct part 85, toward the base 90 may be further provided on the bottom surface 8111*a* of the heater housing 81.

The drain hole 8111*b*4, as illustrated, may be formed farther from the screw hole 8111*b*3 than the second coupling hole 8111*b*2. For example, the drain hole 8111*b*4 may be disposed in a way that the center of the drain hole 8111*b*4 is arranged on an extension line connecting the center of the screw hole 8111*b*3 and the center of the second coupling hole 8111*b*2.

The drain hole 8111*b*4 may be formed aside from the second coupling hole 8111*b*2 or formed in a way that the drain hole 8111*b*4 and the second coupling hole 8111*b*2 are formed in succession to communicate with each other.

However, since the drain hole 8111*b*4 and the second coupling hole 8111*b*2 are adjacent to each other, the drain hole 8111*b*4 and the second coupling hole 8111*b*2 may be integrally formed, as illustrated, considering pressing-based formability. That is, the drain hole 8111*b*4 and the second coupling hole 8111*b*2 may form a single opening by connecting each other.

Figure 13:
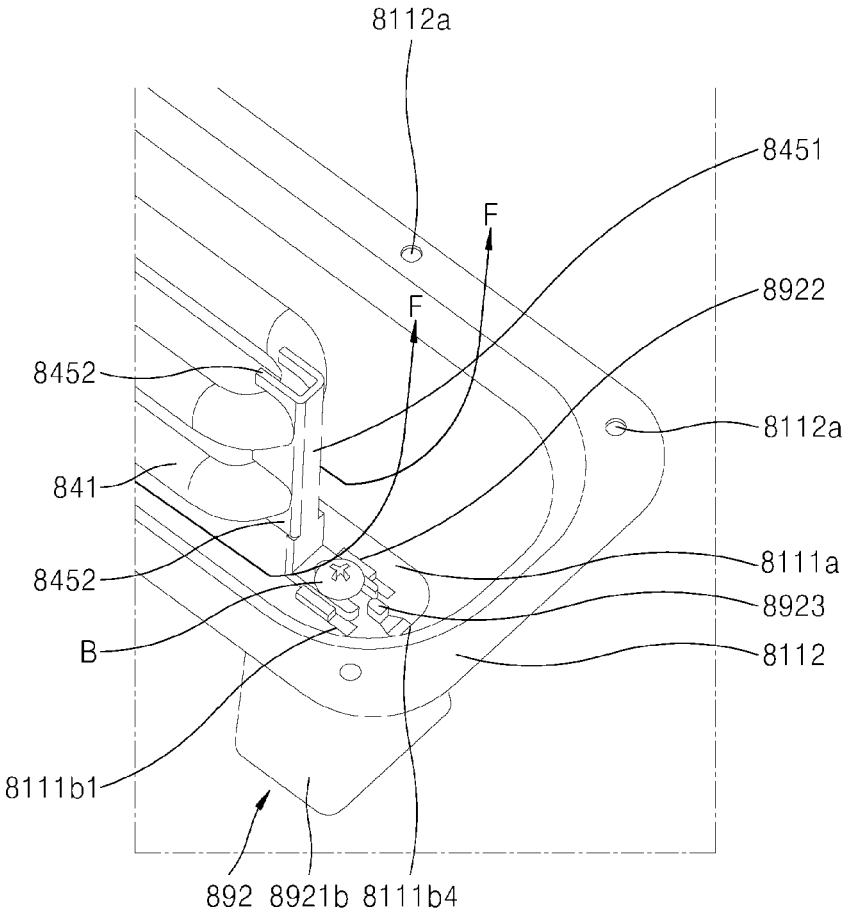
FIG. 13 is a front perspective view of FIG. 11.

To effectively serve as an outlet through which wash water is discharged, the drain hole 8111*b*4 may have a cross section greater than the cross section of the second coupling hole 8111*b*2, as illustrated in FIGS. 12 and 13.

However, if the drain hole 8111*b*4 is entirely blocked by the upper side surface 8921*a* of the leg body 8921 disposed under the drain hole 8111*b*4, the drain hole 8111*b*4 may not perform the function of draining wash water drawn reversely.

To prevent this from happening, the drain hole 8111*b*4 may be disposed such that the lower portion of the drain hole 8111*b*4 is blocked by the upper side surface 8921*a* of the leg body 8921 at least partially.

That is, a portion of the drain hole 8111*b*4 may be blocked in the state of overlapping the upper side surface 8921*a* of the leg body 8921, and the remaining portion may extend to a position outside the upper side surface 8921*a* of the leg body 8921 and be partially open.

By doing so, as wash water drawn reversely is discharged through the partially open portion of the drain hole 8111*b*4, the wash water being drained may move in the downward direction (D-direction) along the outer perimeter surface 8921*b* of the leg body 8921 by using gravity.

Thus, the phenomenon where reversely drawn wash water directly falls onto the base 90 without moving along the outer perimeter surface 8921*b* while forming droplets and then is scattered to surroundings may be minimized. The scattered droplets after the fall are highly likely to impose damage to other electronic components provided at the base 90.

Figure 14:
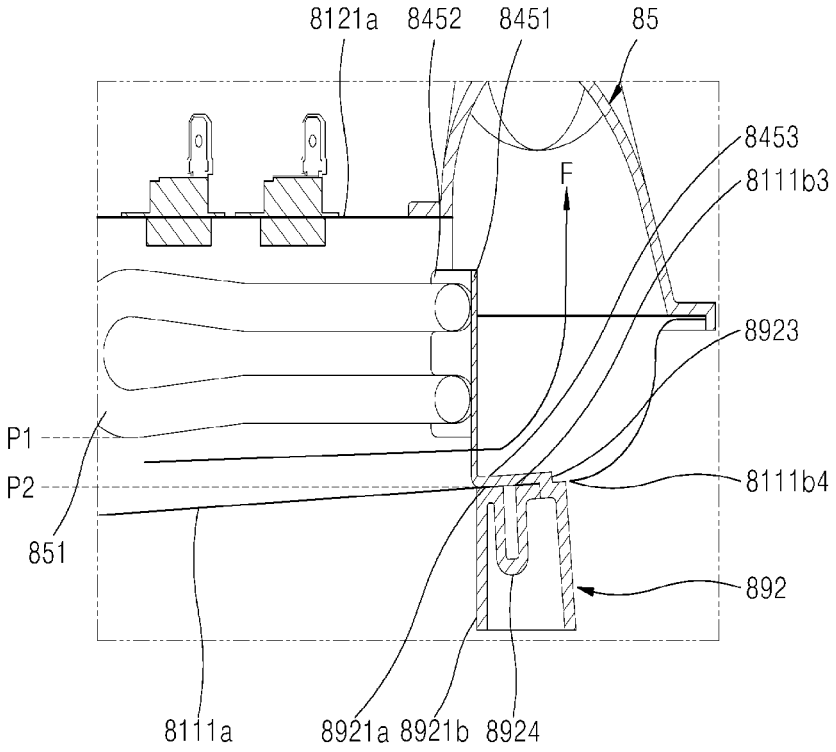
FIG. 14 is a cross-sectional view along A-A in FIG. 11.

Additionally, as illustrated in FIG. 14, the up-down position P1 of the drain hole 8111*b*4 may be lower than the lower most position P2 of the heater main body 841, with respect to the up-down direction.

Thus, even if wash water continues to come in reversely through the connection duct part 85, the submerge of the heater main body 841, caused by the wash water, may be prevented since the water level of the wash water in the heater housing 81 is limited to the position of the drain hole 8111*b*4.

That is, the drain hole 8111*b*4 may limit the top of the water level of wash water in the heater housing 81.

Further, the upper side surface 8921*a* of the second leg 892, as described above, may be formed into a flat surface most of which is blocked except for the portion where the through hole 8925 is formed, to ensure a maximum surface area of contact with the lower housing 811.

However, the lower end surface of the leg body 8921 of the second leg 892 is entirely open as illustrated in FIG. 10. That is, the lower end surface of the leg body 8921 having a through hole shape forms an open surface entirely.

The entirely open lower end surface contacting the base 90 may help to minimize a surface area of contact of the leg body 8921 of the second leg 892 with the base 90. By doing so, the transfer of heat generated in the heater main body 841 to the base 90 through the heater housing 81 and the second leg 892 may be minimized, thereby preventing the thermal damage and thermal deformation of the base 90.

Further, as a temporary assembly between the second leg 892 and the lower housing 811 is completed as described above, the assembly of the heater bracket 845 may proceed.

FIG. 12 shows a state prior to a coupling of the screw bolt B.

As described above, each of the heater holders 8452 may be provided in the state of being tightly coupled to the outer surface of the heater main body 841 and modularized in advance, in a way that the heater holder 8452 is plastically deformed, at a time of a coupling of the heater older 8452 to the heater main body 841.

The heater bracket 845 may move to the right position together with the heater main body 841 for a genuine assembly.

At this time, the right position of the heater bracket 845 may mean that the screw hole 8111*b*3 formed on the bottom surface 8111*a* of the lower housing 811 is aligned with the bolt groove 8454 formed at the horizontal extension part 8453 of the heater bracket 845 in the up-down direction and that the horizontal extension part 8453 of the heater bracket 845 is disposed between the pair of first coupling projections 8922 such that the horizontal extension part 8453 surface-contacts the bottom surface 8111*a* of the lower housing 811.

As the heater main body 841 and the heater bracket 845 move to the right position, the transverse width of the horizontal extension part 8453 may be less than or the same as a distance between the pair of first coupling projections 8922. By doing so, the pair of first coupling projections 8922 may the horizontal extension part 8453 of the heater bracket 845 to the right position.

As the horizontal extension part 8453 of the heater bracket 845 is disposed between the pair of first coupling projections 8922 completely, the screw bolt B's other end portion, i.e., lower end portion, with a screw thread passes through the bolt groove 8454 of the horizontal extension part 8453, the screw hole 8111*b*3 of the lower housing 811 and the through hole 8925 of the second leg 892 consecutively.

Then the lower end portion of the screw bolt B may be finally screw-coupled to the screw boss 8924 of the second leg 892.

As the screw-coupling proceeds, a head part provided in one end portion, i.e., the upper end portion, of the screw bolt B joins the horizontal extension part 8453 of the heater bracket 845, and while the head part pressurizes the horizontal extension part 8453 in the downward direction (D-direction), a triple coupling, i.e., a genuine assembly, among the heater bracket 845, the lower housing 811 and the second leg 892 is completed.

Further, the heater bracket 845 is disposed at the upstream side with respect to the drain hole 8411*b*4, with respect to the flow direction of dry airflow F, as illustrated in FIGS. 12 to 14.

Accordingly, a direct arrival of the dry airflow F to the drain hole 8411*b*4 disposed in the lower stream of the heater bracket 845 may be minimized since the dry airflow F is branched to the left and to the right by the horizontal extension part 8451 of the heater bracket 845 and then moves up. As a result, the flow rate of dry airflow F that can leak through the drain hole 8411*b*4 may be minimized, and deterioration in the supply efficiency of dry air may be prevented.

[Detailed Structure of Heater Housing and Housing Connector]

Hereafter, detailed structures of the heater housing 81 and the housing connector 87 of the dishwasher 1 of one embodiment, and their coupling relationship are described with reference to FIGS. 1 to 15.

As described above, the housing connector 87 indirectly connects and fixes the fan housing 82 accommodating the air blowing fan to the heater housing 81.

To this end, the fan housing 82 may be detachably coupled to one side, i.e., the right side in the illustrative embodiment, of the housing connector 87, which is the upper stream with respect to the flow direction of dry airflow (hereafter, a longitudinal direction).

Additionally, the open font end of the heater housing 81 may be detachably coupled to the other side, i.e., the right side in the illustrative embodiment, of the housing connector 87, which is the lower stream with respect to the flow direction of dry airflow.

Figure 15:
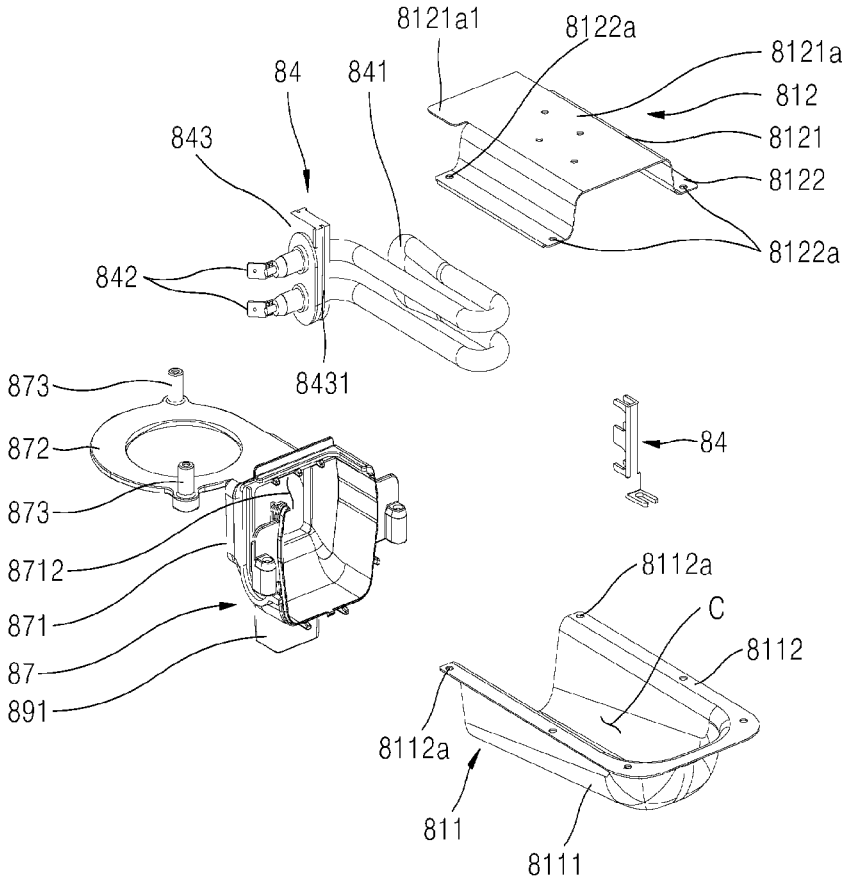
FIG. 15 is an exploded perspective view for describing a relative relationship between a heater housing and a housing connector.
Figure 16:
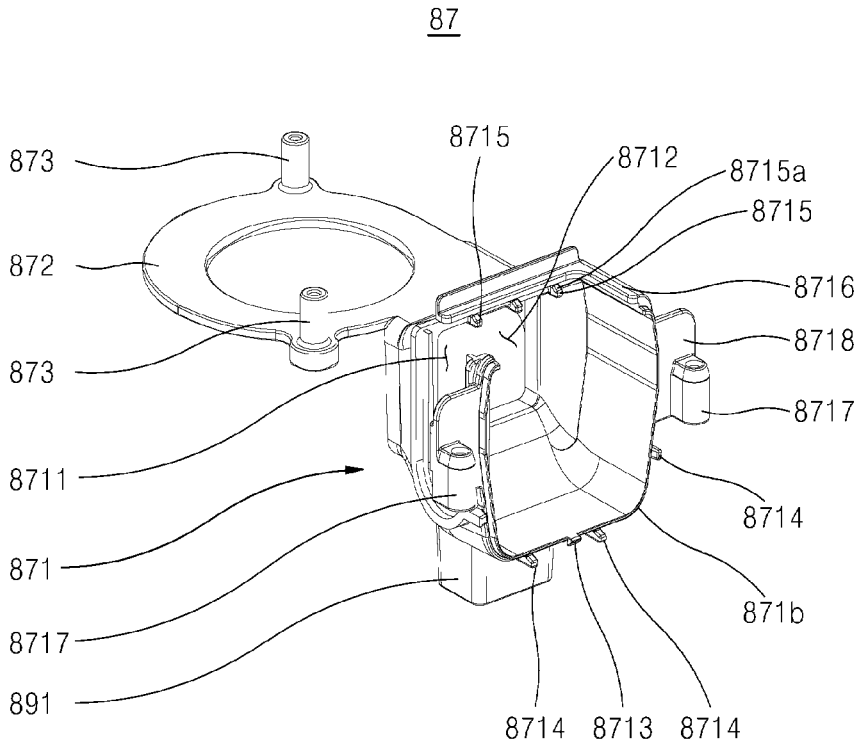
FIG. 16 is a front perspective view showing a detailed structure of the housing connector in FIG. 15.

Specifically, the housing connector 87, as illustrated in FIGS. 15 and 16, may comprise a connector main body 871 that has a box shape and has an inlet 8712 into which dry airflow discharged from the fan housing 82 is drawn, at a front end portion 871*a* thereof, and a connection tab 872 that protrudes from the front end portion 871*a* of the connector main body 871 toward the fan housing 82 and is coupled with the fan housing 82.

The connection tab 872 may extend in parallel with the upper surface 821 of the fan housing 82 in a direction where the connection tab 872 covers the upper surface 821 of the fan housing 82 from the inlet 8712 of the connector main body 871.

The connection tab 872 may has an approximately circular plate shape to correspond to the shape of the upper surface 821 of the fan housing 82, to cover the upper surface 821 of the fan housing 82, and extend horizontally from the upper side of the inlet 8712.

As illustrated, a pair of fastening bosses 873 may be integrally provided on the upper surface of the connection tab 872 and extend in the upward direction (U-direction).

The pair of fastening bosses 873 may respectively have a screw hole to which a screw bolt having passed through the fan housing 82 is screw-coupled.

The connection tab 872 may have a circular central opening therein, and the circular central opening may be formed vertically (the U-D direction) in a penetrating manner, and is used to cool the PCB substrate and the motor provided in the fan housing 82.

As described above, at a time of fastening the fan housing 82, the connection tab 872 and the fan housing 82 may be assembled in the state where the up-down positions of the connection tab 872 and the fan housing 82 are reversed, or in an upside-down state of the connection tab 872 and the fan housing 82. At this time, the pair of fastening bosses 873 may serve as a leg that supports the connection tab 872 and the fan housing 82 in a non-fastening state against the gravitational direction.

The connector main body 871 is coupled to the open front end of the heater housing 81 disposed in the lower steam with respect to the flow direction of dry airflow, to form an air passage C through which dry airflow flows together with the heater housing 81.

To this end, the connector main body 871 may be formed into a hollow hole-shaped box that has a vacant inner portion.

As illustrated, the connector main body 871 may have an inner shape the cross section of which gradually expands, preferably, have a rectangular funnel shape to correspond to the shape of the open front end of the heater housing 81.

At this time, the cross section of the air passage C inside the connector main body 871 may expand gradually along the flow direction of dry airflow, and the cross section of the rear end portion of the connector main body 871 coupled with the heater housing 81 may be approximately the same as the cross section of the front end surface of the heater housing 81. Accordingly, the flow loss of the dry airflow may be minimized.

The connector main body 871 may help to minimize the transfer of heat generated in the heater to the fan housing 82 through the heater housing 81 and support the fan housing 82 and the heater housing 81.

To this end, the connector main body 871 may be manufactured in a way that a plastic material having predetermined heat resistance is injection-molded.

Additionally, to support the fan housing 82 and the heater housing 81, a first leg 891 may be integrally formed in the lower portion of the connector main body 871 and protrude toward the base.

In the illustrative embodiment, the upper surface and the front surface of the box-shaped connector main body 871 may be open at least partially.

The connector main body 871's upper surface and front surface that are at least partially open provides a passage through which the heater main body 841 is inserted while the heater main body 841 is disposed and fixed in the air passage C.

As illustrated in FIG. 15, the heater main body 841 that are formed in two rows, for example, is disposed in the state where the heater main body 841 bends at least two times, and has a shape that bends in a L form entirely.

The heater main body 841 having a shape that bends in a L form may come into the heater housing 81 and the connector main body 871 while moving horizontally in the downward direction (D-direction) though the open upper surface and front surface of the connector main body 871, for an arrangement and an assembly.

As described above, the heater main body 841 may be indirectly supported in the state of separating from the heater housing 81 and the connector main body 871.

The front end side of the heater main body bending in a L shape may be supported by the terminal fixation part 843, in the state of separating from the connector main body 871. A pair of terminals may be fixed to the front surface of the terminal fixation part 843, in the state of protruding outward.

The rear end side of the heater main body 841 bending in a L shape may be supported by the heater bracket 845, in the state of separating from the heater housing 81.

FIG. 15 shows that the rear end of the heater main body 841 is separated from the heater bracket 845. However, before the heater main body 841 is disposed at the connector main body 871 and the heater housing 81, the heater bracket 845 may be assembled in advance in the state of being tightly coupled to the heater main body 841.

The lower end of the heater bracket 845 may be fixed to the heater housing 81, preferably, the bottom surface 8111*a* of the lower housing 811, through a fastener such as a screw bolt and the like.

The partially open front surface of the connector main body 871 may form a U-shaped fixation slot 8711 to which the terminal fixation part 843 is coupled in a sliding manner, to correspond to the outer shape of the terminal fixation part 843.

The up-down slide of the terminal fixation part 843 may be guided by the edge of the fixation slot 8711, and may have a guide groove 8431 coupled to the edge of the fixation slot 8711.

Accordingly, after the terminal fixation part 843 is coupled to the fixation slot 8711 completely, the edge of the fixation slot 8711 is inserted into the guide groove 8431 such that the front-rear (F-R direction) escape of the terminal fixation part 843 is prevented.

Additionally, since the fixation slot 8711 and the terminal fixation part 843 are coupled in the state of being surface-contacted, such that the leakage of dry airflow is minimized.

The partially open upper end of the connector main body 871 may be covered and shielded by the upper housing 812.

For example, the partially open upper end of the connector main body 871 may be covered and shielded by the upper side surface 8121*a* of the upper housing 812.

As illustrated in FIG. 15, a front end portion 8121*a*1 of the upper side surface 8121*a* of the upper housing 812 may extend further toward the connector main body 871 than the rear end portion of the expansion surface 8122.

Preferably, the front end portion 8121*a*1 of the upper side surface 8121*a* of the upper housing 812 may extend to cover the partially open upper end of the connector main body 871 entirely.

At this time, the front end portion 8121*a*1 of the upper side surface 8121*a* of the upper housing 812 may be inserted into the connector main body 871 in a way that the front end portion 8121*a*1 of the upper side surface 8121*a* of the upper housing 812 enters into the lower portion side of the upper end surface of the connector main body 871 formed into a L shape.

Having entered into the lower portion side, the front end portion 8121*a*1 of the upper side surface 8121*a* of the upper housing 812 surface-contacts the upper end surface of the connector main body 871, and the L-shaped upper end surface of the connector main body 871 forms a coupling surface 8716.

A plurality of second support ribs 8715 that supports the front end portion 8121*a*1 of the upper side surface 8121*a* of the upper housing 812, having entered into the connector main body 871, from below may be provided under the coupling surface 8716.

As illustrated in FIG. 16, the plurality of second support ribs 8715 may be arranged approximately at regular intervals.

One end portion of the second support rib 8715 may be a fixed end that is integrally fixed to the lower portion of the coupling surface 8716, and the other end portion may be a free end portion that has a L shape.

A distance between the free end portion of the second support rib 8715 and the lower portion of the coupling surface 8716 may be approximately the same as the thickness of the front end portion 8121*a*1 of the upper side surface 8121*a* of the upper housing 812.

Accordingly, the front end portion 8121*a*1 of the upper side surface 8121*a* of the upper housing 812 may be fit-coupled and fixed between an inner surface forming the lower portion of the coupling surface 8716 and the second support rib 8715.

At this time, since an inclined surface 8715*a* the up-down height of which gradually decreases toward the front end portion 8121*a*1 of the upper housing 812 is formed on the upper surface of the second support rib 8715, the front end portion 8121*a*1 of the upper housing 812 may be easily guided and inserted between the inner surface forming the lower portion of the coupling surface 8716 and the second support rib 8715.

The second support rib 8715 may help to maintain surface-to-surface contact between the front end portion 8121*a*1 of the upper side surface 8121*a* of the upper housing 812 and the coupling surface 8716 of the connector main body 871, such that the leakage of dry airflow from between the coupling surface 8716 and the front end portion 8121*a*1 of the upper side surface 8121*a* of the upper housing 812 is minimized.

Likewise, the entirely open rear end portion 871*b* of the connector main body 871 may be fit-coupled and fixed to the concave part 8111 of the lower housing 811 forming the inner surface of the heater housing 81, and the concave part 8121 of the upper housing 812.

At this time, the rear end portion 871*b* of the connector main body 871 may be fit-coupled in a way that the rear end portion 871*b* of the connector main body 871 is partially inserted into the concave part 8111 of the lower housing 811 and the concave part 8121 of the upper housing 812.

A plurality of first support ribs 8714 may be provided in the rear end portion 871*b* of the connector main body 871 to form a fit-coupling for surface-to-surface contact, in a similar way to the fit-coupling of the front end portion 8121*a*1 of the upper side surface 8121*a* of the upper housing 812, as illustrated in FIG. 16.

Like the second support rib 8715, the first support rib 8714 may have one end portion as a fixed end portion that is integrally fixed to the outer surface of the rear end portion 871*b* of the connector main body 871 and the other end portion as a free end portion that is formed into a L shape.

A distance between the free end portion of the first support rib 8714 and the outer surface of the rear end portion 871*b* of the connector main body 871 may be approximately the same as the thickness of the concave part 8111 of the lower housing 811 and the concave part 8121 of the upper housing 812.

Accordingly, the concave part 8111 of the lower housing 811 may be fit-coupled and fixed between the outer surface of the rear end portion 871*b* of the connector main body 871 and the first support rib 8714.

At this time, since an inclined surface 8714*a* the up-down height of which decreases gradually toward the concave part 8111 of the lower housing 811 formed on the upper surface of the first support rib 8714, a front end portion 8111*a*1 of the concave part 8111 of the lower housing 811 may be guided to easily enter between the outer surface of the rear end portion 871*b* of the connector main body 871 and the first support rib 8714.

The surface-to-surface contact of the concave part 8111 of the lower housing 811 and the concave part 8121 of the upper housing 812 with the outer surface of the rear end portion 871*b* of the connector main body 871 may be maintained through the first support rib 8714. By doing so, the leakage of dry airflow from between the rear end portion 871*b* of the connector main body 871 and the heater housing 81 may be minimized.

Additionally, as a means of maintaining the coupling state between the connector main body 871 and the heater housing 81 and preventing the separation thereof, a holding projection 8713 protruding toward the heater housing 81 may be provided in the rear end portion 871*b* of the connector main body 871, and to correspond to the holding projection 8713, a fastening hole 8111*b*5 to which the holding projection 8713 is elastically coupled may be provided at the heater housing 81.

For example, the holding projection 8713 may be integrally provided in the rear end portion 871*b* of the connector main body 871 in a direction in which the holding projection 8713 extends from an inner lower surface 871*c* of the connector main body 871 toward the inside of the heater housing 81.

Further, a hook may be provided in the free end portion of the holding projection 8713 to allow the holding projection 8713 to be elastically coupled to the fastening hole 8111*b*5, for example.

The fastening hole 8111*b*5 to which the holding projection 8713 is elastically coupled may be formed on the bottom surface of the heater housing 81, preferably, the bottom surface 8111*a* of the lower housing 811 in a penetrating manner, near the front end portion of the bottom surface 8111*a*, in the up-down direction.

For example, the fastening hole 8111*b*5 may be formed into a rectangular hole-shaped opening into which the hook provided at the holding projection 8713 is inserted and held.

The holding projection 8713 may extend in parallel with the flow direction of dry airflow to the upper side of the bottom surface 8111*a* of the lower housing 811, to support the bottom surface 8111*a* of the lower housing 811 in the up-down direction together with the first support rib 8714.

That is, the hook of the holding projection 8713 may be elastically coupled to the fastening hole 8111*b*5 of the lower housing 811 in a way that the hook is inserted into the lower portion of the fastening hole 8111*b*5 from the upper portion side thereof.

Additionally, in the state where the holding projection 8713 is coupled to the fastening hole 8111*b*5, the fastening hole 8111*b*5 may be configured to remain open at least partially.

That is, the cross section of the fastening hole 8111*b*5 may be greater than the size of the hook. For example, the longitudinal length W2 of the fastening hole 8111*b*5 may be greater than the longitudinal length of the hook, or the transverse width W1 of the fastening hole 8111*b*5 may be greater than the transverse width of the hook, to increase a fastening cross section.

FIGS. 1 to 18 show a fastening hole 8111*b*5 having a longitudinal length W2 greater than a longitudinal direction of a hook. Hereafter, the illustrative fastening hole is described but not limited.

As the holding projection 8713 is coupled to the front end portion of the fastening hole 8111*b*5 that extends along a direction (the longitudinal direction) parallel with the flow direction of dry airflow and has a greater length in the longitudinal direction, the rear end portion side of the fastening hole 8111*b*5 is open at least partially.

Figure 18:
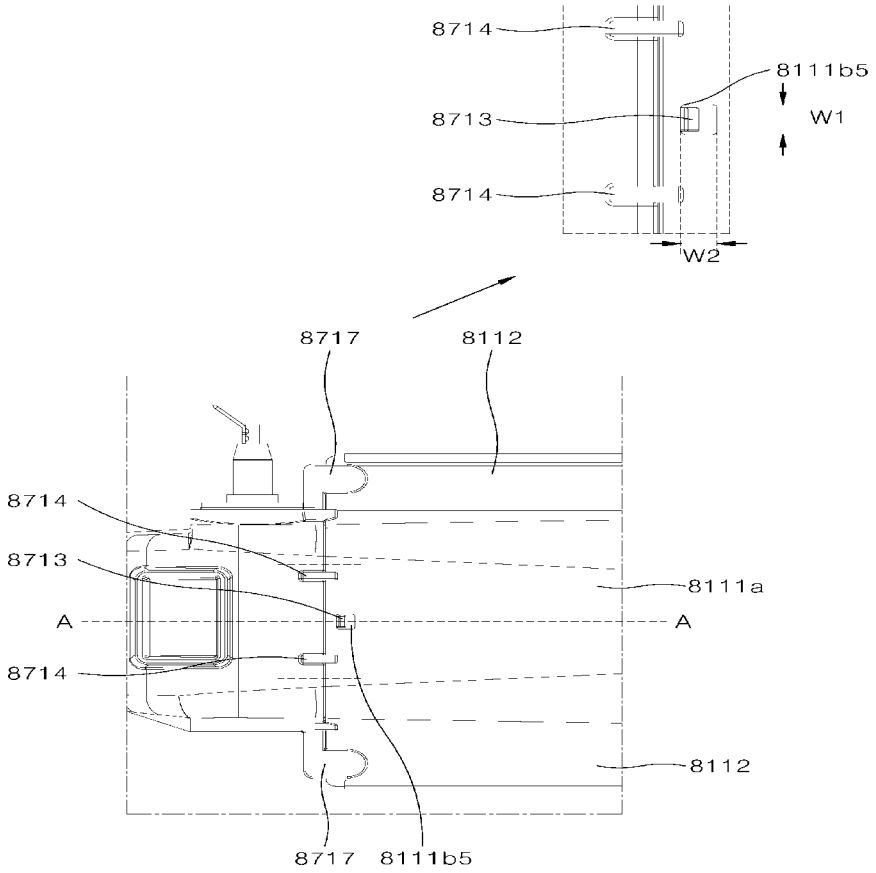
FIG. 18 is a partial enlarged view showing the lower portion of FIG. 17.

At this time, since the fastening hole 8111*b*5 is formed on the bottom surface 8111*a* of the lower housing 811 facing the lower surface of the base as illustrated in FIG. 18, the fastening hole 8111*b*5 may be open toward the lower surface of the base partially.

Thus, the open rear end portion side of the fastening hole 8111*b*5 may serve as a drain opening that discharges wash water reversely flowing into the heater housing 81 or the housing connector toward the base.

Further, the housing connector 87 and the lower housing 811 may be fit-coupled as described above as the rear end portion 871*b* of the connector main body 871 is partially inserted into the bottom surface 8111*a* of the lower housing 811.

At this time, the rear end of the connector main body 871 almost touches the front end portion of the fastening hole 8111*b*5 in the state where the fit-coupling process is completed.

Figure 19:
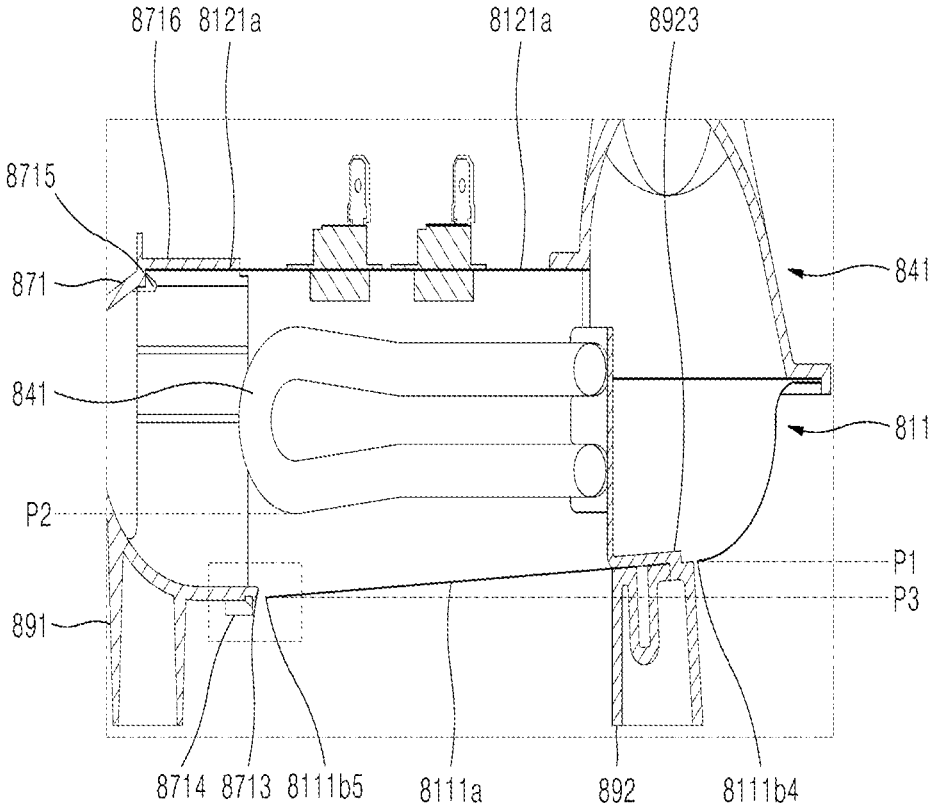
FIG. 19 is a cross-sectional view showing the heater housing and the housing connector in FIG. 17 cut along A-A.

Accordingly, the upper portion of the fastening hole 8111*b*5 may be formed in a position lower than that of the inner lower surface 871*c* of the connector main body 871 with respect to the up-down direction, as illustrated in FIGS. 18 and 19.

Further, since the inner lower surface 871*c* of the connector main body 871 is formed into an inclined surface that has a downward inclination angle along the longitudinal direction, wash water reversely drawn through the inlet 8712 formed in the front end portion 871*a* of the connector main body 871 may be effectively guided by gravity to the fastening hole 8111*b*5 without remaining on the inner lower surface 871*c* of the connector main body 871.

Further, the fastening hole 8111*b*5, as illustrated in FIG. 19, is formed at the front end portion side of the bottom surface 8111*a* of the lower housing 811 having an upward inclination angle at which an up-down height gradually increases toward the rear end portion of the bottom surface 8111*a* of the lower housing 811 along the flow direction of dry airflow.

Thus, wash water reversely drawn through the connection duct part 85 coupled to the rear end portion side of the lower housing 811 may be guided by using gravity to the fastening hole 8111*b*5 effectively along the bottom surface 8111*a*.

At least a portion of the reversely drawn wash water, guided along the bottom surface 8111*a* of the lower housing 811, may stay on the bottom surface 8111*a* of the lower housing 811 without being discharged through the fastening hole 8111*b*5.

However, at a time of providing high-temperature dry air, wash water staying in the heater generating high-temperature heat is evaporated naturally and discharged to the tub side again through the connection duct part 85.

Further, a drain hole 8111*b*4 may be further formed on the bottom surface 8111*a* of the lower housing 811, which is an inclined surface, and be at least partially open toward the base in the lower stream of the fastening hole 8111*b*5 with respect to the flow direction of dry airflow.

At this time, the drain hole 8111*b*4 may be formed in the lower portion of/under the connection duct part 85 with respect to the up-down direction, and formed in a position lower than that of the lower end portion of the heater with respect to the up-down direction.

Accordingly, even if wash water continues to come in reversely through the connection duct part 85 and the above-described fastening hole 8111*b*5 is blocked, the heater main body 841 is unlikely to be submerged by the wash water since the water level of the wash water is limited to the position of the drain hole 8111*b*4 in the heater housing 81.

That is, the drain hole 8111*b*4 may limit the top of the surface of wash water in the heater housing 81.

Figure 20:
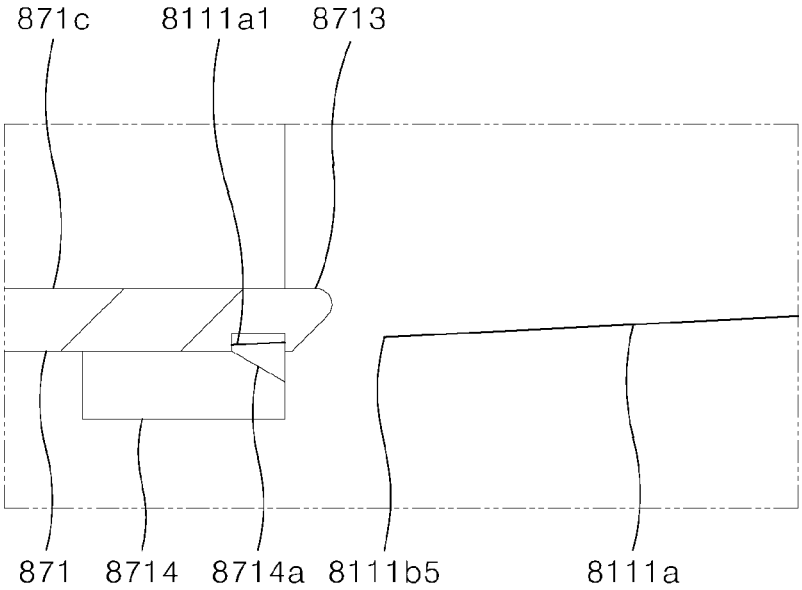
FIG. 20 is a partial enlarged view of FIG. 19.

The drain hole 8111*b*4, as illustrated in FIGS. 19 and 20, may be formed at the upper side of the second leg 892, and at least partially blocked by the upper side surface of the second leg 892 to be open partially.

As the heater housing 81 and the connector main body 871 are coupled completely based on a simple fit-coupling method, the lower housing, 811, the upper housing 812 and the connector main body 871 may be finally coupled with a fastener at the same time.

A pair of screw bolts B may be the fastener, for example.

Figure 17:
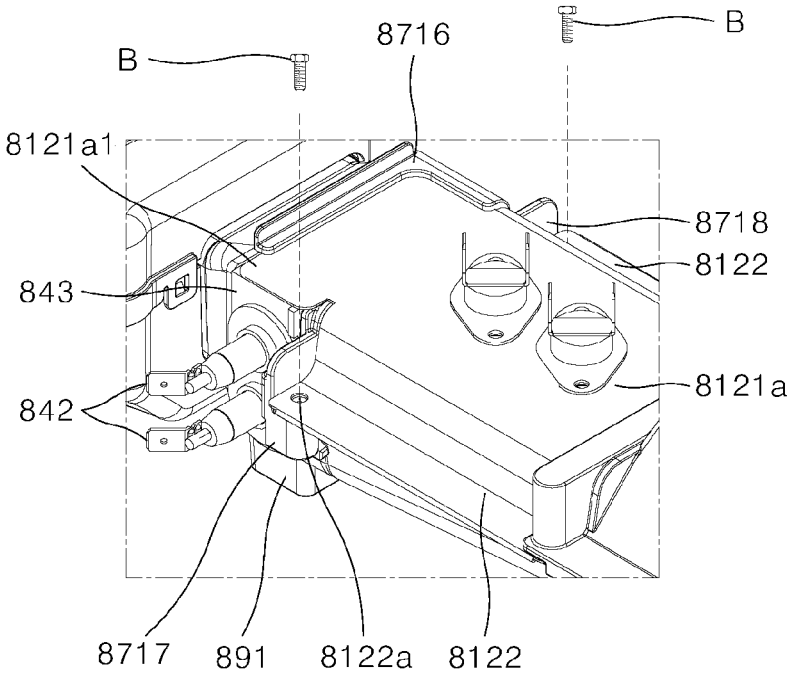
FIG. 17 is a front perspective view showing the heater housing and the housing connector in FIG. 15 coupled to each other.

As illustrated in FIG. 17, the pair of screw bolts B respectively extends by passing through the screw hole 8112*a* that is formed closest to the front end portion of the expansion surface 8112 of the lower housing 811 and the screw hole 8122*a* that is formed closest to the front end portion 8121*a*1 of the expansion surface 8122 of the upper housing 812, at the same time, and is screw-coupled to the connector main body 871.

A screw boss 8717 may be provided on the front surface and the rear surface of the connector main body 871 and respectively coupled with the screw bolt B.

The screw boss 8717 may be formed in a way that extends in the up-down direction integrally on a perpendicular extension surface 8718 respectively disposed on the front surface and the rear surface of the connector main body 871.

As described above, the connector main body 871, the lower housing 811 and the upper housing 812 of one embodiment are coupled simply based on a fit-coupling method, and are triply coupled through the screw bolt B, thereby ensuring improvement in assemblability and structural reliability.

Further, the connector main body 871, the lower housing 811 and the upper housing 812 may be triply coupled through the pair of screw bolts B, thereby minimizing the number of fasteners and simplifying the fastening process.

[Detailed Structure of Heater Housing and Connection Duct Part]

Hereafter, detailed structures of the heater housing 81 and the connection duct part 85 of the dishwasher 1 of one embodiment and their coupling relationship are described with reference to FIGS. 1 to 21.

Figure 21:
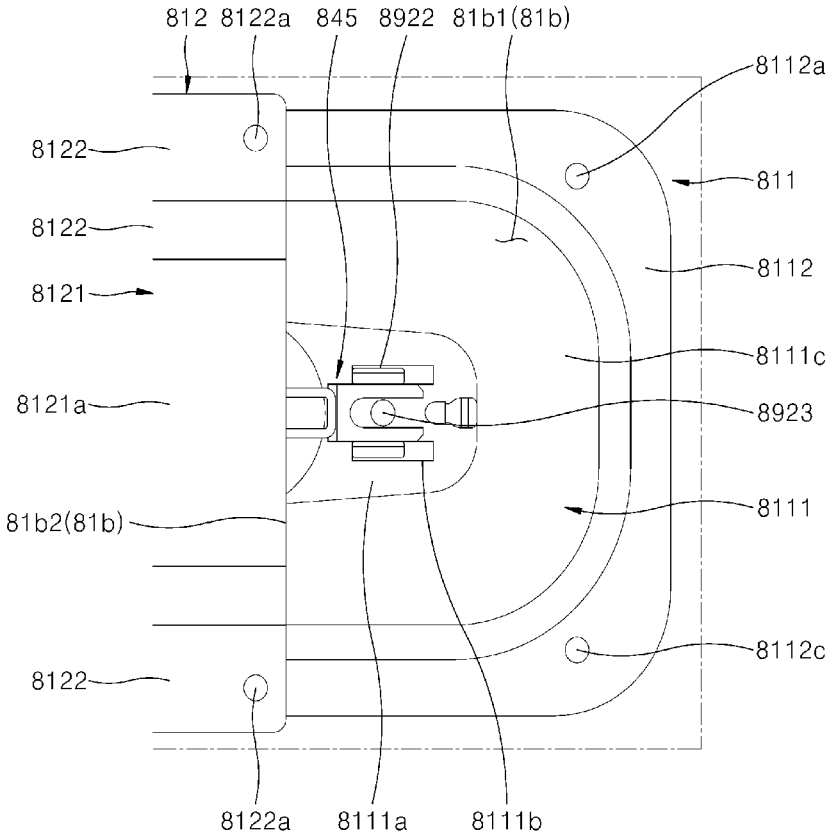
FIG. 21 is a plan view showing an upper housing coupled to a lower housing.

As illustrated in FIG. 21, the rear end side of the lower housing 811 is exposed at least partially without being covered by the upper housing 812, with respect to a direction parallel with the flow direction of dry airflow F (hereafter, the longitudinal direction) in the state where the lower housing 811 is disposed at the upper side of the upper housing 812, preferably, in the state where the expansion surface 8122 of the upper housing 812 and the expansion surface 8112 of the lower housing 811 are aligned with each other, and surface-contacted and joined with each other.

The rear end side of the lower housing 811, which is exposed perpendicularly without being covered by the upper housing 812 as described above, may form a horizontal outlet 81*b*1 that is open perpendicularly, and dry airflow may pass through the horizontal outlet 81*b*1.

The horizontal outlet 81*b*1 is formed in a way that the rear end of the upper surface of the lower housing 811 is partially open. Accordingly, the horizontal outlet 81*b*1 may have approximately the same up-down height as the expansion surface 8112 formed at the upper end of the lower housing 811.

The rear end side of the upper housing 812, provided with the concave part 8121 which is convex upward with respect to the expansion surface 8122, forms a perpendicular outlet 81*b*2 that is open horizontally.

The perpendicular outlet 81*b*1 is formed in a way that the rear end of the upper housing 812 is cut entirely along a direction across the flow direction of dry airflow (hereafter, the transverse direction). Accordingly, the perpendicular outlet 81*b*1 may be formed in a position higher than that of the expansion surface 8122 formed at the lower end of the concave part 8121 of the upper housing 812, with respect to the up-down direction (U-D direction).

The horizontal outlet 81*b*1 of the lower housing 811 and the horizontal outlet 81*b*1 of the upper housing 812 may form a single outlet 81*b* where the horizontal outlet 81*b*1 of the lower housing 811 and the horizontal outlet 81*b*1 of the upper housing 812 communicate with each other.

Figure 23:
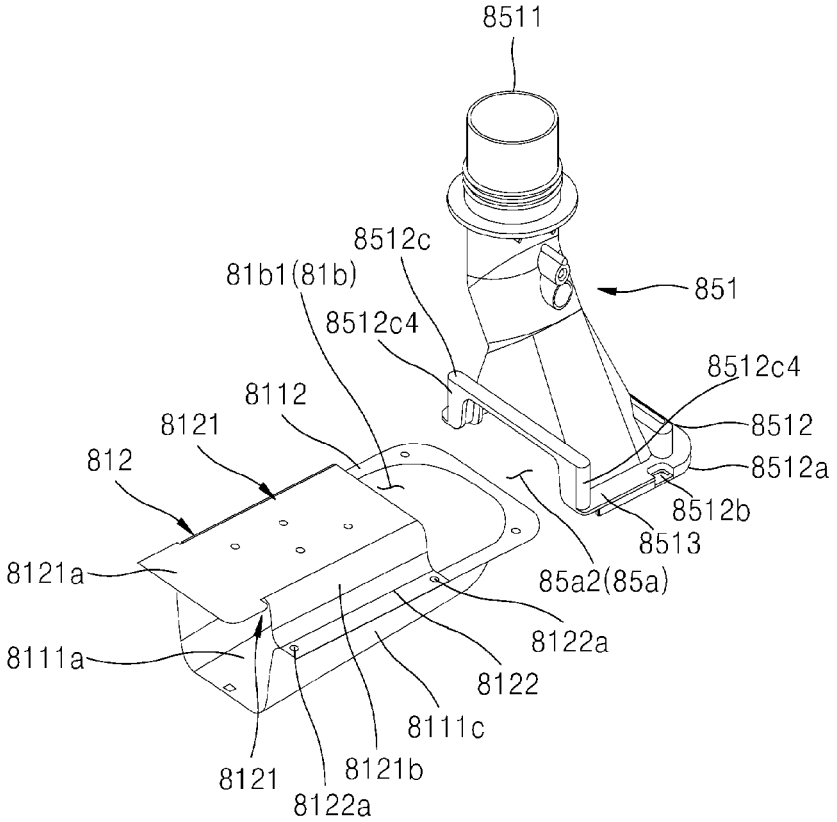

Thus, when viewed from the front, the outlet 81*b* may be an opening having a L-shaped cross section where the upper surface of the rear end of the heater housing 81 is partially cut, as illustrated in FIG. 23.

Additionally, the horizontal outlet 81*b*1 of the lower housing 811 and the perpendicular outlet 81*b*1 of the upper housing 812 may have a non-circular cross section because of the shape of the concave part 8111, 8121. For example, the horizontal outlet 81*b*1 of the lower housing 811 may have an approximate U-shaped cross section, and the perpendicular outlet 81*b*1 of the upper housing 812 may have an approximate arch-shaped cross section.

Since the horizontal outlet 81*b*1 and the perpendicular outlet 81*b*1 constituting the outlet 81*b* of the heater housing 81 have a non-circular cross section respectively as described above, the horizontal outlet 81*b*1 and the perpendicular outlet 81*b*1 may serve as a means of preventing the misassembly of the duct main body 851 to be coupled to the outlet 81*b* as described hereafter.

The lower end portion 8512 of the above-described duct main body 851 may be coupled to the outlet 81*b* of the heater housing 81.

Additionally, a lower end suction opening 85*a* that fluid-communicates with the outlet 81*b* of the heater housing 81 may be formed in the lower end portion 8512 of the duct main body 851 to allow dry airflow having passed through the outlet 81*b* of the heater housing 81 to flow.

For example, to correspond to the shape of the outlet 81*b* of the heater housing 81, the lower end suction opening 85*a* may comprise a horizontal inlet 85*a*1 that fluid-communicates with the horizontal outlet 85*a*1, and a perpendicular inlet 85*a*2 that fluid-communicates with the perpendicular outlet 81*b*1.

To correspond to the shape of the horizontal outlet 81*b*1 and the perpendicular outlet 81*b*1 of the heater housing 81, the horizontal inlet 85*a*1 and the perpendicular inlet 85*a*2 of the duct main body 851 may form a single lower end suction opening 85*a* where the horizontal inlet 85*a*1 and the perpendicular inlet 85*a*2 of the duct main body 851 communicate in a L shape.

The lower end portion 8512 of the duct main body 851 may be coupled to the heater housing 81 in a way that covers the open outlet 81*b* of the heater housing 81 entirely from above.

To cove the outlet 81*b* of the heater housing 81 entirely, the cross section of the lower end suction opening 85*a* may be greater than or the same as that of the outlet 81*b* of the heater housing 81.

Further, the lower end portion 8512 of the connection duct part 85 may be supported entirely by the heater housing 81 through the duct main body 851.

To this end, a flange surface 8513 and a bridge part 8512*c* may be provided in the lower end portion 8512 of the duct main body 851, and the flange surface 8513 joins the expansion surface 8112 of the lower housing 811 in the surface-to-surface contact state and is supported by the same, and the bridge part 8512*c* joins the upper surface of the rear end of the upper housing 812 in the surface-to-surface contact state and is supported by the same.

The flange surface 8513 is formed in a way that surrounds the horizontal outlet 81*b*1 of the lower housing 811 entirely, and surface-contacts and joins the expansion surface 8112 of the lower housing 811 exposed in the upward direction (U-direction).

Figure 22:
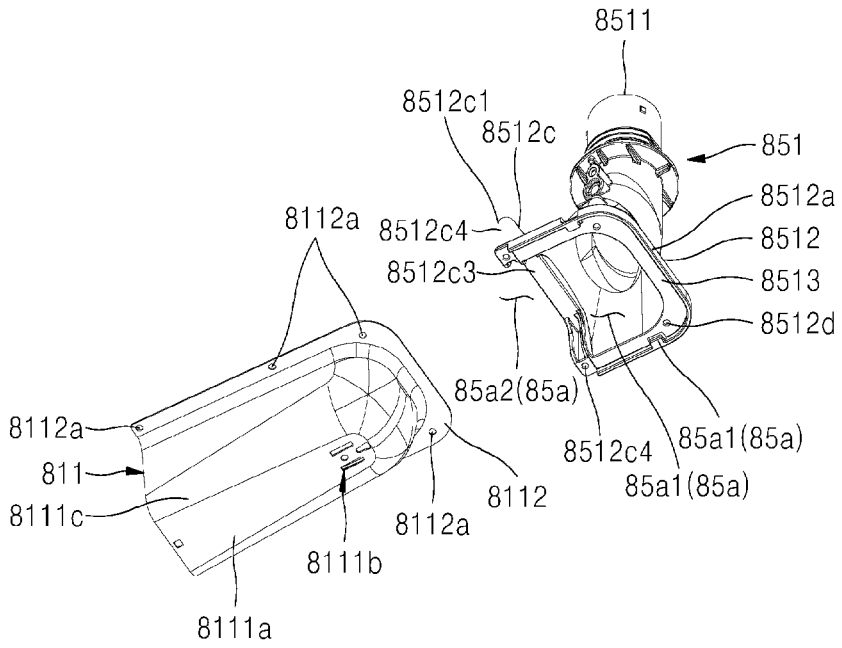
FIGS. 22 and 23 are exploded perspective views showing a state prior to a slide coupling between a heater housing and a connection duct part.

To join the expansion surface 8112 of the lower housing 811 exposed in an approximate U shape effectively and entirely, the flange surface 8513 of the duct main body 851 may have a U shape, as illustrated in FIG. 22.

Further, the expansion surface 8112 of the lower housing 811 expands in a direction parallel with the horizontal direction, as described above. The flange surface 8513 surface-contacting and joining the expansion surface 8112 may be formed into a flat surface that expands from the horizontal inlet in a direction parallel with the horizontal direction.

Since the flange surface 8513 and the expansion surface 8112 of the lower housing 811 forming a contact surface have directionality parallel with the horizontal direction, the lower end portion 8512 of the duct main body 851 may be reliably supported by the expansion surface 8112 of the lower housing 811 in the gravitational direction.

Further, even if wash water of the tub 20 is drawn reversely through the duct main body 851 that extends to the upper end portion 8511 from the lower end portion 8512 almost perpendicularly, wash water moved by gravity is unlikely to leak from the contact surface between the flange surface 8513 and the expansion surface 8112 since the flange surface 8513 and the expansion surface 8112 of the lower housing 811 extend along the horizontal direction. Thus, the reversely drawn wash water may be collected directly on the bottom surface 8111*a* of the lower housing 811 without leaking from the contact surface.

Further, the flange surface 8513 of the duct main body 851 may have a surface area greater than that of the expansion surface 8112 of the lower housing 811.

For example, the horizontal width of the duct main body 851 may be greater than the horizontal width of the lower housing 811 in a way that the horizonwise outer end portions of the flange surface 8513 further expand horizontally past the expansion surface 8112 of the lower housing 811.

Thus, a sufficient contact surface and a sufficient support surface between the flange surface 8513 of the duct main body 851 and the expansion surface 8112 of the lower housing 811 may be ensured, and the possibility that dry airflow leaks from between the flange surface 8513 and the expansion surface 8112 may be reduced, thereby preventing deterioration in the supply efficiency of dry air.

As the flange surface 8513 of the duct main body 851 and the expansion surface 8112 of the lower housing 811 are joined completely based on surface-to-surface contact therebetween, the flange surface 8513 and the expansion surface 8112 may be fastened by at least one fastener, preferably, a screw bolt.

Additionally, a plurality of screw holes may be provided on the expansion surface 8112 of the lower housing 811, and a screw bolt may pass through the screw hole to extend. Among the screw holes, first row screw holes 8112*a* disposed closest to the rear end of the expansion surface 8112 may be used for fastening the flange surface 8513.

The flange surface 8513 may have screw holes 8512*d* formed in positions corresponding to those of the first row screw holes 8112*a*.

Additionally, the bridge part 8512*c* is provided at an open rear end of the lower end portion 8512 of the duct main body 851 having a U shape, and extends across the open rear end of the duct main body 851 along the front-rear direction (F-R direction) while protruding from the flange surface 8513 perpendicularly.

As described above, the lower portion side of the bridge part 8512*c* is open at least partially, such that the above-described perpendicular inlet 85*a*2 is formed.

A lower side surface 8512*c*3 of the bridge part 8512*c* has a shape corresponding to the shape of the upper side surface 8121*a* of the rear end of the upper housing 812 described above. For example, the lower side surface 8512*c*3 of the bridge part 8512*c* may have the same arch shape as the upper side surface 8121*a* of the rear end of the upper housing 812.

As the flange surface 8513 of the duct main body 851 joins the expansion surface 8112 of the lower housing 811 in the surface-to-surface contact state, likewise, the lower side surface 8512*c*3 of the bridge part 8512*c* may surface-contact and join the upper side surface 8121*a* of the rear end of the upper housing 812 at least partially.

For example, the upper side surface 8121*a* of the rear end of the upper housing 812 joins the lower side surface 8512*c*3 of the bridge part 8512*c* in a way that the upper side surface 8121*a* of the rear end of the upper housing 812 is inserted into the perpendicular inlet 85*a*2 through the lower portion side of the bridge part 8512*c*.

Thus, the upper side surface 8121*a* of the rear end of the upper housing 812 may surface-contact the lower side surface 8512*c*3 of the bridge part 8512*c* while overlapping the lower side surface 8512*c*3 of the bridge part 8512*c* at least partially with respect to the perpendicular direction.

The overlapping between the upper side surface 8121*a* of the rear end of the upper housing 812 and the lower side surface 8512*c*3 of the bridge part 8512*c* may lead to the expansion of the contact surface and support surface between the bridge part 8512*c* and the upper side surface 8121*a* of the upper housing 812, and a significant reduction in the possibility that dry airflow leaks from the bridge part 8512*c* and the upper side surface 8121*a* of the upper housing 812.

Like the flange surface 8513 of the duct main body 851 and the expansion surface 8112 of the lower housing 811, as the lower side surface 8512*c*3 of the bridge part 8512*c* joins the upper side surface 8121*a* of the upper housing 812, based on surface-to-surface contact, completely, the bridge part 8512*c* and the upper housing 812 may be fastened through at least one fastener, preferably a screw bolt.

A plurality of screw holes may be provided on the expansion surface 8122 of the upper housing 812 and the expansion surface 8112 of the lower housing 811, and screw bolts penetrate the plurality of screw holes at the same and extend.

The screw holes through which the screw bolts pass and extend at the same time may be second row screw holes 8112*a* formed on the expansion surface 8112 of the lower housing 811, and be first row screw holes 8122*a* disposed closest to the rear end side of the upper housing 812.

Further, a screw boss 8512*c*4 may be provided respectively in a front end portion 8512*c*1 and a rear end portion 8512*c*2 of the bridge part 8512*c*, in a position corresponding to the position of the second row screw hole 8112*a* of the lower housing 811 and the first row screw hole 8122*a* of the upper housing 812, and the screw bolt having passed through the screw hole is screw-coupled to the screw boss 8512*c*4.

As the screw bolt having passed through the second row screw hole of the lower housing 811 and the first row screw hole of the upper housing 812 is screw-coupled to the screw boss 8512*c*4, the lower housing 811, the upper housing 812 and the bridge part 8512*c* may be fastened at the same time, enable a triple fastening structure.

Thus, the structure and process of fastening the duct main body 851 of the connection duct part 85 and the heater housing 81 may be simplified, and the number of fasteners may be minimized.

As illustrated in FIG. 22, the lower end surface of the screw boss 8512*c*4 of the upper housing 812, joining the upper side surface 8121*a* of the upper housing 812, may have/form a step that is disposed higher than the lower end surface of the flange surface 8513, to correspond to the thickness of the upper housing 812.

Further, as described above, the flange surface 8513 that has one open surface and has a U shape may be provided in the lower end portion 8512 of the duct main body 851, and be coupled to the expansion surface 8112 of the lower housing 811 based on surface-to-surface contact.

The surface-to-surface contact coupling may be ensured based on a slide coupling, for example.

Preferably, any one of the lower end portion 8512 of the duct main body 851 and the expansion surface 8112 of the lower housing 811 may be slide-coupled to the other or the lower end portion 8512 of the duct main body 851 and the expansion surface 8112 of the lower housing 811 may be slide-coupled to each other at the same time, while making a relative movement in the horizontal direction.

The slide coupling may be carried out in a way that the lower housing 811 to which the upper housing 812 is coupled moves toward the duct main body 851 horizontally, or the duct main body 851 moves toward the lower housing 811 horizontally. A slide coupling carried out by moving the lower housing 811 to which the upper housing 812 is coupled toward the duct main body 85 horizontally is described, for example, but not limited.

A slide coupling between the lower housing 811 and the duct main body 851 may start with the alignment of the expansion surface 8112 of the lower housing 811 and the flange surface 8513 of the duct main body 851 on the same horizontal surface in the up-down direction, as illustrated in FIG. 23.

The up-down alignment is to perform a slide coupling in the state where the expansion surface 8112 of the lower housing 811 surface-contacts and joins the flange surface 8513 of the duct main body 851.

Figure 24:
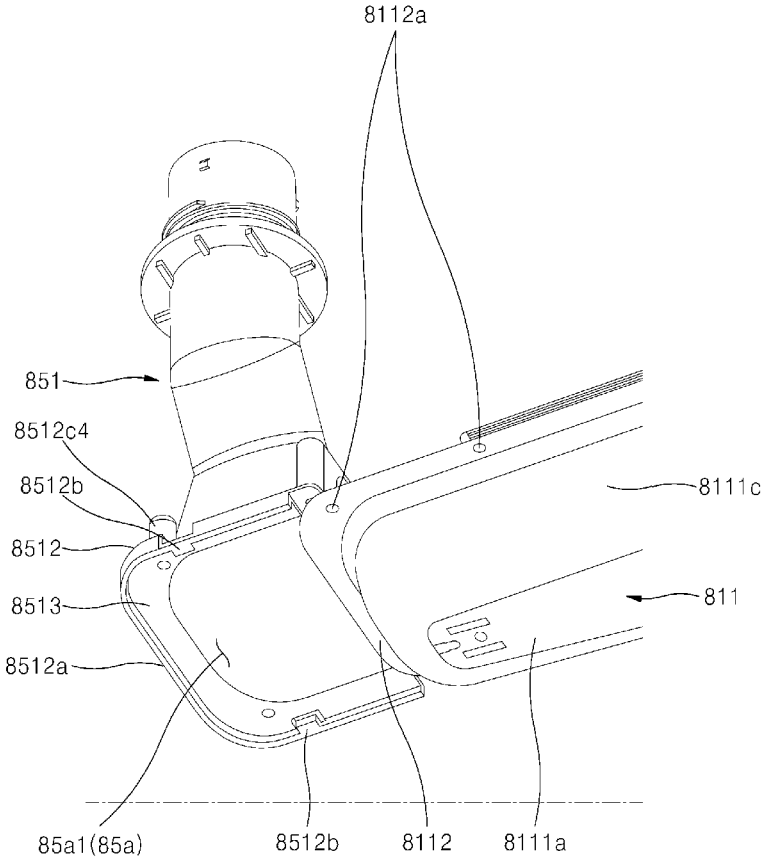
FIG. 24 is a bottom perspective view showing the initiation of a slide coupling between a heater housing and a connection duct part.

As the lower housing 811 moves toward the duct main body 851 horizontally in the state where the expansion surface 8112 of the lower housing 811 is aligned with the flange surface 8513 of the duct main body 851 as illustrated in FIG. 23, the rear end of the expansion surface 8112 of the lower housing 811 may start to be slide-coupled to the flange surface 8513 of the duct main body 851 while being inserted into the open lower portion of the bridge part 8512*c* of the duct main body 851 as illustrated in FIG. 24.

A means of guiding the slide movement of the expansion surface 8112 of the lower housing 811 may be provided on the flange surface 8513 forming the lower end surface of the duct main body 851.

For example, a means of guiding a slide movement may comprise a guide wall 8512*a* that protrudes from the flange surface 8513 in the downward direction (D-direction), and a guide projection 8512*b* that protrudes from the guide wall 8512*a* in parallel with the flange surface 8513.

The guide wall 8512*a* may extend along the horizonwise outer end portions of the flange surface 8513.

For example, the guide wall 8512*a* may continue to extend along the end portion of the outer side of the flange surface 8513 to have a shape corresponding to the shape of the horizonwise outer end portions of the expansion surface 8112 of the lower housing 811.

Figure 25:
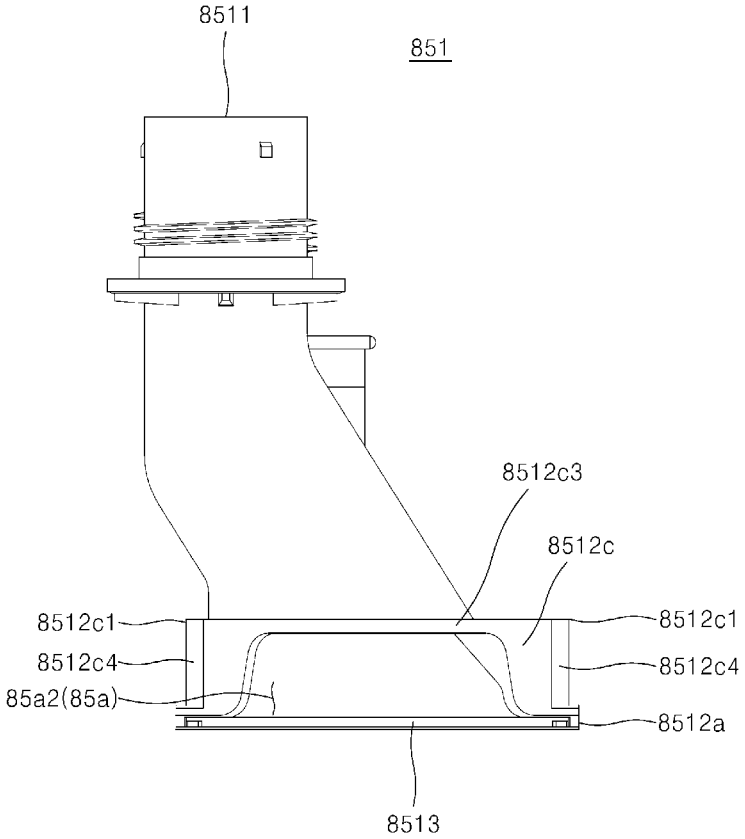
FIG. 25 is a side view of a connection duct part.
Figure 26:
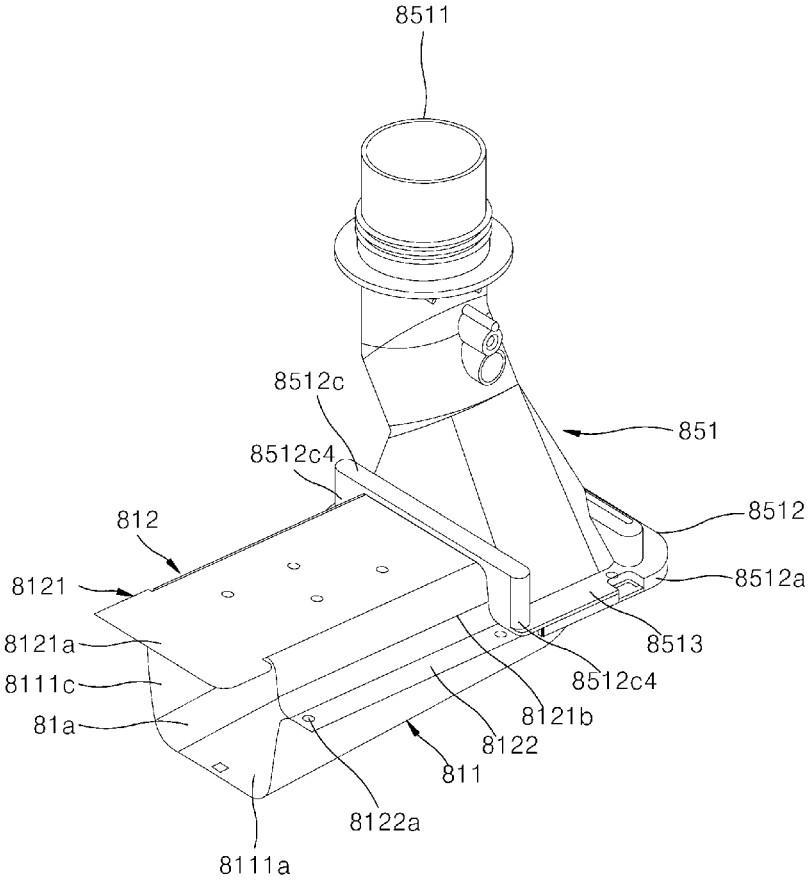
FIG. 26 is a top perspective view showing a heater housing and a connection duct part slide-coupled completely.

As shown in the illustrative embodiment of FIGS. 24 and 25, the guide wall 8512*a* may be comprised of a pair of linear extension parts that extends in parallel with the longitudinal direction, and a curved extension parts that has one end portion and the other end portion respectively connecting to the pair of linear extension parts continuously, for example.

Each of the linear extension parts may be provided in the front end portion and the rear end portion of the horizonwise outer end portions of the flange surface 8513 and extend linearly along a direction parallel with the longitudinal direction.

The inner surface of each of the linear extension parts contacts the front end portion and the rear end portion of the end portions of the outer side of the expansion surface 8112 of the lower housing 811 respectively at a time of slide of the lower housing 811.

Thus, the pair of linear extension parts may guide the lower housing 811 such that the slide movement of the lower housing 811 may be a linear movement in a direction parallel with the longitudinal direction.

The contact between the pair of linear extension part and the front end portion and rear end portion of the lower housing 811 may be maintained continuously even after the slide coupling is completed.

The curved extension part may be formed in a way that extends in a curved line shape along the left end portion of the horizonwise outer end portions of the flange surface 8513.

The shape of the curved extension part may correspond to the shape of the left end portion of the horizonwise outer end portions of the expansion surface 8112 of the lower housing 811.

The shape of the curved extension part may help the curved extension part to serve as a stopper that determines the position of a temporary assembly for the completion of the slide movement and a genuine assembly.

That is, when the lower housing 811 continues to slide and then the left end portion of the expansion surface 8112 of the lower housing 811 contacts the inner surface of the curved extension part, the lower housing 811 may not slide any longer.

As the left side end portion the of the expansion surface 8112 of the lower housing 811 contacts the inner surface of the curved extension part as described above, a slide movement is completed, that is, a slide coupling-based temporary assembly between the heater housing 81 and the duct main body 851 is completed.

As the slide coupling-based temporary assembly is completed, the above-described screw hole 8112*a*, 8122*a* of the lower housing 811 and the upper housing 812 and the screw hole 8512*d* of the lower end portion of the duct main body 851 corresponding thereto are aligned automatically. Accordingly, a genuine assembly using a screw bolt may proceed immediately with no need to set the position of the heater housing and the duct main body 851.

Additionally, a height at which the guide wall 8512*a* protrudes downward from the flange surface 8513 may be greater than the thickness of the expansion surface of the lower housing 811 such that the guide wall 8512*a* is provided with a guide projection 8512*b*, as described hereafter, while remaining constant approximately.

Even after the genuine assembly is completed, the guide wall 8512*a* and the lower housing 811's expansion surface 8112's horizonwise outer end portion may be in contact with each other.

Accordingly, the guide wall 8512*a* protrudes further downward than the coupling surface between the flange surface 8513 and the lower housing 811's expansion surface 8112, such that the guide wall 8512*a* is disposed to block the coupling surface perpendicularly.

Thus, the leakage of wash water drawn reversely and dry airflow may be additionally prevented.

Further, the guide wall 8512*a* may be provided continuously along the horizonwise outer end portion of the lower end portion 8512 of the duct main body 851 having a non-circular shape and arranged not to be provided at the right end portion side of the lower end portion 8512 of the duct main body 851 having a perpendicular inlet 85*a*2.

That is, the guide wall 8512*a* may be formed asymmetrically around the lower end suction opening 85*a* and guide the expansion surface 8112 of the lower housing 811 to allow the expansion surface 8112 to slide only in a single direction. The above-described structure that enables a relative movement and a coupling only in a single direction may help to prevent the misassembly of the lower housing 811 and the duct main body 851 of the dishwasher 1 of one embodiment effectively.

Additionally, the guide projection 8512*b* joins the lower portion of the sliding expansion surface 8112 of the lower housing 811 to prevent the lower housing 811 from separating from the flange surface 8513 in the up-down direction. Further, the guide projection 8512*b* may help to maintain the surface-to-surface contact between the lower housing 811's expansion surface 8112 and the flange surface 8513 after the completion of the slide movement.

To this end, the guide projection 8512*b* may be integrally formed at each of the pair of linear extension parts and protrude in parallel with the flange surface 8513 from the pair of linear extension parts.

To guide the slide movement and maintain the surface-to-surface contact, an up-down distance between the flange surface 8513 and the guide projection 8512*b* may be approximately the same as the thickness of the expansion surface 8112 of the lower housing 811.

Further, to prevent the expansion surface 8112 of the lower housing 811 from escaping from the flange surface 8513 in the downward direction, a transverse distance between the pair of guide projections 8512*b* may be less than the transverse width of the lower housing 811.

[Detailed Structure of Housing Connector and Fan Housing]

Hereafter, detailed structures of the housing connector 87 and the fan housing 82 of the dishwasher 1 of one embodiment and their coupling relationship are described with reference to FIGS. 1 to 27.

The housing connector 87, as described above, connects and fixes the fan housing 82 accommodating an air blowing fan to the heater housing 81 indirectly.

To this end, the fan housing 82 may be detachably coupled to one side, i.e., the right side in the illustrative embodiment, of the housing connector 87, which is the upper stream with respect to the flow direction of dry airflow (hereafter the longitudinal direction).

Additionally, the open front end of the heater housing 81 may be detachably coupled to the other side, i.e., the right side in the illustrative embodiment, of the housing connector 87, which is the lower stream with respect to the flow direction of dry airflow.

Figure 27:
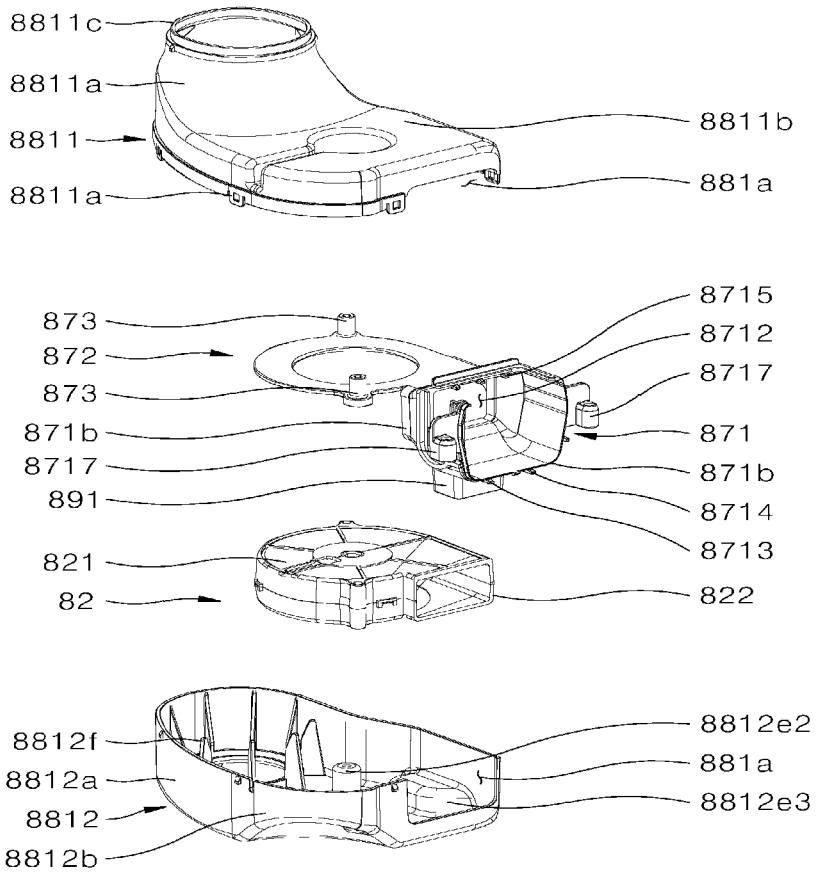
FIGS. 27 and 28 are exploded perspective views separately showing a housing connector, a fan housing and a filter housing among the components in FIGS. 7 and 8.
Figure 28:
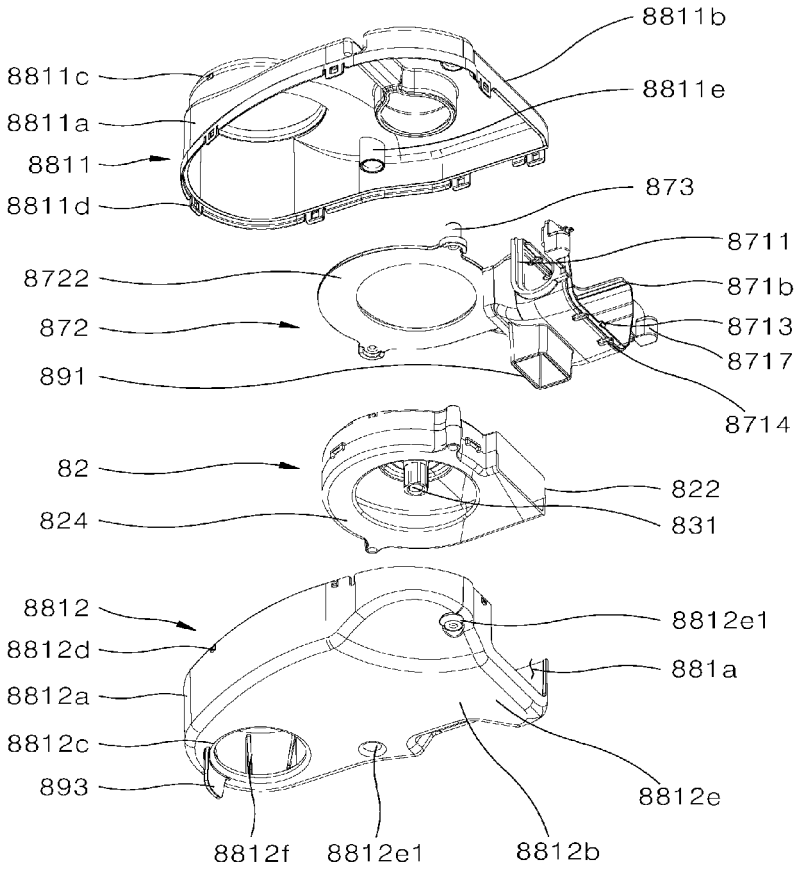

Specifically, the housing connector 87, as illustrated in FIGS. 27 and 28, may comprise a connector main body 871 having a box shape and having an inlet 8712, to which dry airflow discharged from the fan housing 82 is withdrawn, at a front end portion 871*a* thereof, and a connection tab 872 which protrudes toward the fan housing 82 from the front end portion 871*a* of the connector main body 871 and to which the fan housing 82 is coupled.

The connector main body 871 is coupled to the open front end of the heater housing 81, which is disposed at the lower stream with respect to the flow direction of dry airflow, and together with the heater housing 81, form an air passage C through which dry air flow flows.

To this end, the connector main body 871 may be formed into a hollow hole-shaped box having a vacant inner portion.

Specifically, the connector main body 871, as illustrated, may have an inner surface the cross section of which gradually expands, and preferably, formed into a rectangular funnel corresponding to the shape of the open front end of the heater housing 81.

The front end portion 871*a* of the connector main body 871, having the inlet 8712, may have an arm-type connector part 871*a*1 that extends toward the fan housing 82 along the longitudinal direction, to allow a below-described exhaust duct 822 of the fan housing 82 to be inserted and coupled in a connector form.

The arm-type connector part 871*a*1 may have an inner surface having a shape corresponding to the outer shape of the exhaust duct 822 such that the exhaust duct 822 of the fan housing 82 is inserted and coupled to the arm-type connector part 871*a*1.

For example, to correspond to the exhaust duct 822 having an outer shape of a rectangular cross section, the arm-type connector part 871*a*1 may be formed into a hollow hole-shaped container having an inner surface of a rectangular cross section.

Figure 30:
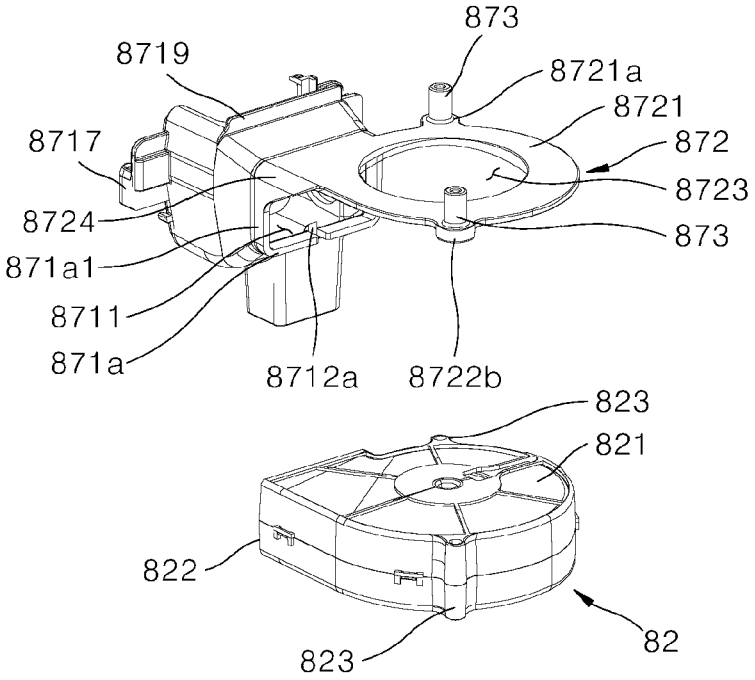
FIG. 30 is a rear perspective view showing a relationship between the housing connector and the fan housing in FIGS. 27 and 28.

As illustrated in FIG. 30, the connection tab 872 protruding from the front end portion 871*a* of the connector main body 871 forms the upper surface of the arm-type connector part 871*a*1 at least partially.

Additionally, both of the lateral surface portions of the arm-type connector part 871*a*1 may comprise a reinforcement surface 8724 that extends in a direction farther from the inlet 8712 and reinforces the connection tab 872. For example, the reinforcement surface 8724, as illustrated, may be provided in a triangular bracket having one side that integrally connects to the connection tab 872, and the other side that integrally connects to the arm-type connector part 871*a*1.

Further, the cross section of the air passage C may expand gradually along the flow direction of dry airflow on the inner surface of the connector main body 871, and the cross section of the rear end portion 871*b* coupled with the heater housing 81 may be approximately the same as the cross section of the front end portion of the heater housing 81. Accordingly, the flow loss of dry airflow may be minimized.

The connector main body 871 may minimize the transfer of heat generated in the heater 84 to the fan housing 82 through the heater housing 81, and support the fan housing 82 and the heater housing 81.

To this end, the connector main body 871 may be manufactured in a way that a plastic material having predetermined heat resistance is injection-molded.

Additionally, to support the fan housing 82 and the heater housing 81, a first leg 891 may be integrally formed in the lower portion of the connector main body 871 and protrudes toward the base.

In the illustrative embodiment, the upper surface and the front surface of the box-shaped connector main body 871 may be open at least partially.

The connector main body 871's upper and front surfaces being open at least partially provide a passage into which the heater main body 841 enters, while the heater main body 841 is disposed in and fixed to the air passage C.

The heater main body 841 may be indirectly supported in the state of separating from the heater housing 81 and the connector main body 871.

The front end side of the heater main body 841 may be supported by the terminal fixation part, in the state of separating from the connector main body 871. A pair of terminals may be fixed to the front surface of the terminal fixation part, in the state of protruding outward.

The rear end side of the heater main body 841 may be supported by the heater bracket 845 in the state of separating from the heater housing 81.

The partially open front surface of the connector main body 871 may form a fixation slot 8711 which has a U shape to correspond to the outer shape of the terminal fixation part and to which the terminal fixation part is coupled in a sliding manner.

The up-down slide of the terminal fixation part may be guided by the edge of the fixation slot 8711 and the terminal fixation part may have a guide groove that is coupled to the edge of the fixation slot 8711.

The partially open upper end of the connector main body 871 may be covered and shielded by the upper housing 812.

For example, the partially open upper end of the connector main body 871 may be covered and shielded by the upper side surface 8121*a* of the upper housing 812, as described above.

The front end portion of the upper side surface 8121*a* of the upper housing 812 surface-contacts the upper end surface of the connector main body 871, and the upper end surface of the connector main body 871 having a L shape forms a coupling surface 8716.

A plurality of second support ribs 8715 may be provided in the lower portion of the coupling surface 8716 and support the front end portion of the upper side surface 8121*a* of the upper housing 812, having entered into the connector main body 871, from below.

One end portion of the second support rib 8715 may be a fixed end that is fixed integrally to the lower portion of the coupling surface 8716, and the other end portion may be a free end portion that has a L shape.

A distance between the free end portion of the second support rib 8715 and the lower portion of the coupling surface 8716 may be approximately the same as the thickness of the front end portion of the upper side surface 8121*a* of the upper housing 812.

Accordingly, the front end portion of the upper side surface 8121*a* of the upper housing 812 may be fixed while being fit-coupled between the inner surface forming the lower portion of the coupling surface 8716 and the second support rib 8715.

The entirely open rear end portion 871*b* of the connector main body 871 may be fixed while being fit-coupled to the concave part 8111 of the lower housing 811 and the concave part 8121 of the upper housing 812 that form the inner surface of the heater housing 81.

At this time, the rear end portion 871*b* of the connector main body 871 may be fit-coupled in a way that the rear end portion 871*b* is partially inserted into the concave part 8111 of the lower housing 811 and the concave part 8121 of the upper housing 812.

For a fit-coupling forming surface-to-surface contact in a way similar to the front end portion 8121*a*1 of the upper side surface 8121*a* of the upper housing 812, a plurality of first support ribs 8714, as illustrated in FIG. 28, may be provided in the rear end portion 871*b* of the connector main body 871.

Like the second support rib 8715, the first support rib 8714 may have one end portion that is a fixed end integrally being fixed to the outer surface of the rear end portion 871*b* of the connector main body 871, and the other end portion that is a free end portion having a L-shape.

A distance between the free end portion of the first support rib 8714 and the outer surface of the rear end portion 871*b* of the connector main body 871 of the free end portion may be approximately the same as the thickness of the concave part 8111 of the lower housing 811 and the concave part 8121 of the upper housing 812.

Accordingly, the concave part 8111 of the lower housing 811 and the concave part 8121 of the upper housing 812 may be fixed while fit-coupling between the outer surface of the rear end portion 871*b* of the connector main body 871 and the first support rib 8714.

Additionally, as a means of maintaining the coupling state between the connector main body 871 and the heater housing 81 and preventing their separation, a holding projection 8713 may be provided in the rear end portion 871*b* of the connector main body 871 and protrude toward the heater housing 81, and to correspond to the holding projection 8713, a fastening hole 8111*b*5 may be provided at the heater housing 81 and the holding projection 8713 may elastically join the fastening hole 8111*b*5.

Figure 29:
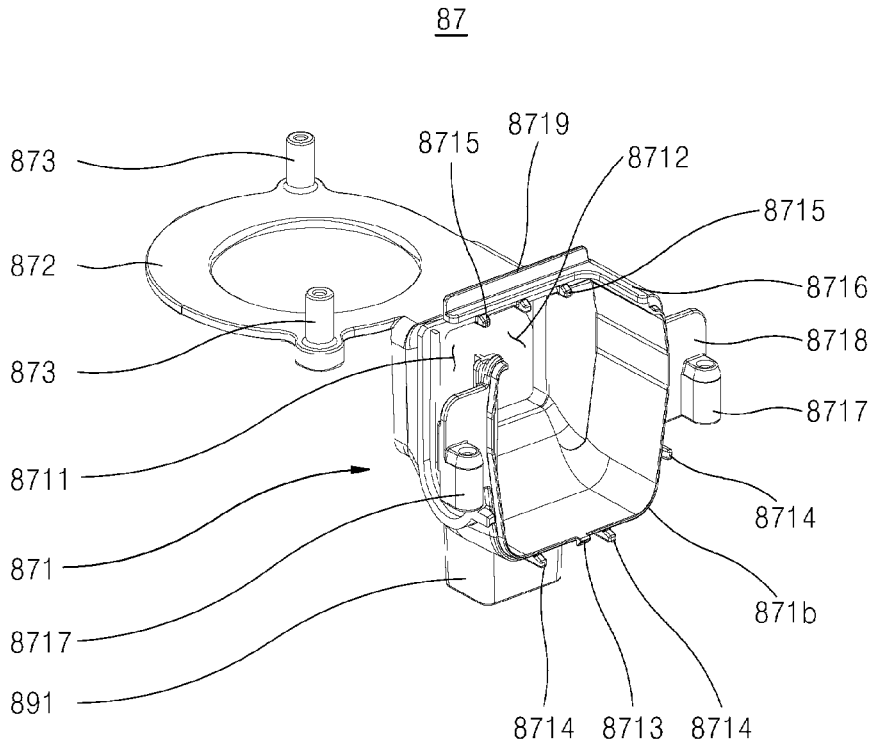
FIG. 29 a front perspective view showing the housing connector in FIGS. 27 and 28.

As illustrated in FIGS. 27 to 29, a main body holding rib 8719 may be integrally provided in the upper portion of the coupling surface 8716 of the connector main body 871, protrude perpendicularly, and extend in a direction across the flow direction of dry airflow (the transverse direction).

As described hereafter, the housing connector 87 and the fan housing 82 may be genuinely assembled with a screw bolt B, in the upside-down state, instead of an exclusive assembly jig that is provided additionally.

The main body holding rib 8719 serves as a leg that supports the housing connector 87 and the fan housing 82 in the upside-down state, against gravity, together with a fastening boss 873 of the connection tab 872 described hereafter, without an exclusive assembly jig provided additionally.

For the main body holding rib 8719 to serve as a leg smoothly, the up-down position of the upper end of the main body holding rib 8719 in the upside-down state may remain constant along the transverse direction.

As described hereafter, the upper end of the main body holding rib 8719 and the upper end of a pair of fastening bosses 873 may be formed to be disposed on the same flat surface P in the upside-down state.

Additionally, the connection tab 872 may extend in parallel with the upper surface 821 of the fan housing 82 from the inlet 8712 of the connector main body 871 in a direction in which the connection tab 872 covers the upper surface 821 of the fan housing 82.

The connection tab 872 has a shape that covers the upper surface 821 of the fan housing 82 entirely. To this end, the connection tab 872 may have a plate shape corresponding to the shape of the upper surface 821 of the fan housing 82, and extend from the upper side of the inlet 8712 approximately horizontally. Preferably, one end portion of the connection tab 872 connecting to the connector main body 871 may be integrally formed at the front end portion 871*a* side of the connector main body 871 in the upper side position of the inlet 8712 and form the upper surface of the arm-type connector part 871*a*1 described above.

As illustrated, a pair of fastening bosses 873 may be integrally provided on the upper surface 8721 of the connection tab 872 and extend perpendicularly or upward.

The connection tab 872 may be additionally provided with a boss support surface 8721*a* that protrudes outward in the horizontal direction such that the pair of fastening bosses 873 is installed in a position corresponding to the position of a bolt fastening part 823 of the fan housing 82 described hereafter.

A circular arc-shaped reinforcement rib 8722*b* may be disposed under the boss support surface 8721*a* in a way that surrounds the upper end of the bolt fastening part 823 of the fan housing 82.

The reinforcement rib 8722*b* may protrude downward from the lower surface of the boss support surface 8721*a* and join the upper end of the bolt fastening part 823.

The reinforcement rib 8722*b* may help to improve the strength of the lower portion of the boss support surface 8721*a*, and expand a surface fastened to the bolt fastening part 823 and increase a coupling force.

A screw hole may be formed respectively in the pair of fastening bosses 873 as described hereafter, and one end portion of the screw bolt B having passed through the fan housing 82 may be screw-coupled to the screw hole.

The pair of fastening bosses 873, as illustrated in FIG. 28, may be coupled to a guide boss 8811*e* that is provided in the first housing 8811 corresponding to the upper housing of the filtering part 88, in the state of being disposed at the base 90.

Hereafter, a process of coupling and assembling the fan housing 82 to the housing connector 87 is described with reference to FIG. 30.

To improve convenience and ease of assembly, the fan housing 82 may be fastened and assembled to the housing connector 87 before the heater 84 and the heater housing 81 are coupled to the housing connector 87.

At this time, as described above, at a time of fastening the fan housing 82, the connection tab 872 and the fan housing 82 may be fastened and assembled through a screw bolt B in an upside-down state or a reversed state of the state where the connection tab 872 and the fan housing 82 are disposed at the base 90.

However, a temporary assembly may precede the genuine assembly based on a screw bolt B.

The temporary assembly, as illustrated in FIG. 30, may be performed in a non-upside down state or in an upside-down state of the right position state where the fan housing 82 is disposed at the housing connector 87. For example, the assembly of the fan housing 82 to the housing connector 87 in the non-upside down state is described as illustrated in FIG. 30.

As described above, an arm-type connector part 871*a*1 may be formed at the connector main body 871 having an inlet 8712 and extend along the longitudinal direction to allow the exhaust duct 822 of the fan housing 82 to be inserted into the arm-type connector part 871*a*1 in a connector form.

For a temporary assembly, the exhaust duct 822 of the fan housing 82 is arranged to face the inlet 8712 of the connector main body 871, as illustrated in FIG. 30.

As the exhaust duct 822 of the fan housing 82 and the inlet 8712 of the connector main body 871 are arranged to face each other, the exhaust duct 822 of the fan housing 82 can fall into the state where the exhaust duct 822 can be inserted into the arm-type connector part 871*a*1 of the connector main body 871.

In this state, as the fan housing 82 moves toward the connector main body 871 horizontally, the exhaust duct 822 of the fan housing 82 may be inserted into the arm-type connector part 871*a*1 of the connector main body 871 through the inlet 8712.

As illustrated, a stopper projection 8712*a* may be integrally provided on the inner surface of the arm-type connector part 871*a*1 and protrude in a direction across the inlet 8712.

The stopper projection 8712*a* may protrude to have a height that is high enough to join the outer end portion of the exhaust duct 822.

Thus, the outer end portion of the exhaust duct 822 that moves through the inlet 8712 may be blocked from moving while joining the stopper projection 8712*a*.

As the outer end portion of the exhaust duct 822 joins the stopper projection 8712*a* as described above, the pair of bolt fastening parts 823 formed at the fan housing 82 may be aligned with the fastening bosses 873 respectively corresponding to the bolt fastening parts 823 to allow one end portion of the screw bolt B to penetrate.

Likewise, the circular arc-shaped reinforcement rib 8722*b* formed under the pair of fastening bosses 873 may be jointed respectively at the upper end of the bolt fastening part 823 of the fan housing 82.

That is, the stopper projection 8712*a* may set a relative position of the fan housing 82 and the housing connector 87 for a genuine assembly of the fan housing 82 and the housing connector 87.

As a temporary assembly between the fan housing 82 and the housing connector 87 is completed, a genuine assembly may proceed in the state of FIG. 30, i.e., in an upside-down state of the right position state.

In the upside-down state of the fan housing 82 and the housing connector 87, the pair of fastening bosses 873 and the main body holding rib 8719 of the connector main body 871 may serve as a leg that supports the connection tab 872 and the fan housing 82 against gravity in a non-fastening state.

That is, the fan housing 82 and the housing connector 87 in the upside-down state may be supported by the upper end of the pair of fastening bosses 873 and the upper end of the main body holding rib 8719 in the right position.

For the pair of fastening bosses 873 and the main body holding rib 8719 to function as a leg, the up-down position of the upper end of the main body holding rib 8719 and the up-down position of the upper end of the pair of fastening bosses 873 may be the same.

Figure 31:
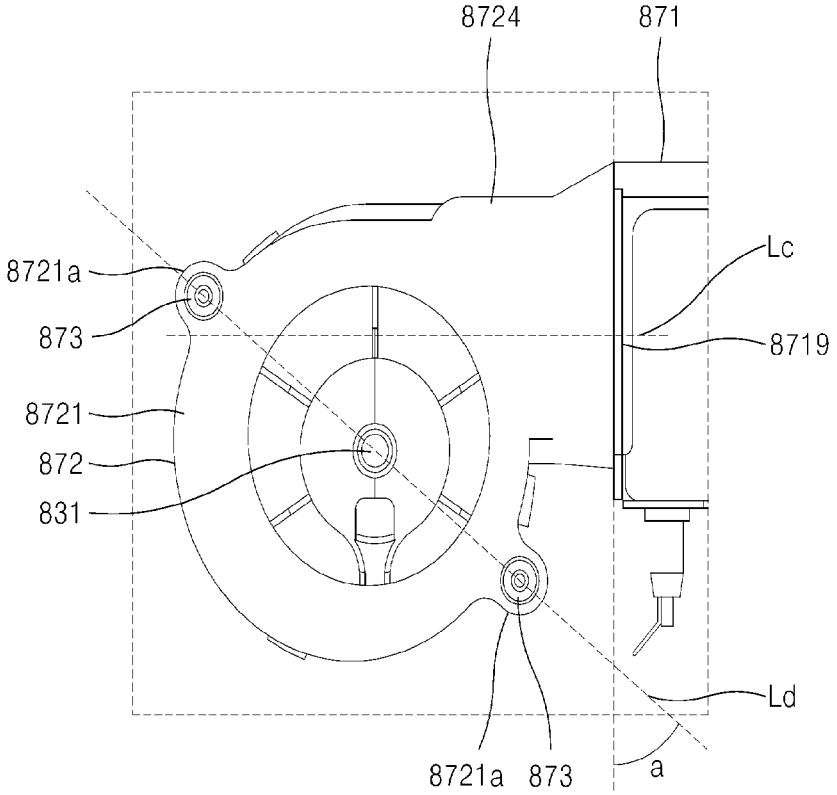
FIG. 31 is a plan view showing a housing connector and a fan housing assembled temporarily.
Figure 32:
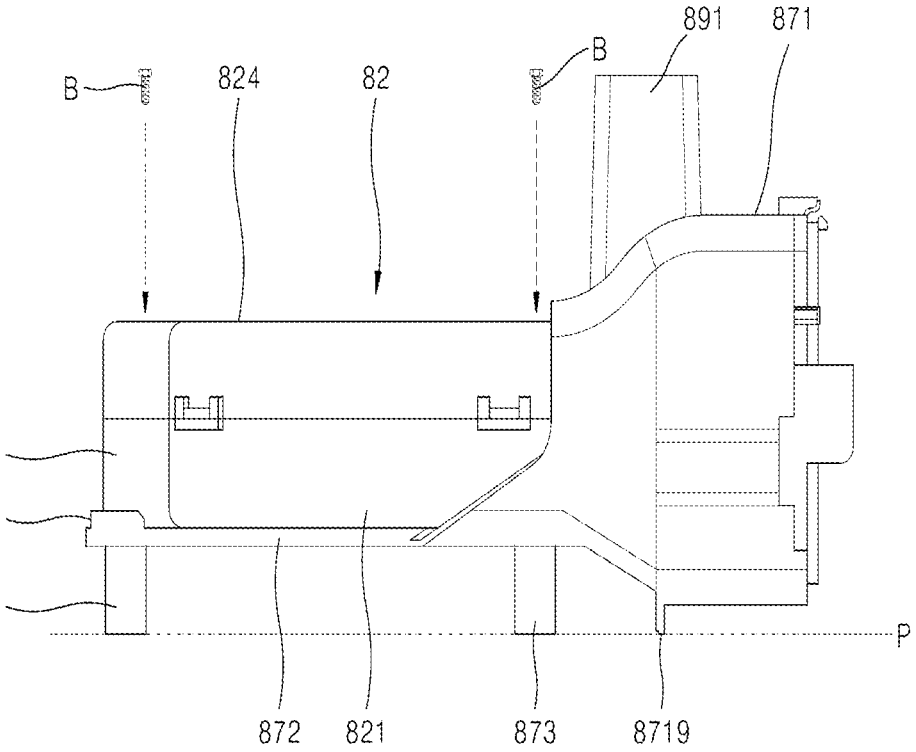
FIGS. 32 and 33 are front views showing a process of genuinely assembling a housing connector and a fan housing upside down.

That is, as illustrated in FIGS. 31 and 32, the upper end of the pair of fastening bosses 873 and the upper end of the main body holding rib 8719 may be disposed on the same flat surface P such that the pair of fastening bosses 873 and the main body holding rib 8719 becomes a leg having an at least three spot support structure.

Further, the self load and assembly load of the fan housing 82 are directly applied to the pair of fastening bosses 873 at a time of a genuine assembly.

To distribute and the load and support the fan housing 82 and the housing connector 87, the pair of fastening bosses 873, as illustrated in FIG. 31, may be spaced from each other along the radial direction of the air blowing fan with the rotation axis of the air blowing fan therebetween.

FIG. 31 shows the pair of fastening bosses 873 are disposed with the rotation axis 831 therebetween such that the center of the pair of fastening bosses 873 and the rotation center of the rotation axis 831 are arranged linearly on the same straight line, for example. Hereafter, the center of the pair of fastening bosses 873 and the rotation center of the rotation axis 831 are arranged linearly along the same straight line, for example, but not limited.

Additionally, to ensure a three spot support structure effectively and distribute the load of the fan housing 82 and the housing connector 87 and support the same properly, the main body holding rib 8719 of the connector main body 871 may be disposed further downstream than the pair of fastening bosses 873 with respect to flow direction of dry airflow.

As illustrated in FIG. 31, the position of the pair of fastening bosses 873 may be set on a straight line Ld passing through the center of the pair of fastening bosses 873 and the rotation center of the rotation axis 831, to form an acute angle a with respect to the direction of the extension of the upper end of the main body holding rib 8719 of the connector main body 871 (the longitudinal direction).

Further, the upper end of the main body holding rib 8719 extends linearly along a direction across an extension line Lc extending in a parallel direction with the flow direction of dry airflow and passing through the center of the inlet 8712 of the connector main body 871, and the pair of fastening bosses 873 may be spaced from each other with the extension line Lc therebetween. Accordingly, since the center of gravity of the air blowing fan 83 that is a centrifugal fan such as a sirocco fan is formed between the pair of fastening bosses 873 and the main body holding rib 8719, the fan housing 82 may be supported without be biased toward any one side, in an upside-down state, as described hereafter.

In the state where the fan housing 82 in the upside-down state is supported by the pair of fastening bosses 873 and the main body holding rib 8719 of the connector main body 871, the fan housing 82 and the housing connector 87 may be fastened and assembled through a pair of screw bolts B that are fasteners.

Figure 33:
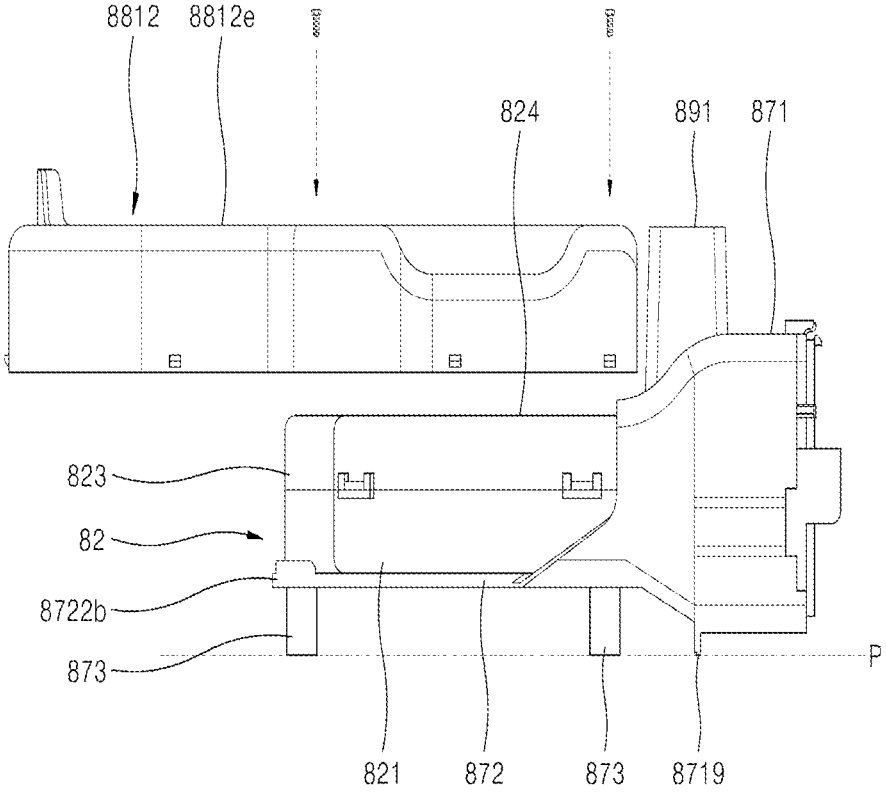

The pair of screw bolts B may fasten the fan housing 82 and the pair of fastening bosses 873 only, as illustrated in FIG. 32, or may fasten the second housing 8812 constituting the lower housing of the filter housing 881, the fan housing 82 and the pair of fastening bosses 873 at the same time, as illustrated in FIG. 33.

That is, the dry air supply part 80 of one embodiment may be assembled in a way that the fan housing 82 is disposed at the filter accommodation part 8812*a* of the second housing 8812 after the fan housing 82 and the housing connector 87 are fastened and assembled regardless of the filtering part 88, or fastened and assembled through a screw bolt B after the second housing 8812 is moved such that the fan housing 82 is disposed at the filter accommodation part 8812*a* of the second housing 8812 in the state where the fan housing 82 and the housing connector 87 are temporarily assembled.

FIG. 32 shows that the fan housing 82 is disposed at the filter accommodation part 8812*a* of the second housing 8812 after the fan housing 82 and the housing connector 87 are fastened and assembled regardless of the filtering part 88.

Referring to FIG. 32, one end portion of the pair of screw bolts B, having a screw thread, may pass through the bolt fastening part 823 of the fan housing 82, move downward and then be screw-coupled to the pair of fastening bosses 873 of the connection tab 872.

At this time, as one end portion of the pair of screw bolts B and the pair of fastening bosses 873 are screw-coupled, a head part provided in the other end portion of the pair of screw bolts B may directly pressurize the bolt fastening part 823 of the fan housing 82 to fasten.

FIG. 33 shows that the dry air supply part 80 of one embodiment is fastened and assembled through a screw bolt B after the second housing 8812 is moved in an upside-down state such that the fan housing 82 is disposed at the filter accommodation part 8812*a* of the second housing 8812 in the state where the fan housing 82 and the housing connector 87 are temporarily assembled.

Referring to FIG. 33, one end portion of the pair of screw bolts B, having a screw thread, passes through a pair of bolt holes 8812*e*1 (FIG. 34) formed on the lower surface 8812*e* of the second housing 8812 of the filtering part 88, then passes through the bolt fastening part 823 of the fan housing 82, and while moving downward, is screw-coupled to the pair of fastening bosses 873 of the connection tab 872.

Figure 34:
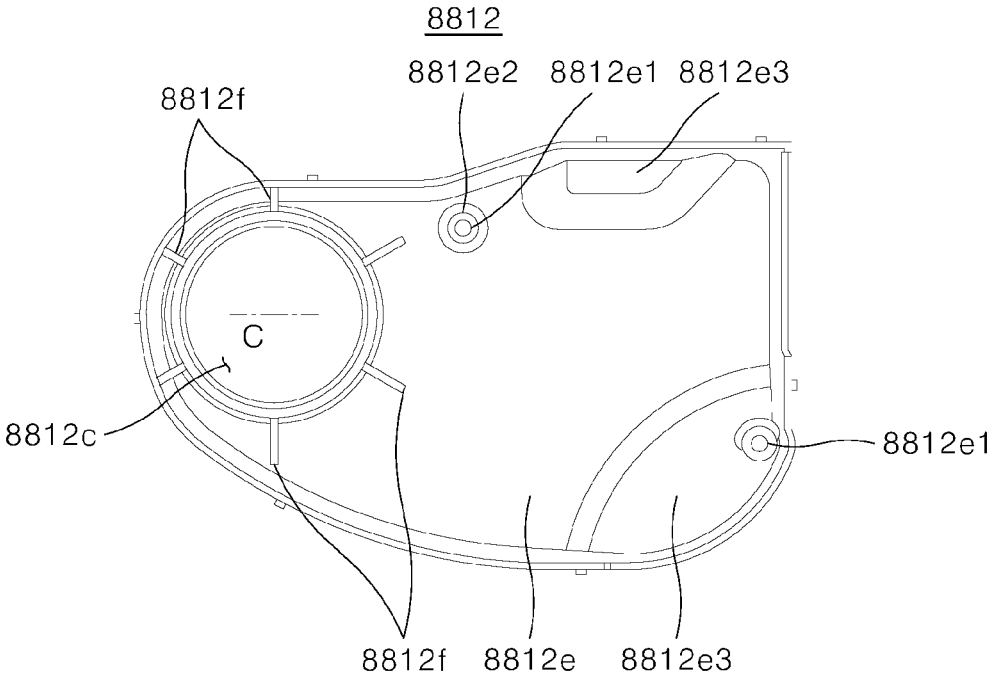
FIG. 34 is a plan view showing a second housing in FIG. 33.

At this time, as one end portion of the pair of screw bolts B and the pair of fastening bosses 873 is screw-coupled, the head part provided in any one of the other end portions of the screw bolts B may be fastened in a way that directly pressurizes surroundings of the bolt hole 8812*e*1 of the screw boss 8812*e*2 protruding upward from the lower surface 8812*e* of the second housing 8812 of the filter housing 881, as illustrated in FIG. 34.

Additionally, the head part provided in the other end portion remaining may be fastened in a way that directly pressurizes surroundings of the bolt hole 8812*e*1 provided at the uplifted surface part 8812*e*3.

That is, the second housing 8812 of the filter housing 881, the fan housing 82 and the housing connector 87 may be fastened at the same time by the pair of screw bolts B.

The screw bolt B as a fastener is used commonly for fastening the second housing 8812 of the filter housing 881, the fan housing 82 and the housing connector 87, as described above, thereby ensuring a reduction in man hours for assembly and assembly costs and improvement in structural reliability.

Further, as a genuine assembly between the fan housing 82 and the housing connector 87, based on the screw bolt B, is completed in the above-described process, the first housing 8811 of the filtering part 88, the heater 84, the heater housing 81 and the like may be fastened and assembled, in the right position state that is a reversed state of the upside-down state or in the state where the fan housing 82 and the housing connector 87 are disposed at the base.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

The invention claimed is:

1. A dishwasher comprising:

a tub defining a wash space configured to accommodate a wash object, the wash space including a front surface that is open; and a dry air supply part configured to generate dry airflow for drying the wash object and supply the dry airflow into the tub, the dry air supply part including:

a heater housing having an air passage configured to pass the dry airflow, a heater disposed at the air passage, and configured to heat the dry airflow, and a support leg coupled to the heater housing, wherein a first penetration hole is defined at a bottom surface of the heater housing and configured to perform a drain function, wherein the support leg is coupled to the heater housing by passing through the first penetration hole of the heater housing, wherein the support leg comprises:

a base, a leg body coupled to the heater housing, the leg body including a lower portion supported by the base, and defining a through hole penetrated by a fastener, and a coupling projection disposed adjacent to the through hole, the coupling projection protruding from the leg body towards a surface of the heater housing, and wherein the coupling projection comprises:

a pair of first coupling projections disposed apart from each other with the through hole therebetween, the pair of first coupling projections protruding from an upper side surface of the leg body toward the bottom surface of the heater housing, and a second coupling projection disposed between the pair of first coupling projections and an outer side edge of the upper side surface of the leg body, the second coupling projection protruding from the upper side surface of the leg body toward the bottom surface of the heater housing and being inserted into the first penetration hole of the heater housing.

2. The dishwasher of claim 1, wherein the dry air supply part further comprises:

a heater bracket disposed at the air passage and configured to support the heater and separate the heater from the bottom surface of the heater housing;

wherein the heater bracket and the support leg are coupled to the heater housing through the fastener; and wherein the heater housing defines a fixation hole penetrated by the fastener.

3. The dishwasher of claim 2, wherein the heater housing defines a pair of first coupling holes accommodating each of the pair of first coupling projections inserted thereinto, and wherein the first penetration hole defines a second coupling hole into which the second coupling projection is inserted.

4. The dishwasher of claim 3, wherein the first penetration hole further comprises a drain part disposed at the second coupling hole and configured to discharge wash water from the tub toward an outside of the dry air supply part.

5. The dishwasher of claim 4, wherein a cross section of the drain part is greater than a cross section of the second coupling hole.

6. The dishwasher of claim 4, wherein a lower portion of the drain part is at least partially blocked by the upper side surface of the leg body.

7. The dishwasher of claim 4, wherein the drain part is disposed at a position lower than a position of the heater with respect to an up-down direction.

8. The dishwasher of claim 1, wherein the dry air supply part further comprises:

a fan assembly disposed at an upstream side of the heater housing with respect to a flow direction of the dry airflow; and a housing connector having one side detachably coupled to the fan assembly and another side coupled to the heater housing, and wherein the housing connector includes:

a holding projection that protrudes toward the heater housing, and a second penetration hole defined at the bottom surface of the heater housing and coupled to the holding projection, the second penetration hole configured to perform a drain function.

9. The dishwasher of claim 8, wherein the second penetration hole is configured, based on being coupled with the holding projection, to be at least partially open.

10. The dishwasher of claim 8, wherein the housing connector comprises;

a connector main body including an inlet configured to receive dry airflow discharged from the fan assembly, the inlet disposed at a front end portion thereof, and a connection tab protruding toward the fan assembly from the front end portion, and being coupled with the fan assembly, wherein a front end of the heater housing is coupled to a rear end portion of the connector main body, the rear end portion of the connector main body disposed at a downstream side of the front end portion and at least partially open, and wherein the holding projection protrudes from the rear end portion of the connector main body toward the second penetration hole.

11. The dishwasher of claim 10, wherein the second penetration hole is defined at a position lower than a position of an inner lower surface of the connector main body with respect to an up-down direction.

12. The dishwasher of claim 10, wherein the bottom surface of the heater housing comprises an inclined surface having an upward inclination angle at which an up-down height increases along the flow direction from the front end of the heater housing, and wherein the second penetration hole is defined at the inclined surface.

13. The dishwasher of claim 1, wherein the dry air supply part further comprises:

a connection duct part configured to guide the dry airflow from the heater housing to the tub, wherein the heater housing includes an outlet configured to discharge the dry airflow, and an expansion surface extending around the outlet along a horizontal direction, and wherein a lower end of the connection duct part is configured to be in fluid communication with the outlet, based on being in contact with the expansion surface.

14. The dishwasher of claim 13, wherein a flange surface is disposed at the lower end of the connection duct part and expands in the horizontal direction, in parallel with the expansion surface while being in contact with the expansion surface.

15. The dishwasher of claim 14, wherein the expansion surface is configured, based on the connection duct part or the heater housing moving toward each other in the horizontal direction, to be coupled to the flange surface.

16. The dishwasher of claim 15, wherein the flange surface comprises:

a guide wall extending along an outer end portion thereof; and at least one guide projection protruding from the guide wall toward a lower portion of the expansion surface and disposed at the outer end portion of the flange surface.

17. The dishwasher of claim 1, wherein the dry air supply part further comprises:

a fan assembly disposed at an upstream side of the heater housing with respect to a flow direction of the dry airflow, and accommodating an air blowing fan configured to generate the dry airflow; and a housing connector having one side coupled to the fan assembly and another side coupled to the heater housing, wherein the housing connector comprises:

a fastening boss protruding and coupled to the fan assembly, and a main body holding rib protruding and extending in a direction across the flow direction of the dry airflow, and wherein an upper end of the fastening boss and an upper end of the main body holding rib are disposed at a same surface.

18. The dishwasher of claim 17, wherein the housing connector comprises:

a connector main body including an inlet configured to receive dry airflow discharged from the fan assembly, the inlet disposed at a front end portion thereof and having a box shape; and a connection tab protruding from the front end portion toward the fan assembly covering an upper surface of the fan assembly and having a plate shape, wherein the fastening boss protrudes from an upper surface of the connection tab in a perpendicular direction, and wherein the main body holding rib protrudes from an upper surface of the connector main body in the perpendicular direction.

19. The dishwasher of claim 18, wherein the fan assembly and the housing connector are coupled to each other in an upside-down state, wherein the fan assembly and the housing connector are disposed at the base of the support leg.

* * * * *